US007784777B2

(12) United States Patent
Dobashi et al.

(10) Patent No.: US 7,784,777 B2
(45) Date of Patent: Aug. 31, 2010

(54) SHEET LOADER, SHEET FOLDING APPARATUS, AND SHEET FINISHING SYSTEM

(75) Inventors: Shoichi Dobashi, Izunokuni (JP); Yasunobu Terao, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 266 days.

(21) Appl. No.: 12/031,439

(22) Filed: Feb. 14, 2008

(65) Prior Publication Data

US 2008/0308984 A1 Dec. 18, 2008

Related U.S. Application Data

(60) Provisional application No. 60/943,597, filed on Jun. 13, 2007, provisional application No. 60/944,962, filed on Jun. 19, 2007, provisional application No. 60/968,249, filed on Aug. 27, 2007, provisional application No. 60/970,139, filed on Sep. 5, 2007.

(30) Foreign Application Priority Data

Oct. 5, 2007 (JP) ..... 2007-262761

(51) Int. Cl.
*B65H 9/04* (2006.01)

(52) U.S. Cl. ..... 270/46; 270/20.1; 270/32; 270/51; 270/58.07; 270/58.17; 270/58.27

(58) Field of Classification Search ..... 270/20.1, 270/32, 37, 45, 46, 51, 58.07, 58.17, 58.27; 271/213; 493/416
See application file for complete search history.

(56) References Cited

U.S. PATENT DOCUMENTS

| | | | | |
|---|---|---|---|---|
| 5,305,994 | A * | 4/1994 | Matsui et al. | 270/58.13 |
| 6,022,011 | A * | 2/2000 | Hirose | 270/37 |
| 6,810,231 | B2 * | 10/2004 | Kobayashi et al. | 399/367 |
| 7,389,979 | B2 * | 6/2008 | Kaneko | 270/58.07 |
| 2008/0315481 | A1 * | 12/2008 | Iguchi et al. | 270/20.1 |
| 2008/0315482 | A1 * | 12/2008 | Iguchi et al. | 270/20.1 |
| 2008/0315483 | A1 * | 12/2008 | Iguchi et al. | 270/20.1 |
| 2008/0315484 | A1 * | 12/2008 | Iguchi et al. | 270/20.1 |
| 2008/0315485 | A1 * | 12/2008 | Iguchi et al. | 270/20.1 |

(Continued)

FOREIGN PATENT DOCUMENTS

| | | |
|---|---|---|
| JP | 60-019656 | 1/1985 |

(Continued)

*Primary Examiner*—Gene Crawford
*Assistant Examiner*—Leslie A Nicholson, III
(74) *Attorney, Agent, or Firm*—Turocy & Watson, LLP

(57) ABSTRACT

A sheet loader for loading a folded sheet bundle provided from a sheet bundle provider with a folded edge of the folded sheet bundle in a lead, including: an undersurface support configured to support an undersurface of the folded sheet bundle provided from the sheet bundle provider; a folded edge blocker configured to take a blocking position to block the folded edge of the folded sheet bundle on the undersurface support and a releasing position to release the folded sheet bundle; and a joint configured to evacuate from an orbit of the folded edge blocker returning from the releasing position to the blocking position, the joint is configured to join the undersurface support with the folded edge blocker at the blocking position after the returning to the blocking position.

19 Claims, 80 Drawing Sheets

U.S. PATENT DOCUMENTS

| | | | | |
|---|---|---|---|---|
| 2008/0315486 | A1* | 12/2008 | Iguchi et al. | 270/20.1 |
| 2008/0315487 | A1* | 12/2008 | Iguchi et al. | 270/37 |
| 2008/0315488 | A1* | 12/2008 | Iguchi et al. | 270/37 |

FOREIGN PATENT DOCUMENTS

| | | |
|---|---|---|
| JP | 09-040263 | 2/1997 |
| JP | 11-322163 | 11/1999 |
| JP | 2001-240292 | 9/2001 |
| JP | 2003-261256 | 9/2003 |
| JP | 2004-099291 | 4/2004 |
| JP | 2004-331332 | 11/2004 |

* cited by examiner (a)

(b)

(c)

SHEET LOADER, SHEET FOLDING APPARATUS, AND SHEET FINISHING SYSTEM

CROSS-REFERENCE TO RELATED APPLICATIONS

This non-provisional application is based upon and claims the benefit of priority from: U.S. provisional application 60/943,597, filed on Jun. 13, 2007; U.S. provisional application 60/944,962, filed on Jun. 19, 2007; U.S. provisional application 60/968,249, filed on Aug. 27, 2007; and U.S. provisional application 60/970,139, filed on Sep. 5, 2007, the entire contents of each of which are incorporated herein by reference.

This application is also based upon and claims the benefit of priority from Japanese Patent Application No. 2007-262761, filed on Oct. 5, 2007, the entire contents of which are incorporated herein by reference.

TECHNICAL FIELD

Exemplary embodiments described herein relate to a sheet loader, a sheet folding apparatus, and a sheet finishing system. More particularly, exemplary embodiments described herein relate to a sheet tray to load folded sheet bundles.

BACKGROUND

JP-H11-322163-A2 describes a problem in paragraph 0295 and FIG. 63 that the height of a stack of folded sheet bundles is much higher only at a side of the folded edge if the folded sheet bundles are stacked with each folded edge overlapping one another because of a spring effect each possesses even if each bundle is folded strongly. In the situation of stacked folded sheet bundles, the open sides of the stack, that is, the side opposite of the folded edges, do not have such a high height. If extra sheet bundles are continually added on the stack, the stack eventually collapses towards the side of the open ends.

JP-H11-322163-A2 further describes a stay 106*a* to avoid such an occasion of stack collapse. The stay 106*a* is almost the same height as the height of a stack of predetermined number of sheet bundles with their folded edges overlapping each other. The stay 106*a* is set under the open end side of the stack. However, the stay 106*a* is not sufficient enough to support various kinds of sheet bundles because the individual height of the sheet bundles changes depending on such factors as temperature and humidity.

JP-H11-322163-A2 yet describes a proposed solution to avoid such a voluminous stacking in paragraph 0293 and FIG. 62. The proposed solution is to stack the sheet bundles with shifting each folded edge of a bundle off from the folded edge of other bundles to an open end side of a sheet bundle below, individually. However, this proposed solution raises another problem. Specifically, an increasing number of sheet bundles undesirably increases the size of the footprint of the stack.

Moreover, JP-2003-261256-A2 describes controlling a moving distance of a sheet stopper mechanism moving in a horizontal direction on a basis of the height of a stack of sheet bundles on an inclined sheet stacker to increase a load capacity.

But the control does not work well before the stack exceeds a predetermined height. In other words, the stack of sheet bundles tends to be unstable when the stack is higher than the predetermined height. The stack of sheet bundles also tends to be unstable after stacking many sheet bundles because sheet bundles stop at the horizontal floor where the sheet stopper moves around.

SUMMARY

The following presents a simplified summary in order to provide a basic understanding of one or more aspects of the invention. This summary is not an extensive overview of the invention. It is not intended to identify key or critical elements, nor to delineate the scope of the claimed subject matter. Rather, the sole purpose of this summary is to present some concepts of the invention in a simplified form as a prelude to the more detailed description that is presented hereinafter.

According to an exemplary embodiment, one aspect of the invention is a sheet loader for loading a folded sheet bundle provided from a sheet bundle provider with a folded edge of the folded sheet bundle in a lead, including: an undersurface support configured to support an undersurface of the folded sheet bundle provided from the sheet bundle provider; a folded edge blocker configured to take a blocking position to block the folded edge of the folded sheet bundle on the undersurface support and a releasing position to release the folded sheet bundle; and a joint configured to evacuate from an orbit of the folded edge blocker returning from the releasing position to the blocking position, the joint is configured to join the undersurface support with the folded edge blocker at the blocking position after the returning to the blocking position.

Another aspect of the invention relates to a sheet folding apparatus, including: a sheet folder configured to fold a sheet bundle; a sheet bundle discharger configured to provide a folded sheet bundle with a folded edge of the folded sheet bundle in a lead; an undersurface support configured to support an undersurface of the folded sheet bundle discharged from the sheet bundle discharger; a folded edge blocker configured to take a blocking position to block the folded edge of the folded sheet bundle on the undersurface support and a releasing position to release the folded sheet bundle; and a joint configured to evacuate from an orbit of the folded edge blocker returning from the releasing position to the blocking position, the joint is configured to join the undersurface support with the folded edge blocker at the blocking position after the returning to the blocking position.

Yet another aspect of the invention relates to a sheet finishing system, including: a printer configured to print images on a plurality of sheets; a sheet folder configured to fold a sheet bundle including the plurality of sheets already printed by the printer; a sheet bundle discharger configured to provide a folded sheet bundle with a folded edge of the folded sheet bundle in a lead; an undersurface support configured to support an undersurface of the folded sheet bundle discharged from the sheet bundle discharger; a folded edge blocker configured to take a blocking position to block the folded edge of the folded sheet bundle on the undersurface support and a releasing position to release the folded sheet bundle; and a joint configured to evacuate from an orbit of the folded edge blocker returning from the releasing position to the blocking position, the joint is configured to join the undersurface support with the folded edge blocker at the blocking position after the returning to the blocking position.

To the accomplishment of the foregoing and related ends, the invention, then, comprises the features hereinafter fully described. The following description and the annexed drawings set forth in detail certain illustrative aspects of the invention. However, these aspects are indicative of but a few of the various ways in which the principles of the invention may be employed. Other aspects, advantages and novel features of the invention will become apparent from the following description when considered in conjunction with the drawings.

BRIEF DESCRIPTION OF THE SEVERAL VIEWS OF THE DRAWINGS

The invention and attendant advantages therefore are best understood from the following description of the non-limiting embodiments when read in connection with the accompanying Figures, wherein.

DETAILED DESCRIPTION

Figure 1:
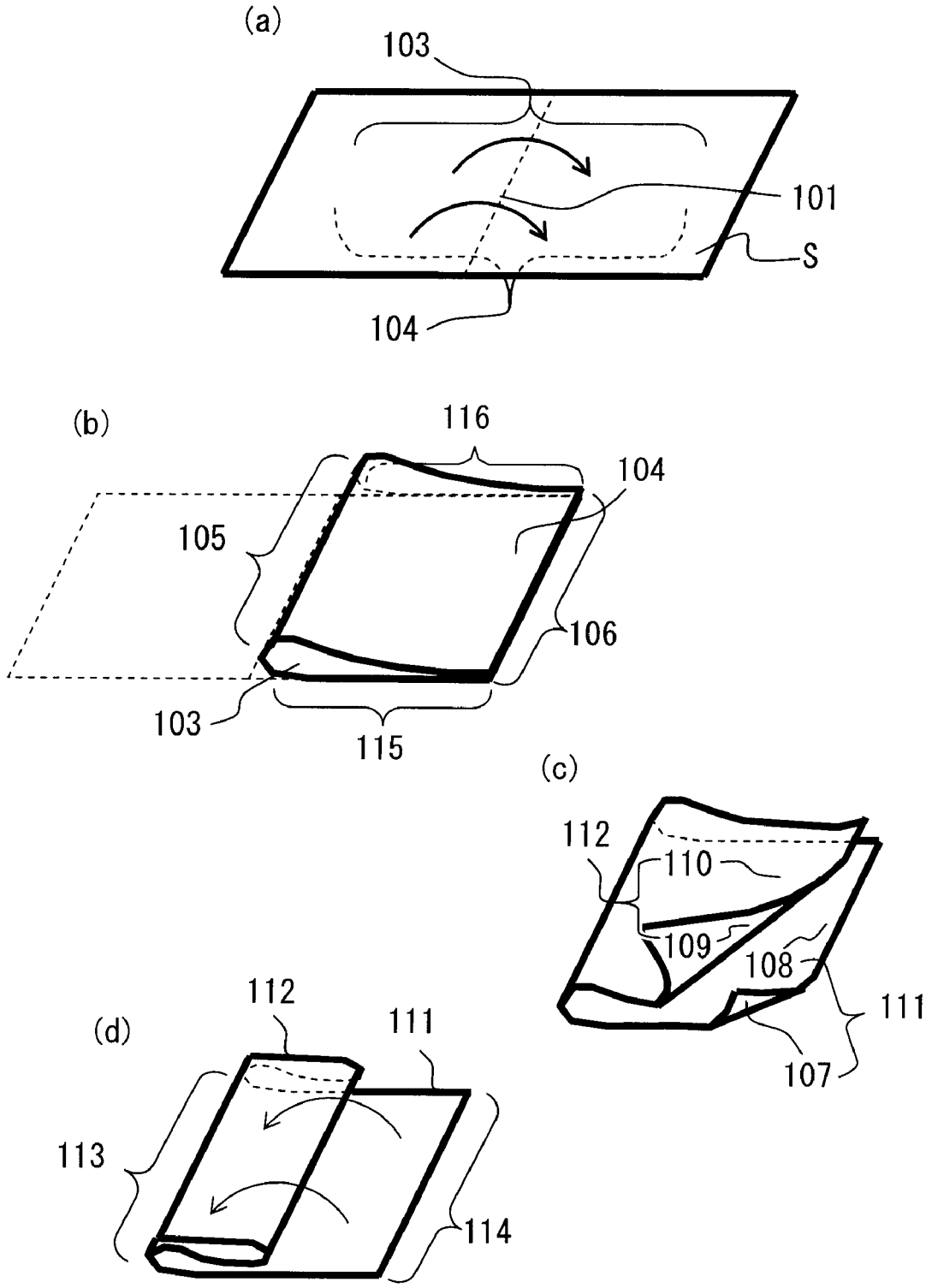
FIG. 1 is a diagram illustrating examples of sheets folded at center of their longitudinal direction.

Referring now to the Figures in which like reference numerals designate identical or corresponding parts throughout the several views.

In this description, the folded edges side of a stack of folded sheet bundles, where folded edges of sheet bundles overlap with each other, is positioned to overlap an open end of the preceding stack of folded sheet bundles. As a consequence, a footprint of a support for all of the sheet bundles is shorter than the footprint of a conventional support for all of the sheet bundles laid their folded edge with the folded edge of each bundle overlapping on the open end of each other adjacent bundle as described in the paragraph 0293 and FIG. 62 of the JP-H11-322163-A2. Furthermore, the stacking orientation in accordance with the invention avoids the undesirable stability fluctuation of the stack caused by height differences in the stack when all folded edges are aligned. Moreover, sheet bundles are well aligned with each folded edge overlapping on each open end of the others respectively by collapsing the stack with the stack sliding.

(1) Definition about a Sheet

Figure 2:
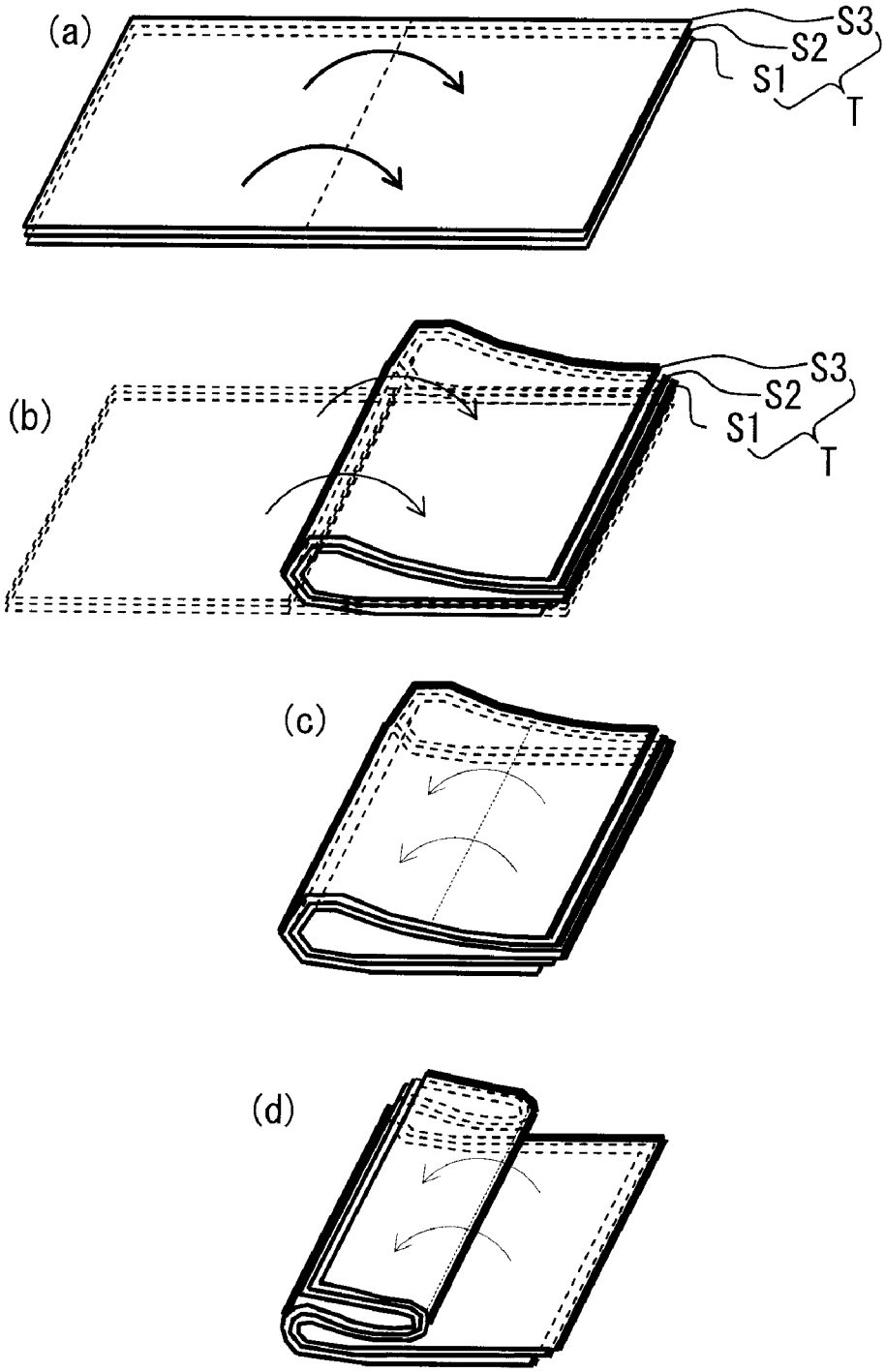
FIG. 2 is a diagram illustrating examples of sheet bundles folded at center of their longitudinal direction.
Figure 3:
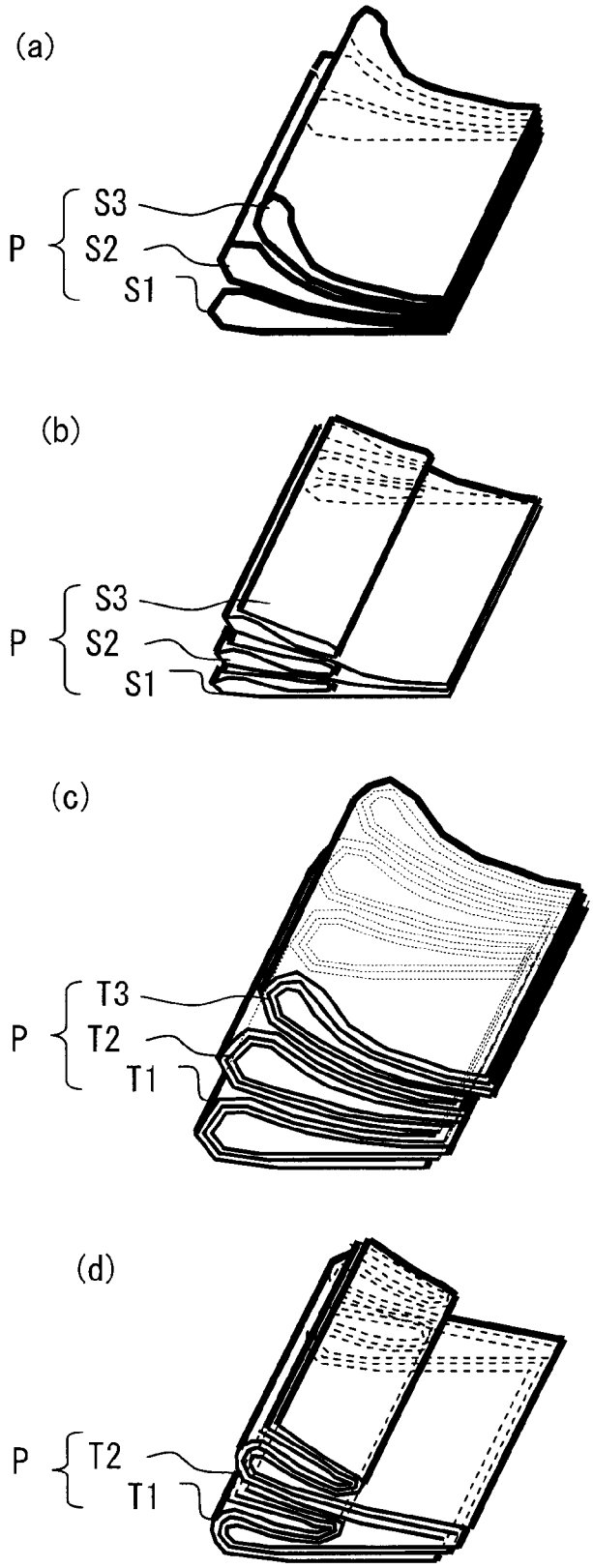
FIG. 3 is a diagram illustrating examples of stacks of sheet bundles.

FIG. 1 to 3 respectively illustrate a diagram of a sheet, a sheet bundle, and a stack of sheet bundles. They are folded at centers of their longitudinal direction, respectively. However, the sheets can be folded at any position.

(1-1) Sheet

As illustrated in FIG. 1(*a*) and FIG. 1(*b*), center-folding makes a fold line 101 on a sheet S at the center of portrait or landscape orientation. As a result, one of faces of the sheet S turns into a couple of inner faces 103 which are face to face to each other, and the other of the faces turn into a couple of outer faces 104 which are back to back to each other (facing away from each other). One of the outer faces 104 touching the ground is an outer-undersurface.

A direction along the fold line 101 is a lateral direction of the sheet S, and a span of the sheet S on the lateral direction is a width of the sheet S. Further, a direction orthogonal to the fold line 101 is a longitudinal direction of the sheet S, and a span of the sheet S on the longitudinal direction is a length of the sheet S. To make a fold line at any position on a sheet S is simply called a folding.

A left edge of the sheet S illustrated in FIG. 1(*b*), that is the fold line between the couple of outer faces, is a folded edge 105. A right edge of the sheet S illustrated in FIG. 1(*b*), that is the opposite side of the folded edge and capable to separate, is an open end 106. A couple of ends connecting the folded edge with the open end are side ends. Assuming the folded edge as a front, a near end of the side ends is a left side end 115, and a far end of the side ends is a right side end 116.

As illustrated in FIG. 1(*c*), leaves on the both sides of the fold line 101 are pages 111 and 112. Four sides of the couple of pages are a superolateral page face 110, a superomedial page face 109, an inferomedial page face 108, and an inferolateral page face 107, respectively. The page 111 as a lower page has the inferolateral page face 107 and the inferomedial page face 108. The page 112 as an upper page has the superolateral page face 110 and the superomedial page face 109.

FIG. 1(*d*) illustrates a diagram of a letter "Z" shaped folded sheet (hereinafter, "Z" folded sheet). The "Z" folded sheet has an additional fold line parallel to the folded edge at the medium of the upper page 112.

Although its shape is different from the center-folded sheet, a left edge of the sheet S illustrated in FIG. 1(*d*) is a folded edge 113. A right edge of the sheet S illustrated in FIG. 1(*d*) also is an open end 114. In other words, each fold edge has a corresponding open edge.

If the inferolateral page face 107 of the folded sheet is laid on a plane, the span from a top of the superolateral page face 110 of the folded sheet to the plane in a direction perpendicular to the plane is a height of the sheet. A region around the maximum height position in the longitudinal direction of the sheet is a bulge portion. A lap portion is a region where the pages are in touch with each other.

(1-2) Sheet Bundle

A plane sheet bundle T is a plurality of sheets, each sheet overlapping on top of an adjacent sheet as depicted by sheets S1, S2 and S3 illustrated in FIG. 2(*a*). A sheet bundle T may be a plurality of folded sheets in which each folded edge of each folded sheet is inserted into an open end of an adjacent folded sheet so that an outer face of the folded sheet meets with an inner face of the adjacent folded sheet and covers the folded sheet.

A left edge of the sheet bundle T illustrated in FIG. 2(*b*) and FIG. 2(*c*) is a folded edge of the sheet bundle T. A right edge of the sheet bundle T illustrated in FIG. 2(*b*) is an open end of the sheet bundle T. A couple of ends connecting the folded edge with the open end are side ends. Assuming the folded edge as a front, a near end of the side ends is a left side end, and a far end of the side ends is a right side end.

FIG. 2(*d*) illustrates a diagram of a letter "Z" shaped folded sheet bundle (hereinafter, "Z" folded sheet bundle). The "Z" folded sheet bundle has an additional fold line parallel to the folded edge at the medium of the upper pages.

(1-3) Stack of Sheet Bundles (or of Sheets)

FIG. 3(*a*) illustrates a folded sheet S2 positioned so that its folded edge overlaps a folded edge of the preceding folded sheet S1. In FIG. 3(*a*), a folded sheet S3 can also be positioned with its folded edge overlapping the folded edge of the preceding folded sheet S2. An entire group of sheets overlapping such as the sheets S1 and S2 (a group of S1, S2, and S3 as well) is a sheet stack P.

A sheet stack P may also be, as illustrated in FIG. 3(*b*), a plurality of "Z" folded sheets aligned with their folded edges facing the same direction with their folded edges overlapping each other.

In addition, a sheet stack P may be, as illustrated in FIG. 3(*c*) and FIG. 3(*d*), a plurality of folded sheet bundles including sheet bundles from T1 through T3 aligned with their folded edges facing toward the same direction with their folded edges overlapping each other.

Furthermore, a folded edge of a stack is a side where each folded edge of a sheet bundle overlaps on an adjacent sheet bundle's folded edge, and an open end of the stack is the side where each open end of sheet bundles overlaps on the adjacent sheet bundle's open end.

(2) Explanation of a Basis of Embodiments

Figure 4:
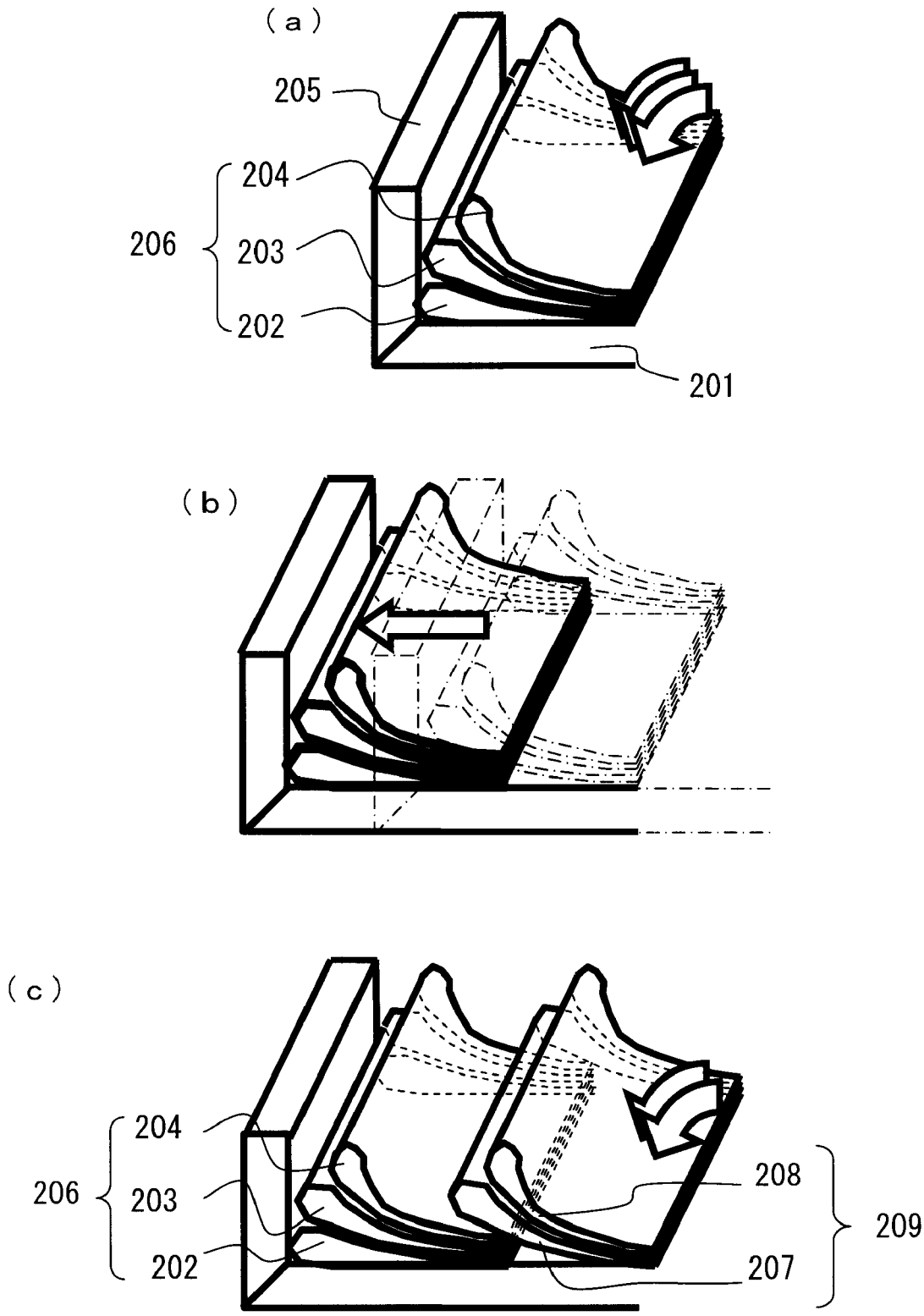
FIG. 4 is a diagram illustrating examples of stacks of sheet bundles for an explanation of a basis of embodiments.

FIG. 4 illustrates diagrams of stacks of sheet bundles for an explanation of a basis for the embodiments. FIG. 4(*a*) illustrates a stack of sheet bundles 206 including sheet bundles 202, 203 and 204. Each folded edge of the stack overlaps on top of the adjacent folded edge on a platform 201 which has a horizontal surface as an undersurface support.

The platform 201 connects to a guard 205 which has a vertical surface (that is, the guard has a surface at least substantially perpendicular to the platform surface). The guard 205 is not necessary if the stack of the sheet bundles moves slowly enough to keep itself stable. The guard 205 is illustrated here only for ease in understanding a transition of the platform 201. The location where the sheet bundles are fed from does not change its position.

The stack shifts to the direction toward its folded edge side after the stack grows to include a predetermined amount of sheet bundles, as illustrated in FIG. 4(*b*). The predetermined amount may be measured in height, determined by number of sheets, or determined by number of sheet bundles. The stack may shift together with the platform 201 as illustrated in FIG. 4(*b*), and also may shift relative to the platform 201 instead of the platform 201 shifting.

In one embodiment, the distance of the shift is shorter than a length of the stack of the sheet bundles. The length of the stack may vary according to individual posture of the sheet bundles, but does not vary so much from the length of the sheet bundle if they are aligned stable. In another embodiment, the distance of the shift may be longer than one third of the length of the stack to load a bulge portion of the following stack on a lap portion of the stack.

After the shift, sheet bundles of the subsequent stack are fed on the platform 201 from the same location where the preceding sheet bundles are fed from. As a result, a folded edge of a sheet bundle 207 is loaded partially covering the preceding stack on a position slightly backing off from the bulge portion of the preceding stack.

After the preceding stack shifts away, a new stack is formed with its sheet bundles at the same vertical position (for example, folded edges of each sheet bundle within the stack are aligned), as illustrated in FIG. 4(*c*). As a result, the sheet bundles come into a condition in which the folded edges side of the stack in which the folded edges of the sheet bundles overlap with each other, are positioned so that there is overlap with the open ends of the preceding stack. In other words, the sheet bundles come into a condition in which the bulge portion of a stack is positioned with overlap with the lap portion of the preceding adjacent stack.

Figure 5:
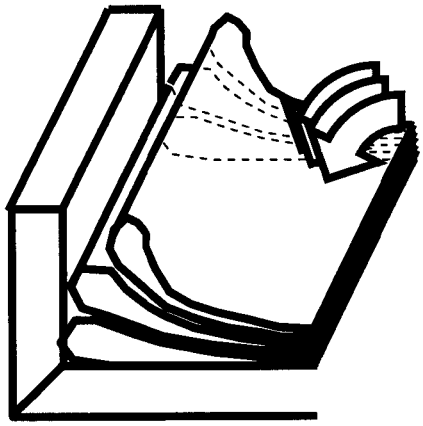
FIG. 5 is a diagram illustrating examples of sheet bundles and stacks of sheet bundles for an explanation of a basis of embodiments.
Figure 5:
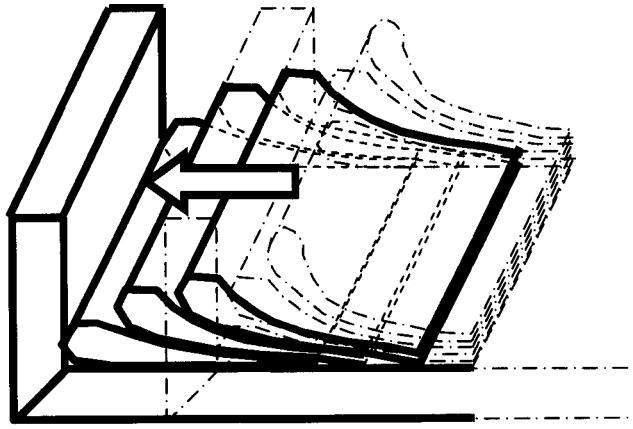
Figure 5:
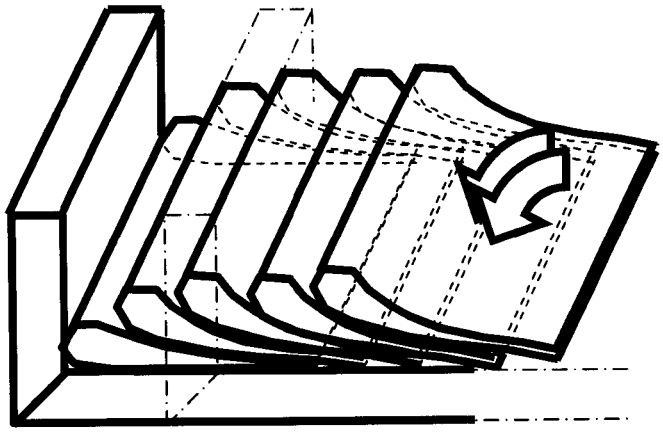

Although FIG. 4 illustrates a situation where the stack does not break apart during the shift, the stack may break apart on a shift by the inertia of the stack as illustrated in FIG. 5(*b*) if friction between the sheet bundles is not sufficiently strong. As a result, each bulge portion of the sheet bundles is respectively on a lap portion of a sheet bundle below the sheet bundle. Bulge portions of the following sheet bundles are loaded in an organized and neat manner on the lap portions of the sheet bundles included in the stack which has already broken apart. If the stack has already broken apart before the stack becomes unstable, it is unnecessary to provide any concern for the stability of the stack.

(2-1) Embodiment 1

Figure 6:
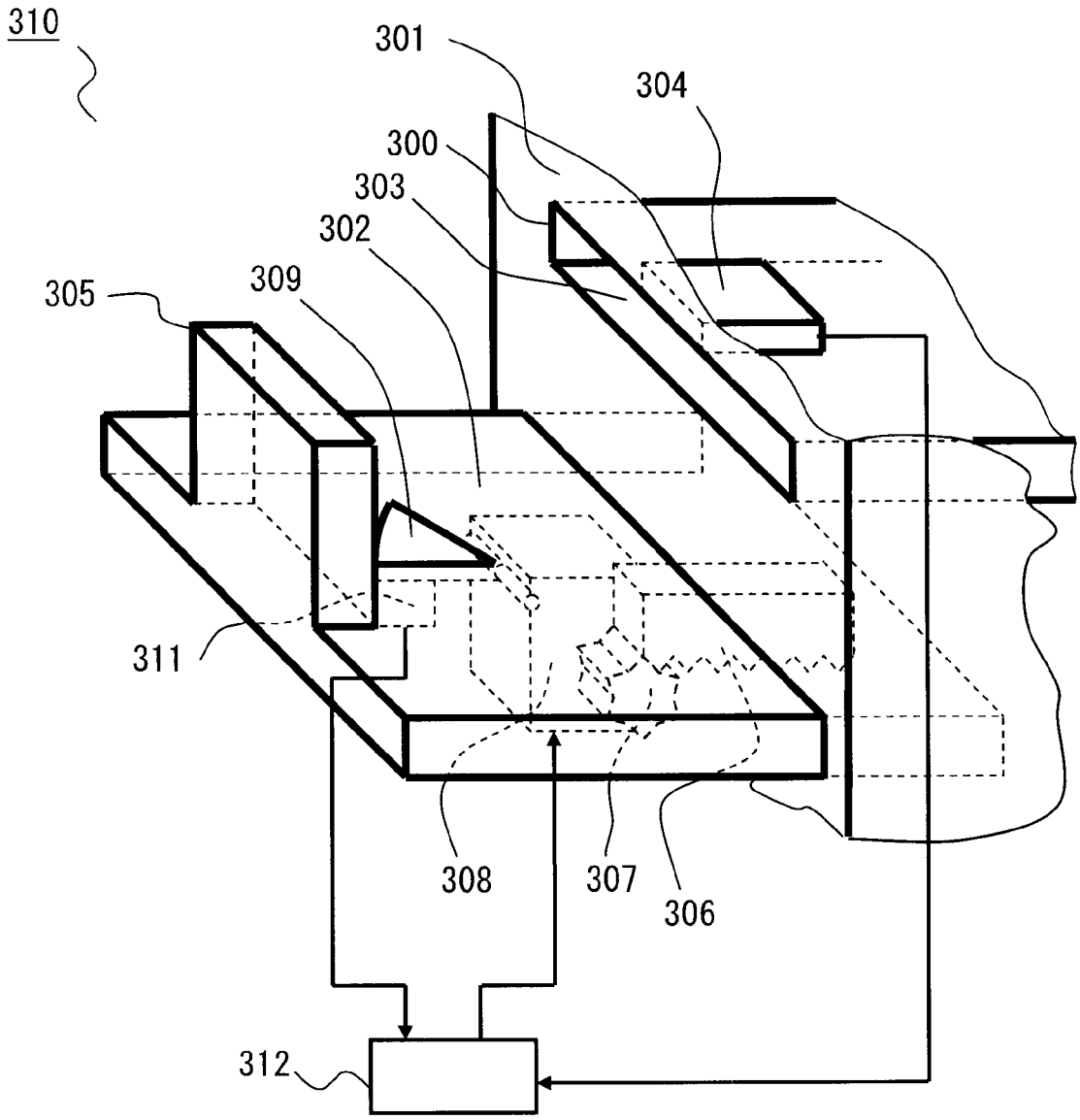
FIG. 6 is a diagram illustrating an exemplary perspective view of a sheet loader according to a first exemplary embodiment.

FIG. 6 illustrates a first exemplary embodiment of a sheet loader. The sheet loader 310 includes an outlet 300 as a part of a sheet bundle provider, a wall 301, a platform 302 as an undersurface support, a path 303, a discharge sensor 304, a guard 305, a rack gear 306, a pinion gear 307, a motor 308, a button 309, a load sensor 311, and a controller 312. The wall 301 and the path 303 may be parts of the sheet bundle provider.

The outlet 300 opens on the wall 301. The wall 301 can correspond to an outer wall of a sheet folding apparatus. Typically, folded sheets and folded sheet bundles are discharged from the outlet 300 to the platform 302 with the folded edges in the lead. Hereinafter, each of the folded sheets and the folded sheet bundles is simply called a sheet bundle. The outlet 300 connects to the path 303.

The discharge sensor 304 is positioned inside of and close to the outlet 300. The discharge sensor 304 senses the sheet bundles conveyed through the path 303 to count the number of sheet bundles discharged from the outlet 300.

The platform 302 is positioned below the outlet 300. The platform 302 has an upper surface as the undersurface support to support an undersurface of the sheet bundle initially discharged from the outlet 300. The platform 302 extends from and backs off to the wall 301 horizontally. The traveling direction of the platform 302 is parallel to a projection of the discharging direction of the outlet 300 on a horizontal plane.

The guard 305 stops the sheet bundle discharged from the outlet 300 to avoid and prevent overrun from the platform 302. The guard 305 has a face to contact the folded edge of the discharged sheet bundle. The guard 305 takes a minimum distance between the face and the wall 301 during waiting for the sheet bundle discharged from the outlet 300. The minimum distance may be about the same as the length of the sheet bundle.

The motor 308 drives the pinion gear 307 to move the platform 302 through the rack gear 306.

The button 309 extends out (typically up) from the upper surface of the platform 302, and is depressed into the upper surface of the platform 302 by the sheet bundle initially discharged on the upper surface of the platform 302. The load sensor 311 detects whether the button 309 is extended or depressed. The load sensor can optionally be equipped to detect the extended distance of the button 309 which can correlate to a predetermined number of sheet bundles on the button 309.

The controller 312 controls driving of the motor 308 based on the detection of the discharge sensor 304 and the load sensor 311. The controller 312 counts the times of detection for sheet bundles of the discharge sensor 304 as the number of the sheet bundles discharged from the outlet 300. The controller 312 increments a count each time the discharge sensor 304 detects a sheet bundle while the load sensor 311 is detecting whether the button 309 is depressed. The controller 312 makes the motor 308 drive to advance the platform 302 after a predetermined moment after the count meets or exceeds a predetermined threshold. For example, the predetermined threshold is set to three in this embodiment. The predetermined moment has a sufficient enough length of time for the sheet bundle to remain stable on the platform 302, or on the preceding sheet bundles, after the discharge sensor 304 detects the sheet bundle, and also is shorter than a discharging interval between sheet bundles. Of course, it is an acceptable configuration to increase the discharging interval between sheet bundles more than usual on making the motor 308 drive, if possible.

When the load sensor 311 detects the button 309 in an extended position, the controller 312 clears the count to zero and initiates the motor 308 drive to back off the platform 302.

Figure 15:
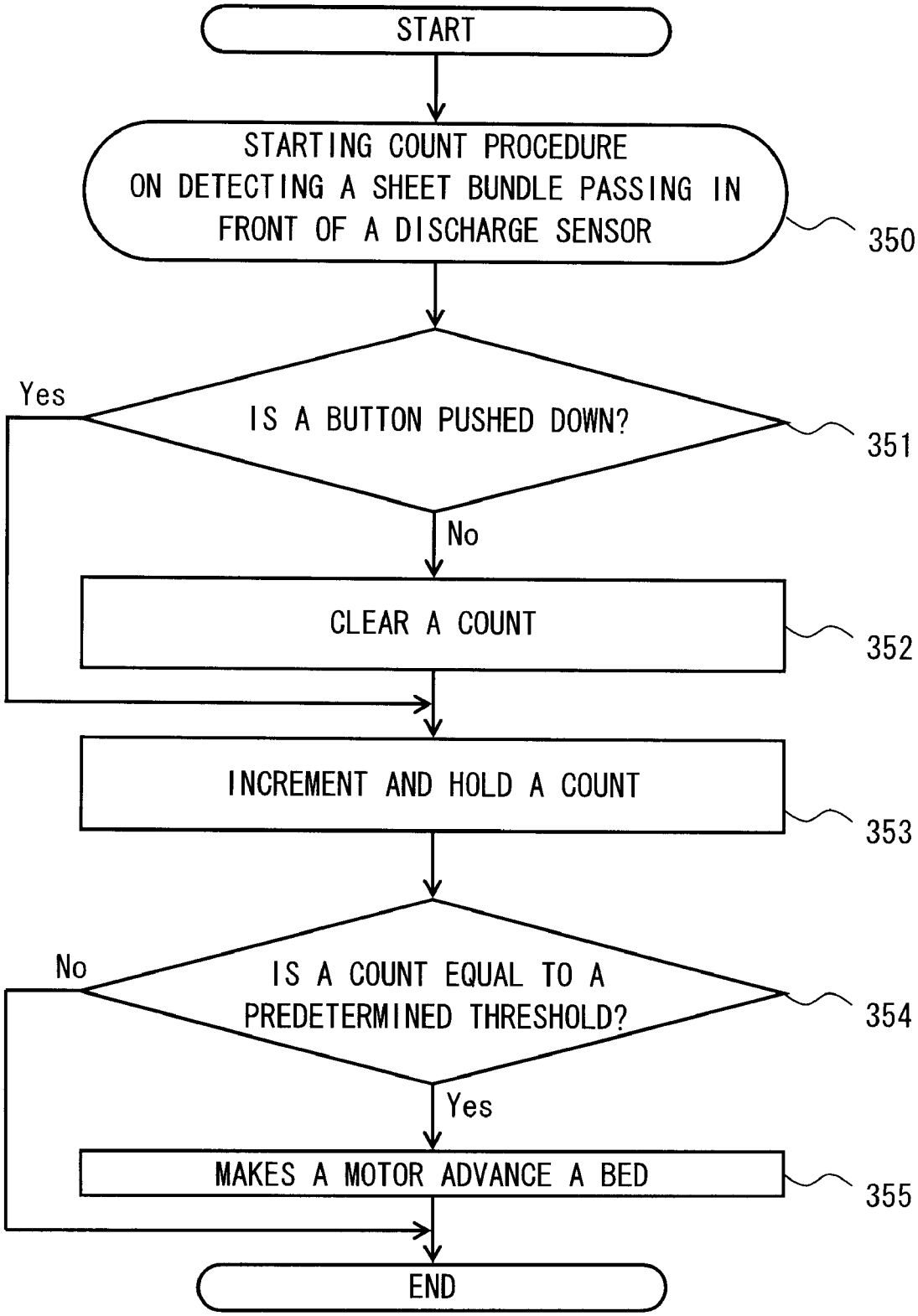
FIG. 15 is a flowchart illustrating an exemplary operation of a sheet loader according to a first exemplary embodiment.

An exemplary operation of the sheet loader 310 is explained with snapshots in FIGS. 7 to 12, and a flowchart in FIG. 15.

Figure 7:
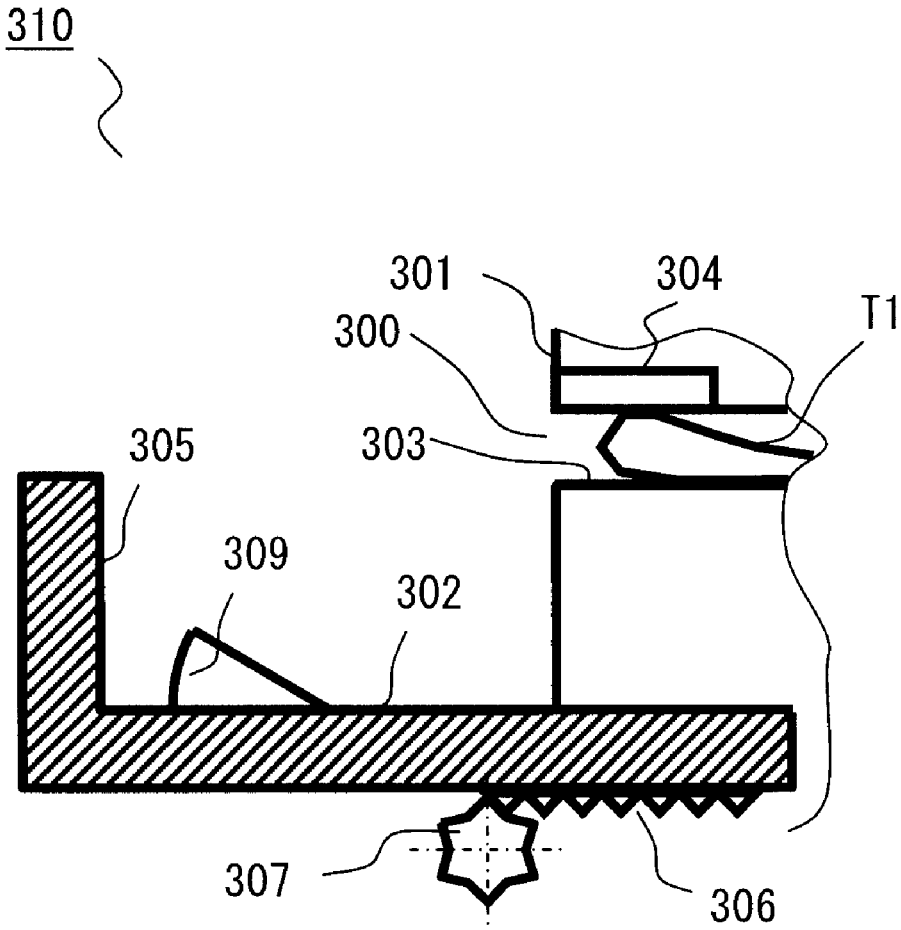
FIG. 7 is a diagram illustrating an exemplary cross-sectional view of a sheet loader according to a first exemplary embodiment.

FIG. 7 illustrates a cross-sectional snapshot of the sheet loader 310 before a sheet bundle T1 in the path 303 is discharged to the platform 302. The controller 312 starts a count procedure illustrated in FIG. 15 on detecting a sheet bundle T1 passing in front of the discharge sensor 304 (Act 350).

Figure 8:
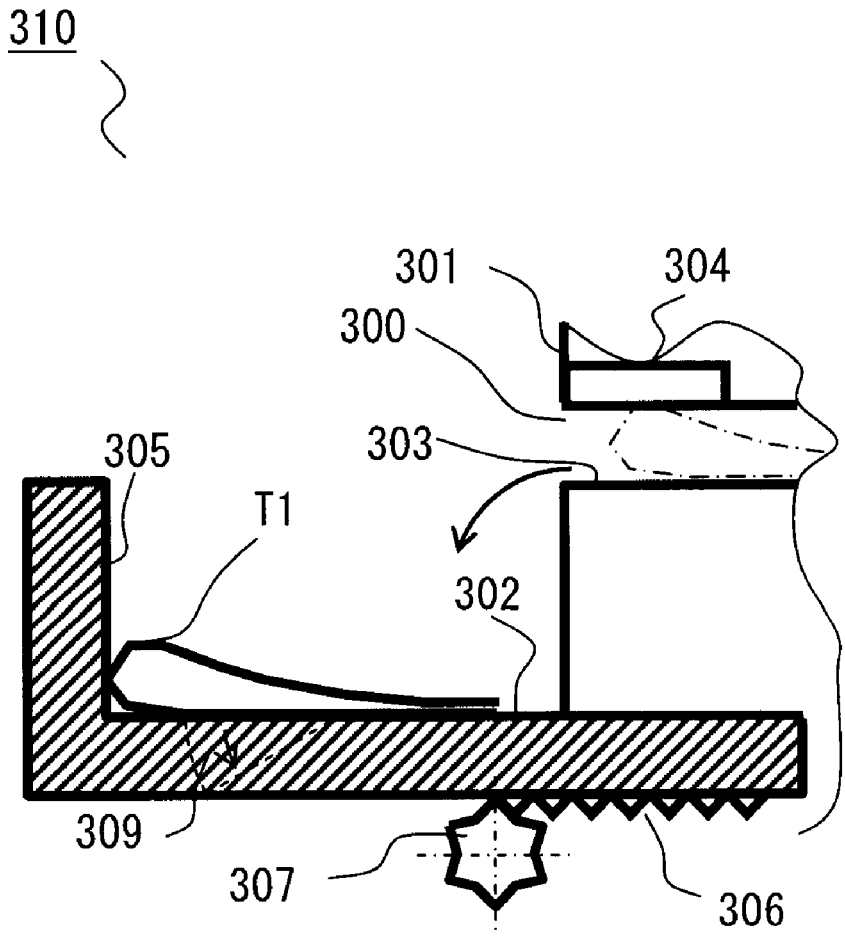
FIG. 8 is a diagram illustrating an exemplary cross-sectional view of a sheet loader according to a first exemplary embodiment.

FIG. 8 illustrates a cross-sectional snapshot of the sheet loader 310 after the sheet bundle T1 is discharged to the platform 302. The sheet bundle T1 lands on the platform 302 with its folded edge in the lead and depresses the button 309 to be about even with or under the upper surface of the platform 302.

If a sheet bundle passes in front of the discharge sensor 304 with the button 309 extended (reference "No" of Act 351), the controller 312 clears the count to zero before incrementing the count (Act 352) and holding the count (Act 353) as one. Otherwise, if the sheet bundle passes in front of the discharge sensor 304 with the button 309 depressed (reference "Yes" of Act 351), the controller 312 increments the count and holds the count without clearing or resetting to zero (Act 353). So, the count is held as one after a transition from the situations illustrated in FIG. 7 and FIG. 8.

Figure 9:
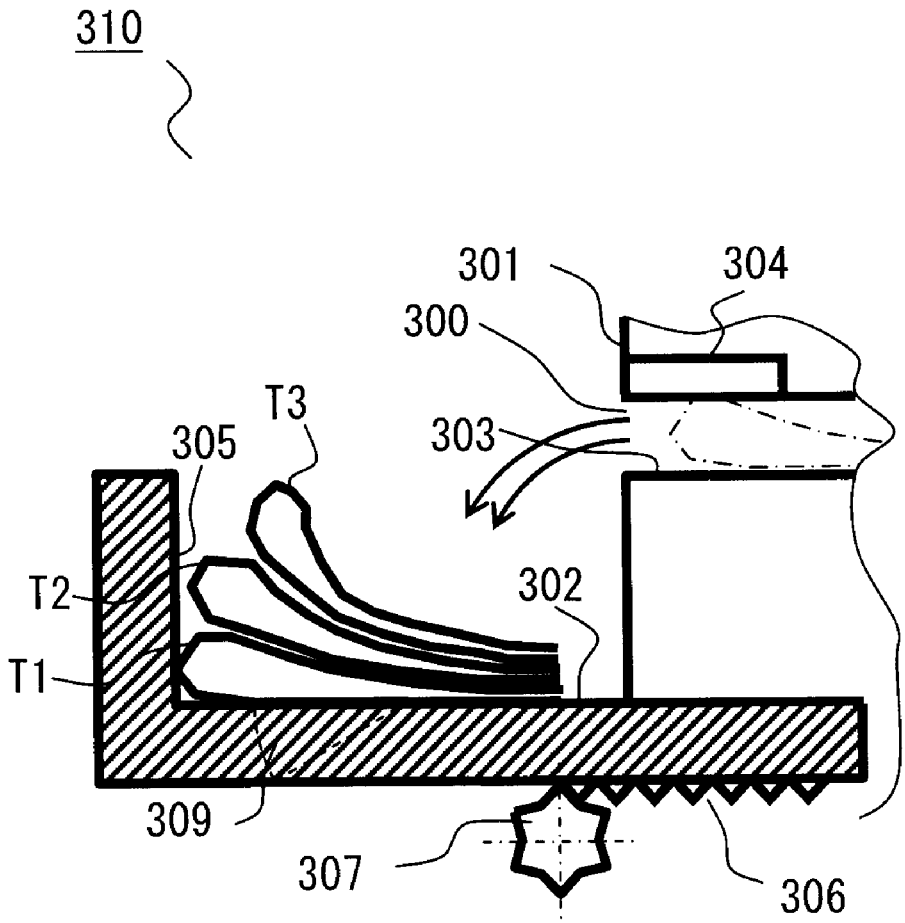
FIG. 9 is a diagram illustrating an exemplary cross-sectional view of a sheet loader according to a first exemplary embodiment.

FIG. 9 illustrates a cross-sectional snapshot of the sheet loader 310 after sheet bundles T2 and T3 are discharged on the sheet bundle T1 on the platform 302. A stack of the sheet bundles is formed with the sheet bundle T1 and the following sheet bundles T2 and T3 positioned on the sheet bundle T1. The sheet bundles T2 and T3 pass in front of the discharge sensor 304 with the button 309 in a depressed state due to the sheet bundle T1, the controller 312 increments the count twice and holds the count as three after a transition from the situations illustrated in FIG. 8 and FIG. 9.

Figure 10:
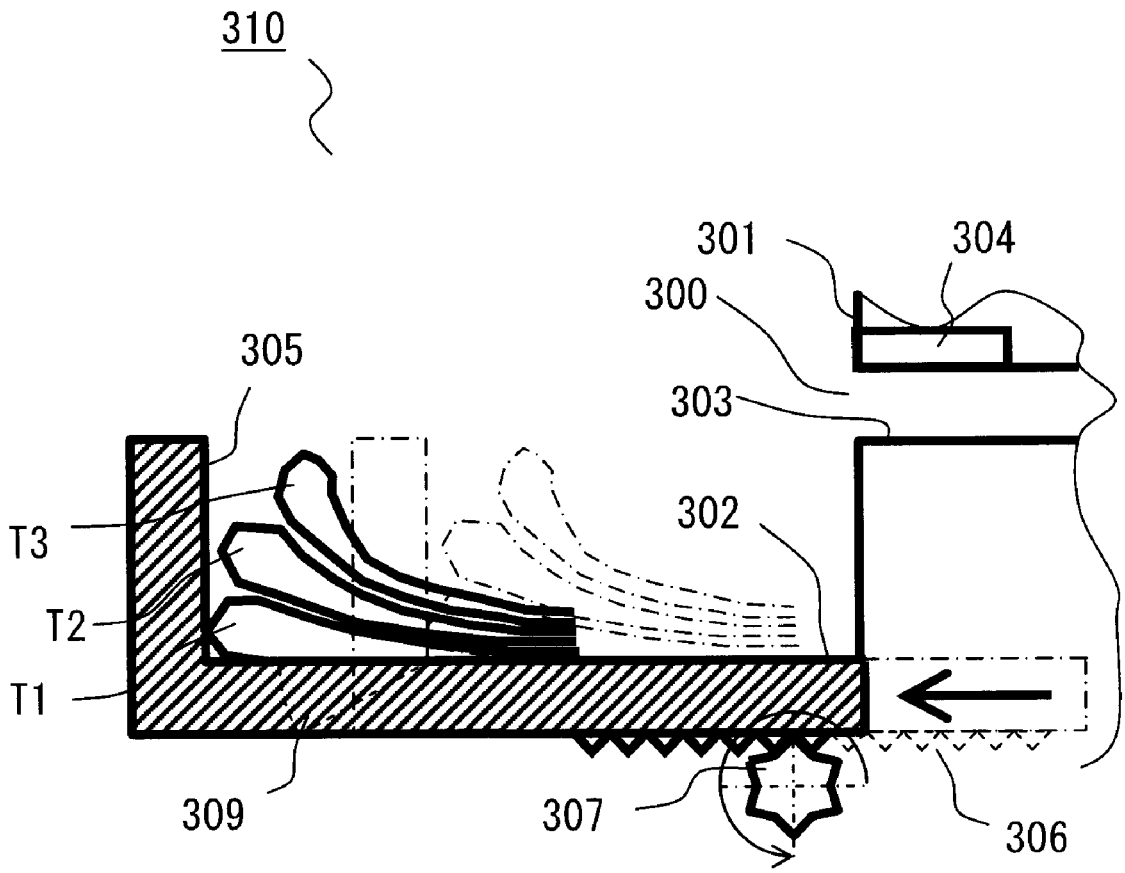
FIG. 10 is a diagram illustrating an exemplary cross-sectional view of a sheet loader according to a first exemplary embodiment.

After holding the count, the controller 312 determines whether the platform 302 is advanced or not (Act 354). If the count is not equal to the predetermined threshold (reference "No" of Act 354), then the controller 312 finishes the count procedure without advancing the platform 302. If the count is equal to the predetermined threshold (reference "Yes" of Act 354), then the controller 312 makes the motor 308 advance the platform 302 (Act 355) after the predetermined moment as illustrated in FIG. 10 and finishes the count procedure.

The distance to advance the platform 302 may be between one third and two thirds of the length of the sheet bundle. However, it may be shorter than one third if the bulge portions of the sheet bundles are small because of the weak strength of folding expansive force. In other words, the distance to advance the platform 302 has a sufficient enough length to avoid overlapping the bulge portion of a sheet bundle to be discharged from the outlet 300 on the bulge portion of the preceding stack of sheet bundles. It may be possible to configure the distance to advance the platform 302 shorter if the stack is soft enough for its bulge portion to be pressed as likely to turn into a lap portion by the following sheet bundle. It also may be possible to configure the distance to advance the platform 302 to change according to the type of sheets constituting the stack. The distance should be configured to be shorter if the folding expansive force of the sheets are relatively weak.

Figure 11:
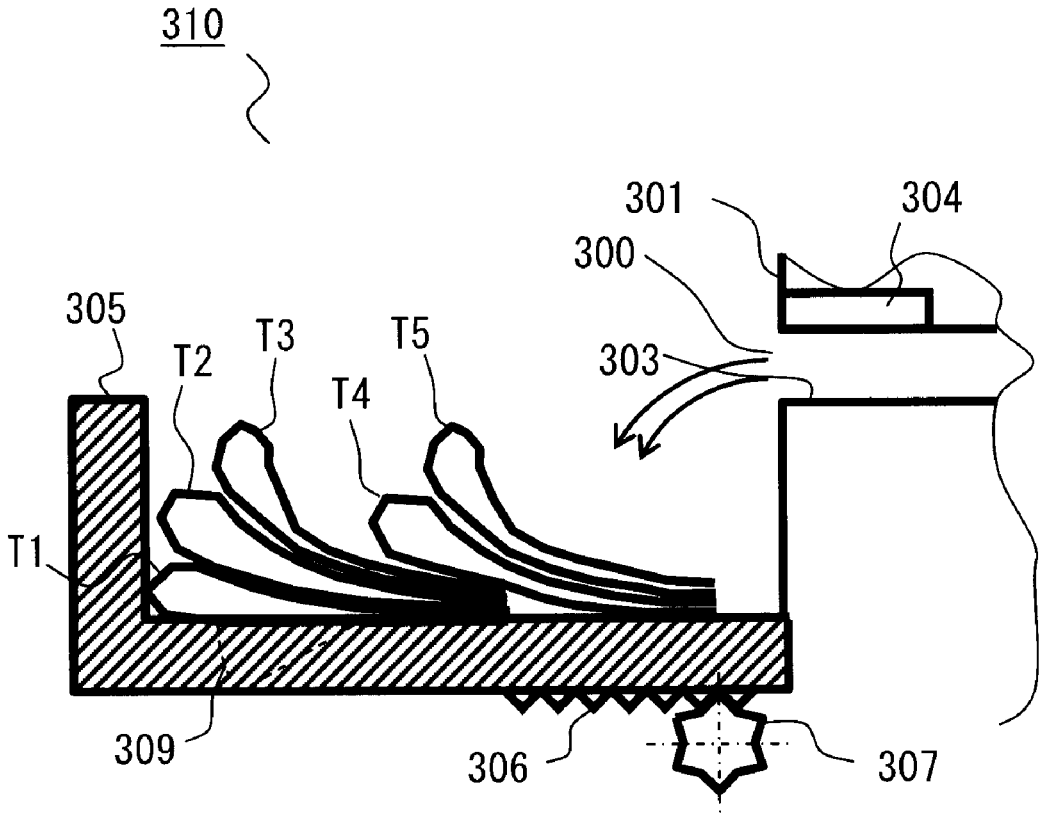
FIG. 11 is a diagram illustrating an exemplary cross-sectional view of a sheet loader according to a first exemplary embodiment.

FIG. 11 illustrates a cross-sectional snapshot of the sheet loader 310 after sheet bundles T4 and T5 are discharged on the lap portion of the stack of sheet bundles (T1, T2, and T3) on the platform 302. Folded edges of the sheet bundles T4 and T5 overlap with the lap portion of the stack. The controller 312 holds the count as five in the time of FIG. 11.

Even if the lap portion of the stack is relatively low, it has a Slight thickness that raises the folded edge of a sheet bundle overlapping there. As a result, the stabilities of different stacks are different between of the first stack and the second stack overlapping the first stack. Consequently, it may be possible to configure a fewer number of the sheet bundles constituting the first stack than the number of sheet bundles of the second stack.

In addition, it may be possible to configure to form a third stack of sheet bundles overlapping on a lap portion of the second stack, and to mount a bulge portion of a stack N+1 on a lap portion of the preceding stack N (positive integer).

Figure 12:
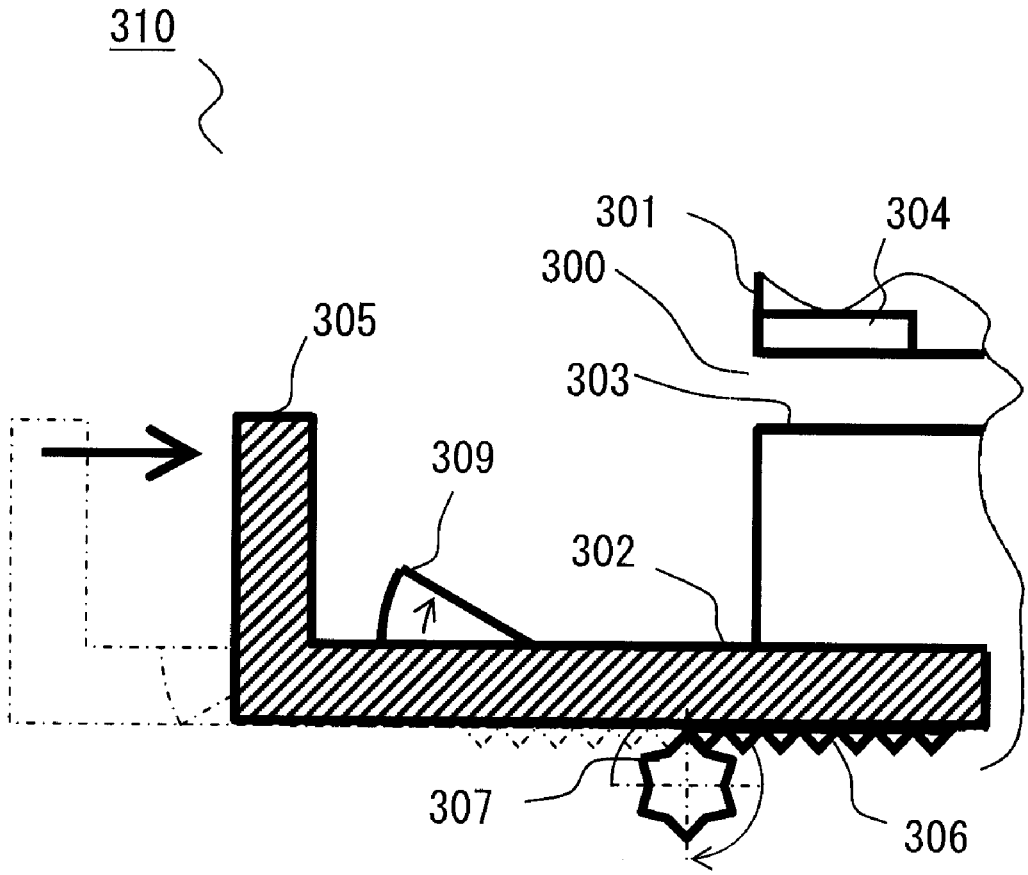
FIG. 12 is a diagram illustrating an exemplary cross-sectional view of a sheet loader according to a first exemplary embodiment.

FIG. 12 illustrates a cross-sectional snapshot of the sheet loader 310 after the stacks are removed from the platform 302. The button 309 extends from the upper surface of the platform 302, and then, the controller 312 clears the count to zero and makes the motor 308 drive to back the platform 302 off toward the wall 301 to the position similar to that as illustrated in FIG. 7.

If a length of the following sheet bundle is longer than the sheet stack removed from the position above the button 309 on the platform 302, a distance to back the platform 302 off may be shortened, or the platform 302 may stay unchanged, to prepare a sufficient enough distance for the following sheet bundles to be positioned between the wall 301 and the guard 305.

Needless to say, the number of the sheet bundles that constitute the stack is not limited to only two or three as illustrated in the figures, but the number may be less or more. Moreover, the structure to move the platform 302 is not limited to the rack-and-pinion components shown. There are many alternative ways to configure the structure such as a rack with a worm gear.

Figure 13:
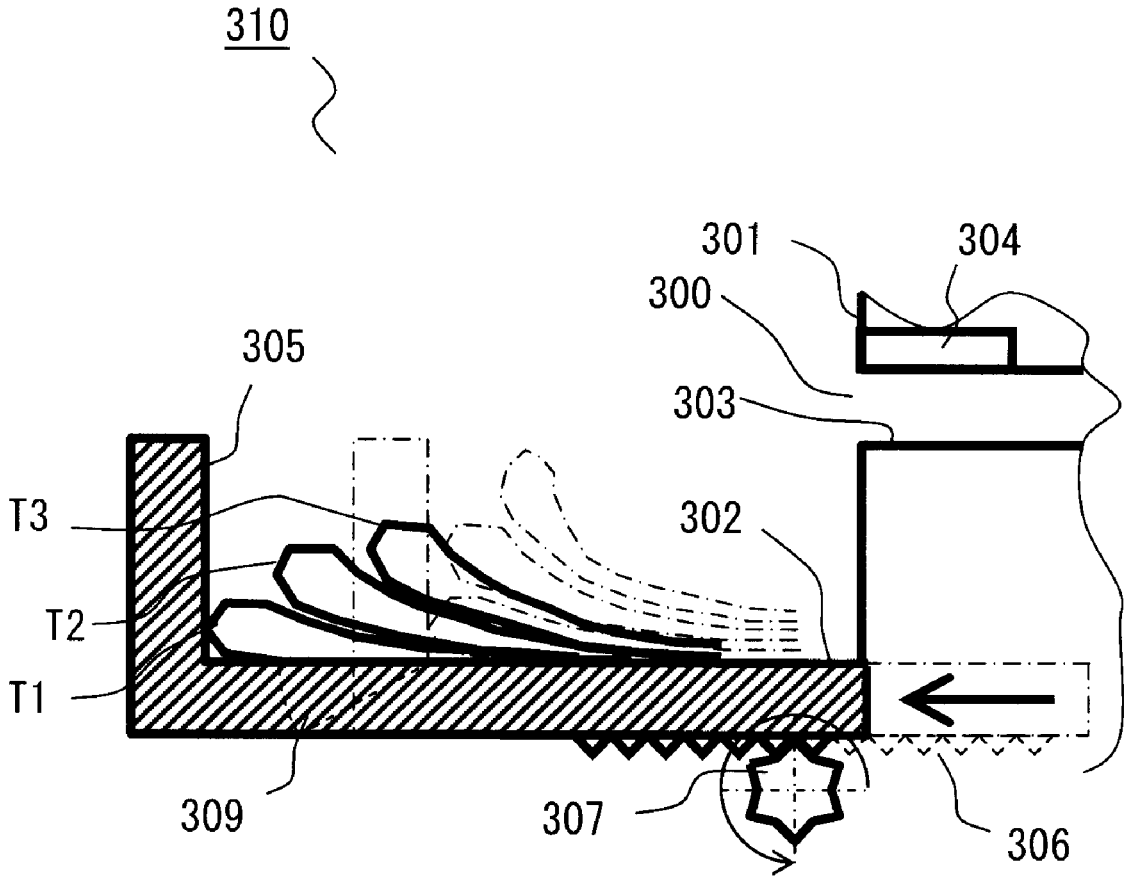
FIG. 13 is a diagram illustrating an exemplary cross-sectional view of a sheet loader according to a first exemplary embodiment.
Figure 14:
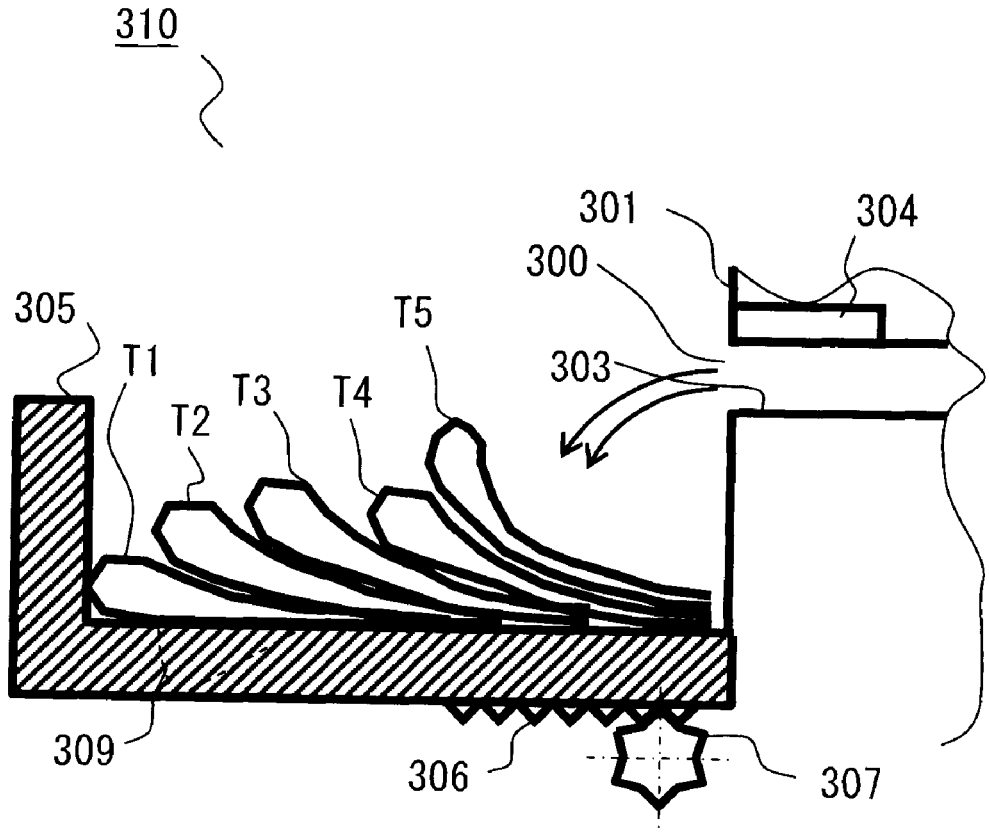
FIG. 14 is a diagram illustrating an exemplary cross-sectional view of a sheet loader according to a first exemplary embodiment.

Although FIG. 10 and FIG. 11 illustrate a situation where the stack does not break apart during movement of the platform 302, the stack may break apart when the platform 302 shifts by the inertia of the stack as illustrated in FIG. 13. If friction between the sheet bundles is not sufficiently strong, each bulge portion of the sheet bundles is respectively on a lap portion of a sheet bundle below the sheet bundle. Bulge portions of the following sheet bundles are loaded in an organized and neat manner on the lap portions of sheet bundles included in the stack which has already broken apart, as illustrated in FIG. 14. If the stack has already broken apart before the stack becomes unstable, it is unnecessary to provide concern over the stability of the stack.

Figure 16:
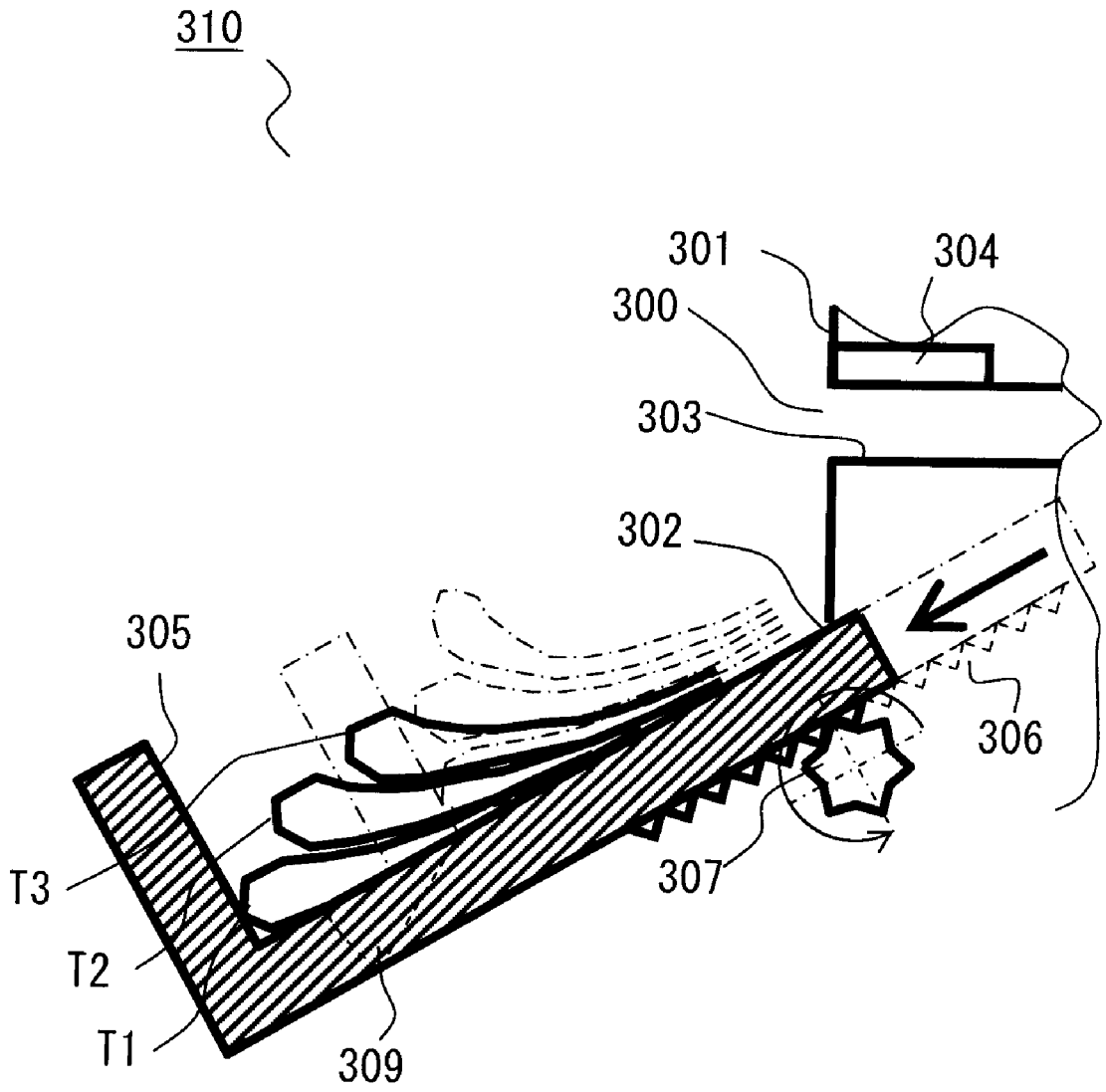
FIG. 16 is a diagram illustrating an exemplary cross-sectional view of a sheet loader according to a first exemplary embodiment.
Figure 17:
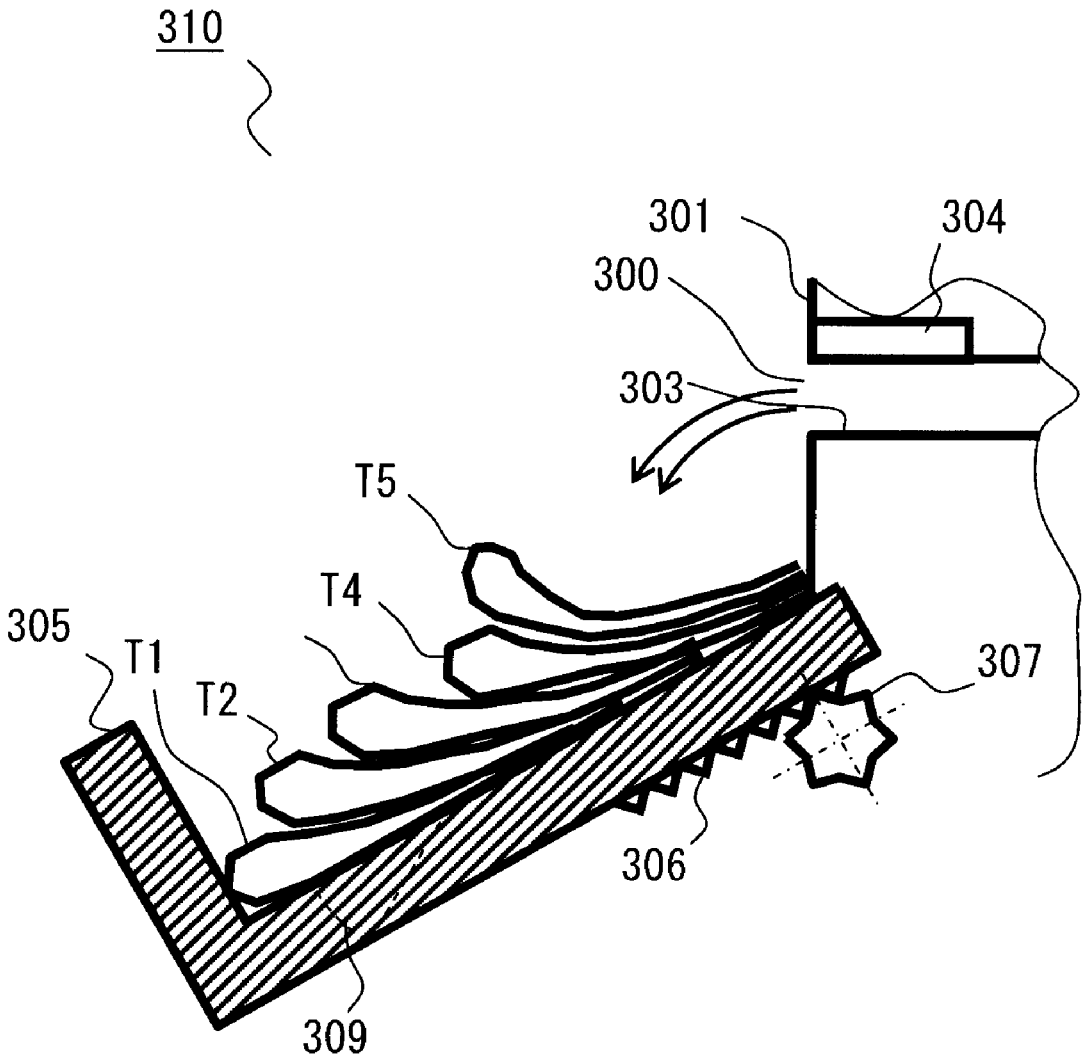
FIG. 17 is a diagram illustrating an exemplary cross-sectional view of a sheet loader according to a first exemplary embodiment.

The platform 302 may be configured so as to decline from the outlet 303 side as illustrated in FIG. 16 and FIG. 17, as well. There are sheet bundles supported on the declining upper surface of the platform 302. The guard 305 supports a folded edge of a first sheet bundle and the bulge portion of the first sheet bundle supports a bulge portion of the following sheet bundle. Each of the sheet bundles is prevented from sliding down the slope by a bulge portion of the preceding sheet bundle. As the result, sheet bundles are loaded in an organized and neat manner on the platform 302.

Moreover, sheet bundles are stabilized and compressed since the bulge portions are pressed together by the gravity force of the following sheet bundles sliding down the slope. As a result, the loading capacity on the platform 302 becomes higher than a substantially level bed.

Such a beneficial effect cannot be not attained by the techniques described in JP-2003-261256-A2 where the sheet stopper mechanism moves in a horizontal direction connecting at the bottom of the slope, although the sheets slide down the slope of the inclined sheet stacker. In this configuration, the first and some of the following sheets stop at the bottom of the slope and overtake the preceding sheet thereby causing the sheets to be out of order.

(2-2-1) Embodiment 2

Figure 18:
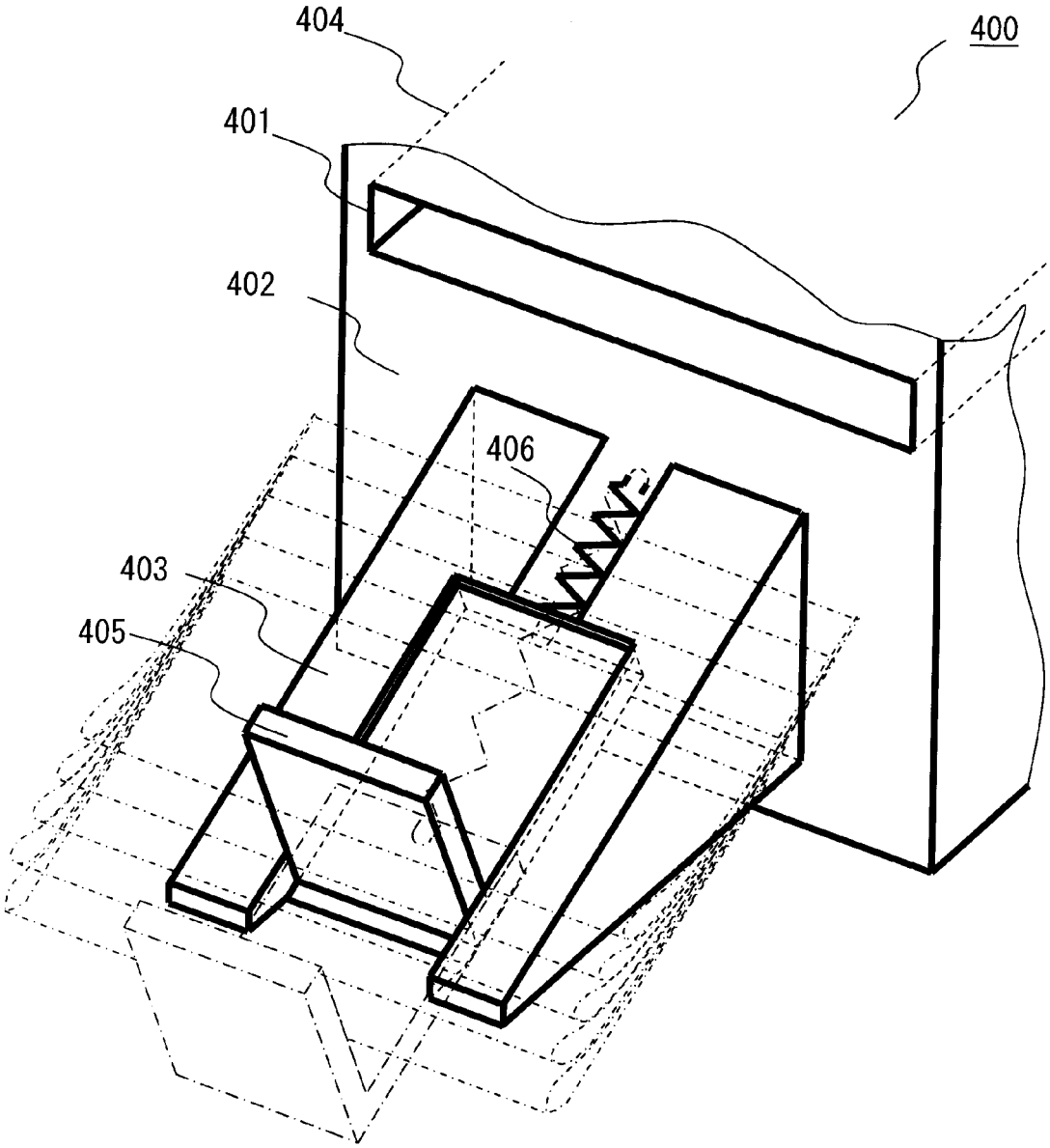
FIG. 18 is a diagram illustrating an exemplary perspective view of a sheet loader according to a second exemplary embodiment.

FIG. 18 illustrates a second exemplary embodiment of a sheet loader. The sheet loader 400 includes an outlet 401 as a part of a sheet bundle provider, a wall 402, a platform 403 as an undersurface support, a path 404, a guard 405, and a spring 406. The wall 402 and the path 404 may be parts of the sheet bundle provider.

The outlet 401 opens on the wall 402. The wall 402 corresponds to, for example, an outer wall of a sheet folding apparatus. Folded sheet bundles are discharged from the outlet 401 to the platform 403 with their own folded edges in the lead. The outlet 401 connects to the path 404.

The platform 403 is positioned below the outlet 401. The platform 403 is configured so as to decline from the side by the outlet 401.

The guard 405 supports a folded edge of the sheet bundle so that the sheet bundle does not to slide down and off the platform 403. The guard 405 may shift along the decline of the upper surface of the platform 403 in parallel with the platform upper surface. A width of the guard 405 is sufficient to support the folded edge of a sheet bundle, such as about as same length of the shorter side of a post card. A center of the guard 405 can correspond to a center of the sheet bundle discharged from the outlet 401. The spring 406 biases the guard 405 toward the wall 402. The guard 405 is pushed downward along the decline of the upper surface of the platform 403 by the gravitational weight of the sheet bundles on the platform 403. The guard 405 goes far away from the wall according to the weight of the sheet bundles on the platform 403.

Figure 19:
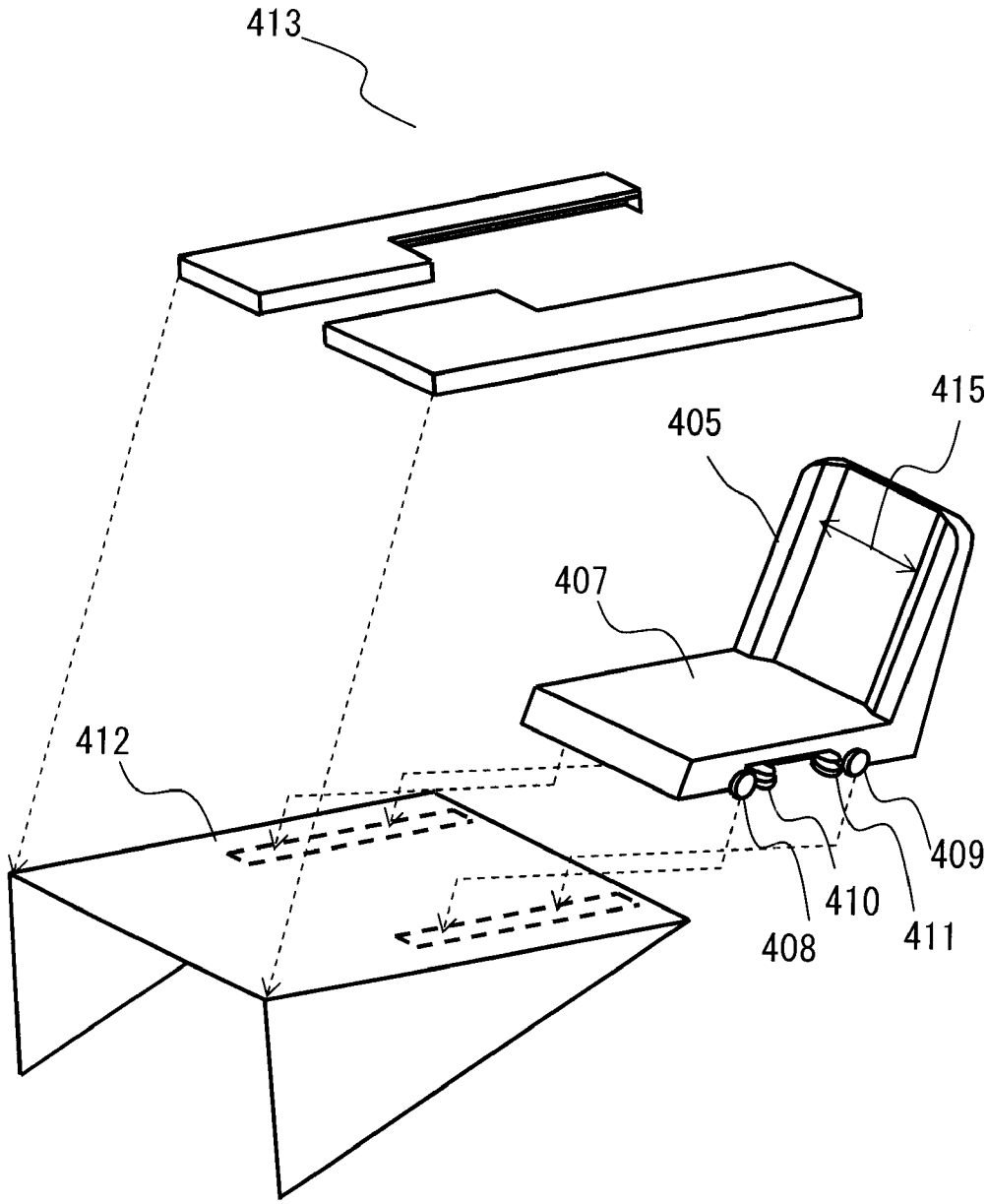
FIG. 19 is a diagram illustrating an exemplary perspective view of a sheet loader around a guard and a base plate according to a second exemplary embodiment.
Figure 20:
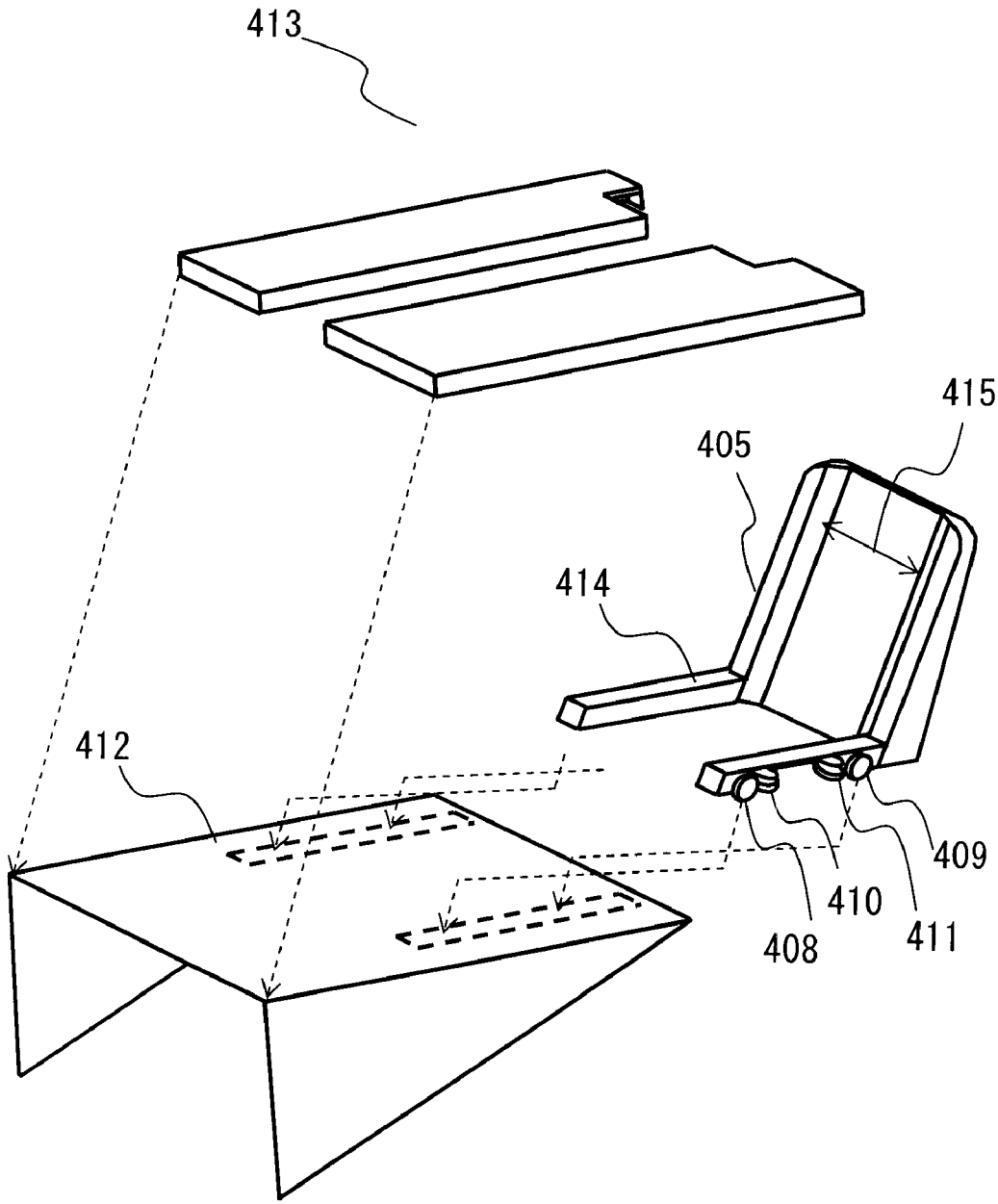
FIG. 20 is a diagram illustrating an exemplary perspective view of a sheet loader around a guard and a base plate according to a second exemplary embodiment.

The guard 405 in this embodiment is connected to a base plate 407 as illustrated in FIG. 19. The base plate 407 has a flat plane parallel to the upper surface of the platform 403, as its upper surface. A width of the base plate 407 can be same as the guard 405. The base plate 407 shifts together with the guard 405.

The base plate 407 has a length along the direction where the guard 405 shifts according. The base plate 407 supports rollers 408 and 409 rotatably around a horizontal axis which is perpendicular to the upper surface of the slope 412. The rollers 408 and 409 are aligned in the direction with a distance therebetween sufficient enough to be stable. Such a structure is effective for the guard 405 to keep its shift movement smooth and its posture stable.

A slope 412 has a flat plane parallel to the upper surface of the platform 403, as its upper surface. The slope 412 supports the base plate 407 through the rollers 408 and 409. The rollers 408 and 409 roll on the region surrounded with broken lines on the upper surface of the slope 412 illustrated in FIG. 19.

A platform cover 413 is attached to the slope 412 and covers regions on the upper surface of the slope 412 other than the region where the base plate 407 is located and moves across. The upper surface of the platform cover 413 is set on the same plane as the upper surface of the base plate 407.

Furthermore, the base plate 407 has other rollers 410 and 411. Rollers 410 and 411 are supported by the base plate 407 rotatably around an axis perpendicular to the upper surface of the slope 412.

The rollers 410 and 411 roll on vertical guide walls which the platform cover 413 supports inside of itself. The vertical guide walls prevent the base plate 407 and the guard 405 from moving the wrong way on the slope 412.

The guard 405 has a trench 415 on the surface where there is some contact with the folded edge of the sheet bundle. The guard 405 provides support to the sheet bundle for added stability because the folded edge of the sheet bundle is supported at two points which are both edges of the trench. The trench 415 is a clearance in which to put user's fingers, allowing the user to remove the sheet bundle easily.

The structure concerning the guard 405 is not limited to the above. For example, the guard 405 may connect to beams 414 instead of the base plate 407 which is for supporting the rollers 408 through 411. The beams 414 are hidden under the platform cover 413, and are exposed after the guard 405 moves down the slope 412.

Figure 21:
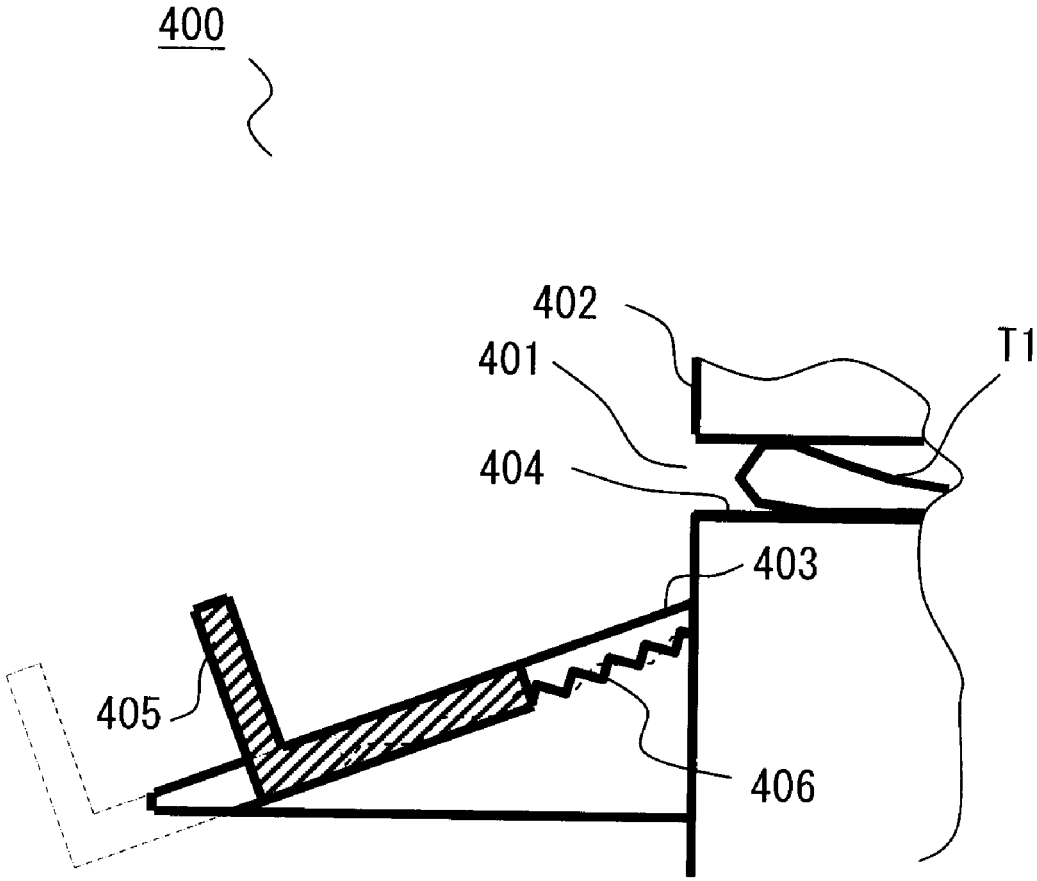
FIG. 21 is a diagram illustrating an exemplary cross-sectional view of a sheet loader according to a second exemplary embodiment.
Figure 22:
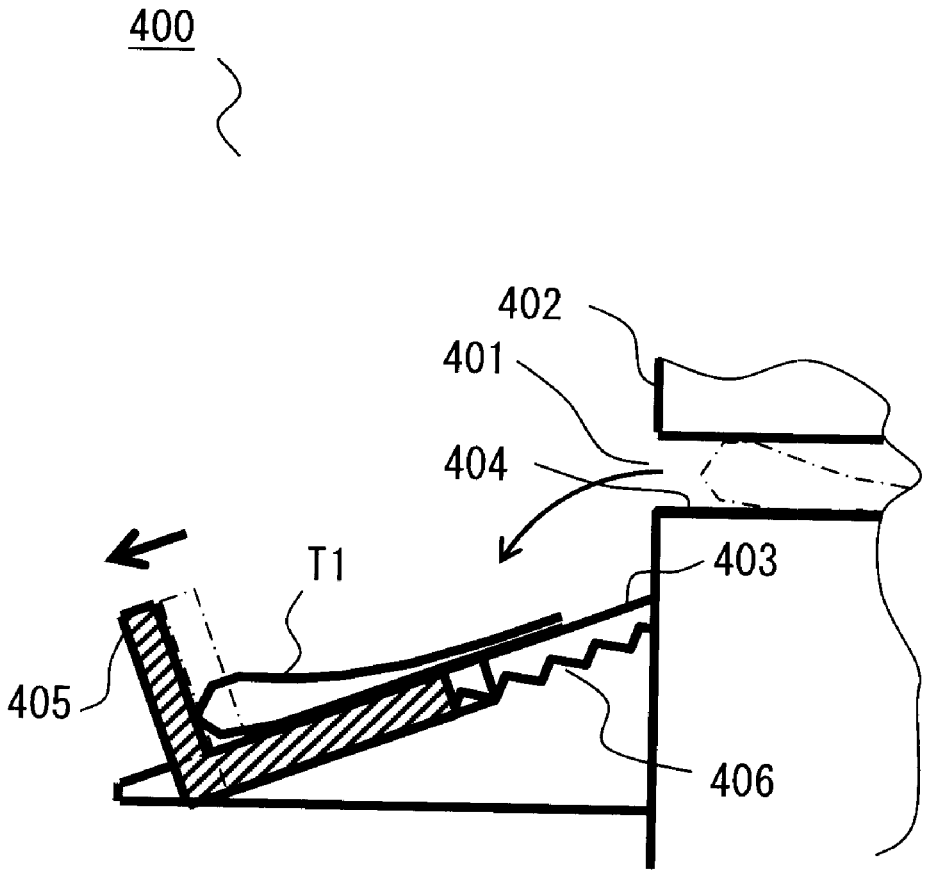
FIG. 22 is a diagram illustrating an exemplary cross-sectional view of a sheet loader according to a second exemplary embodiment.
Figure 23:
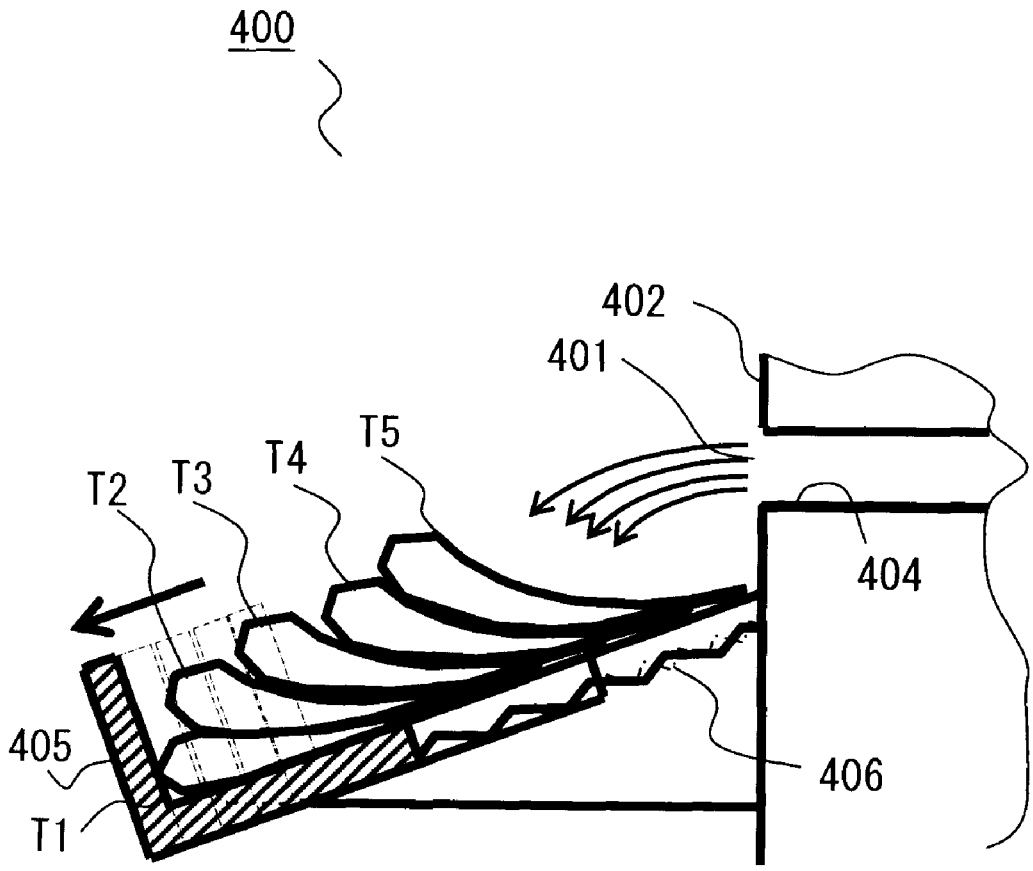
FIG. 23 is a diagram illustrating an exemplary cross-sectional view of a sheet loader according to a second exemplary embodiment.

An exemplary operation of the sheet loader 400 is explained with snapshots in FIGS. 21 to 23.

FIG. 21 illustrates a cross-sectional snapshot of the sheet loader 400 before a sheet bundle T1 in the path 404 is discharged to the platform 403.

The spring 406 biases the guard 405, but there is no sheet bundle on the platform 403, so the guard 405 is at the nearest position in a range where the guard 405 can move or position itself along the decline of the platform 403.

FIG. 22 illustrates a cross-sectional snapshot of the sheet loader 400 after the sheet bundle T1 is discharged to the platform 403.

The weight of the sheet bundle T1 extends the spring 406 by gravitational force on the guard 405, and the guard 405 slides down the decline of the platform 403 slightly.

FIG. 23 illustrates a cross-sectional snapshot of the sheet loader 400 after sheet bundles T2 through T5 are discharged on the platform 403.

The distance between the wall 402 and the guard 405 increases in accordance with a number of sheet bundles laid on the platform 403. That is, a space for putting the sheet bundles with the bulge portion of each (except the first bundle) positioned on top of an adjacent bundle's lap portion respectively is enlarged by the increasing gravitational force of sheet bundles themselves.

Even if relatively large size sheet bundles are discharged on the platform 403, the space for stacking the large size sheet bundles can be acquired by the guard 405 moving away as caused by increasing heaviness of the sheet bundles.

The distance between the wall 402 and the guard 405 may be longer than a length of the sheet bundle before the sheet bundle is discharged on the platform 403. As a result, the sheet bundles slide down the decline to mount their bulge portions on top of a preceding bundle's lap portion.

The angle of the decline of the platform 403 slows down the sliding speed of the sheet bundle so that it does not run over the bulge portion of the preceding sheet bundle. As a result, each bulge portion of the sheet bundles is on the lap portion of an adjacent sheet bundle under the sheet bundle.

(2-2-2) Embodiment 3

Figure 24:
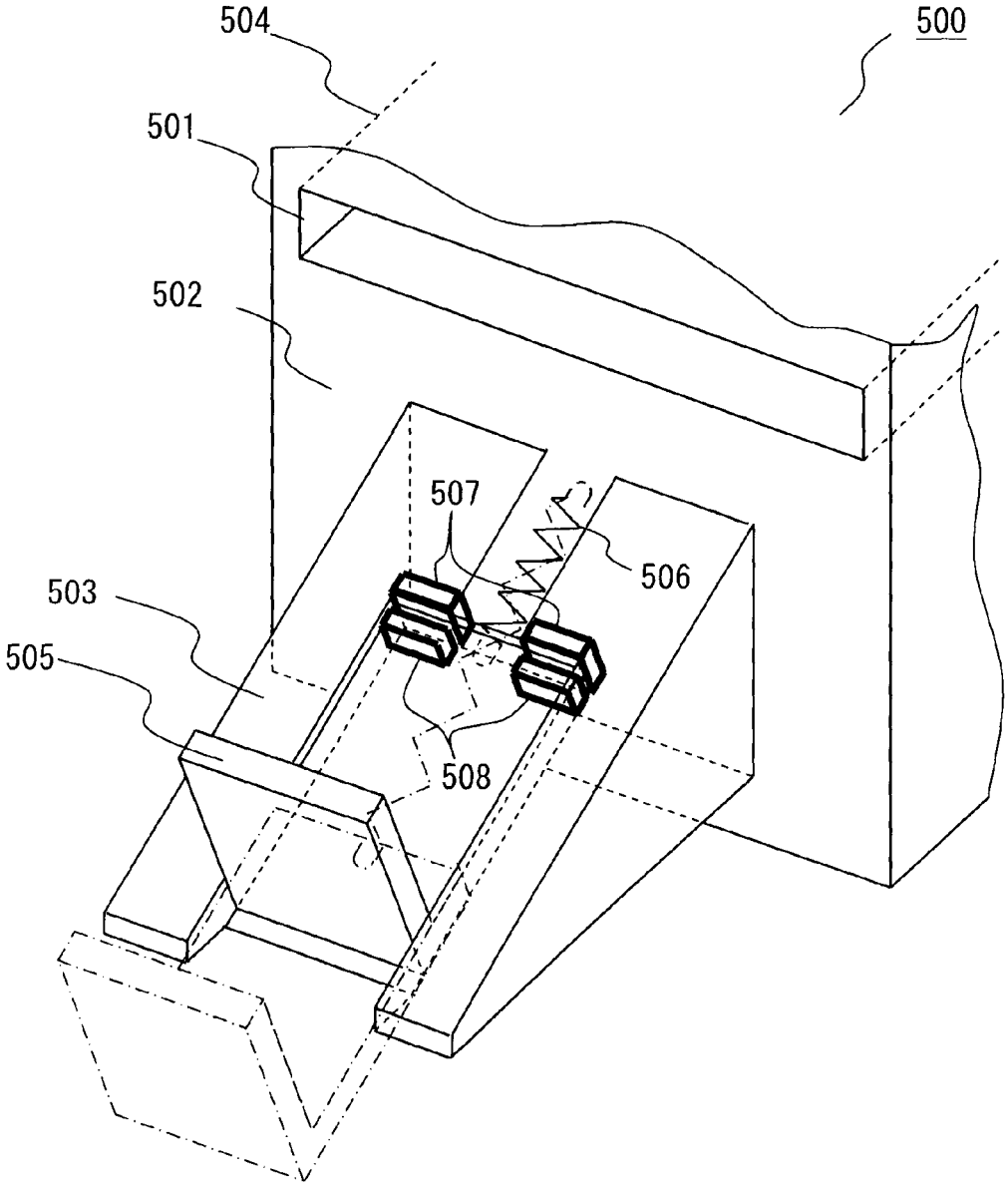
FIG. 24 is a diagram illustrating an exemplary perspective view of a sheet loader according to a third exemplary embodiment.

FIG. 24 illustrates a third exemplary embodiment of a sheet loader. The sheet loader 500 includes an outlet 501 as a part of a sheet bundle provider, a wall 502, a platform 503 as an undersurface support, a path 504, a guard 505, and a spring 506. These features respectively correspond to the outlet 401, the wall 402, the platform 403, the path 404, the guard 405, and the spring 406 of Embodiment 2. The wall 502 and the path 504 may be parts of the sheet bundle provider. The guard 505 may be a folded edge blocker.

The sheet loader 500 further includes a magnet 507 and a steel plate 508. The magnet 507 is supported on the guard 505, and the steel plate 508 is supported on the platform 503. The magnet 507 has a sufficient magnetic force to attract the steel plate 508 to keep the guard 505 only, without supporting any sheet bundles, at the nearest position in a range where the guard 505 can move along the decline of the platform 503. The magnet 507 and a steel plate 508 may be parts of a canceller.

The magnetic force keeps the guard 505 at position nearest magnetic 507 before a total weight of sheet bundles put on the platform 503 exceeds a threshold limit. If the total weight of the sheet bundles put on the platform 503 exceeds the threshold limit, the guard 505 starts to slide down the decline of the platform 503. An initial sliding distance just after the guard 505 starts to slide down the decline of the platform 503 may be longer than a sliding distance of the guard 505 per a sheet bundle after then.

An exemplary operation of the sheet loader 500 is explained with snapshots in FIGS. 25 to 28.

Figure 25:
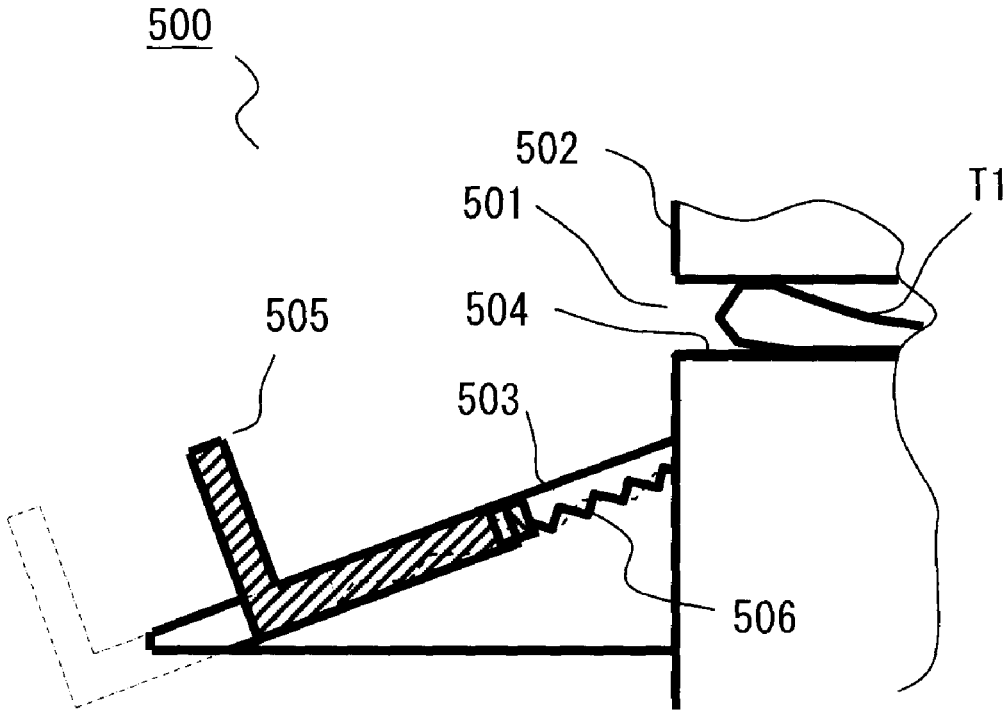
FIG. 25 is a diagram illustrating an exemplary cross-sectional view of a sheet loader according to a third exemplary embodiment.

FIG. 25 illustrates a cross-sectional snapshot of the sheet loader 500 before a sheet bundle T1 in the path 504 is discharged to the platform 503. A total force of the magnet 507 and the spring 506 bias the guard 505 including no sheet bundle on the platform 503, so that the guard 505 is at the nearest position in the range where the guard 505 can move along the decline of the platform 503.

Figure 26:
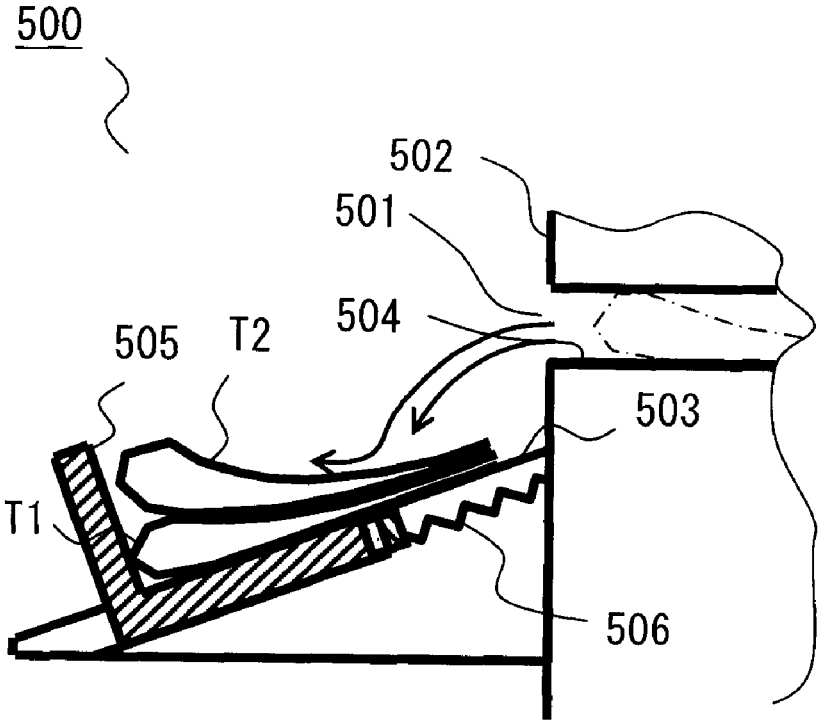
FIG. 26 is a diagram illustrating an exemplary cross-sectional view of a sheet loader according to a third exemplary embodiment.

FIG. 26 illustrates a cross-sectional snapshot of the sheet loader 500 after the sheet bundle T1 and the following sheet bundle T2 are discharged to the platform 503. The guard 505 does not slide down the decline of the platform 503 at this time because the total force of the magnet 507 and the spring 506 sustains a total weight of the sheet bundles T1 and T2 (the combined force of the magnet and the spring is greater than the gravitational force of the weight of sheet bundles T1 and T2). A stack is formed with the sheet bundles T1 and T2.

Figure 27:
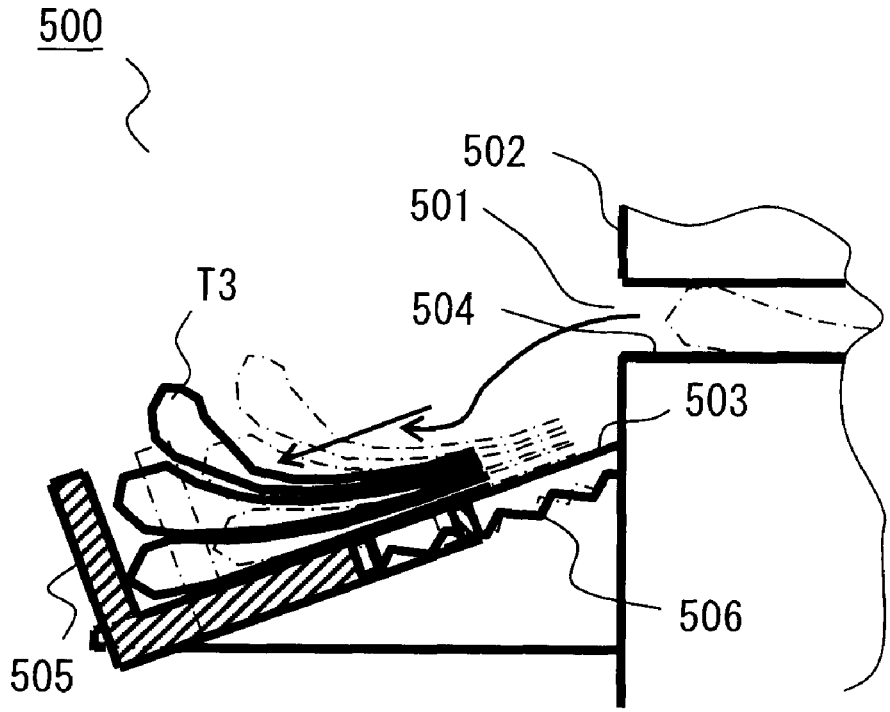
FIG. 27 is a diagram illustrating an exemplary cross-sectional view of a sheet loader according to a third exemplary embodiment.

FIG. 27 illustrates a cross-sectional snapshot of the sheet loader 500 after a sheet bundle T3 is discharged on the stack of the sheet bundle T1 and the sheet bundle T2. The total force of the magnet 507 and the spring 506 cannot sustain the weight of a stack including the sheet bundles T1 through T3

(the combined force of the magnet and the spring is less than the gravitational force of the weight of sheet bundles T1, T2, and T3). Due to the gravitational force, the guard 505 slides down the decline of the platform 503 with the stack. As the result, the stack is ready for being overlapped by a folded edge side of the next following sheet bundle discharged from the outlet 501, on the open end side of the ready stack.

Figure 28:
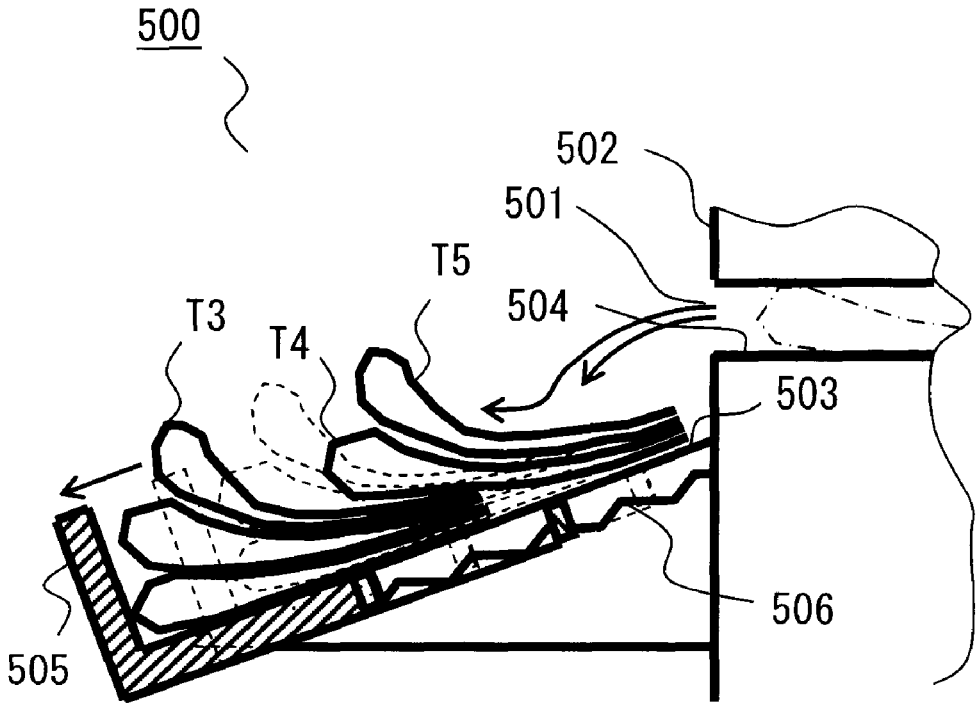
FIG. 28 is a diagram illustrating an exemplary cross-sectional view of a sheet loader according to a third exemplary embodiment.

As just described, the stack is ready for being overlapped by a folded edge of the following sheet bundle on its lap portion by movement of the stack toward its folded edge side. FIG. 28 illustrates a cross-sectional snapshot of the sheet loader 500 after sheet bundles T4 and T5 are discharged on the stack including the sheet bundles T1 through T3, and a folded edge side of a stack of the sheet bundles T4 and T5 overlaps on the open end side of the stack of the sheet bundles T1 through T3.

After the stacks are removed from the platform 503, the guard 505 climbs back to and reassumes the position just as illustrated in FIG. 25 by the force of the spring 506, and the magnet 507 uses its force to securely attract the steel plate 508.

The guard 505 may slide down halfway of the range at a time when the guard 505 starts to slide down as illustrated in FIG. 27 if the force of the spring is set relatively strong. The guard 505 may slide down to the bottom of the range at a time when the force of the spring is set relatively weak, as well.

Figure 29:
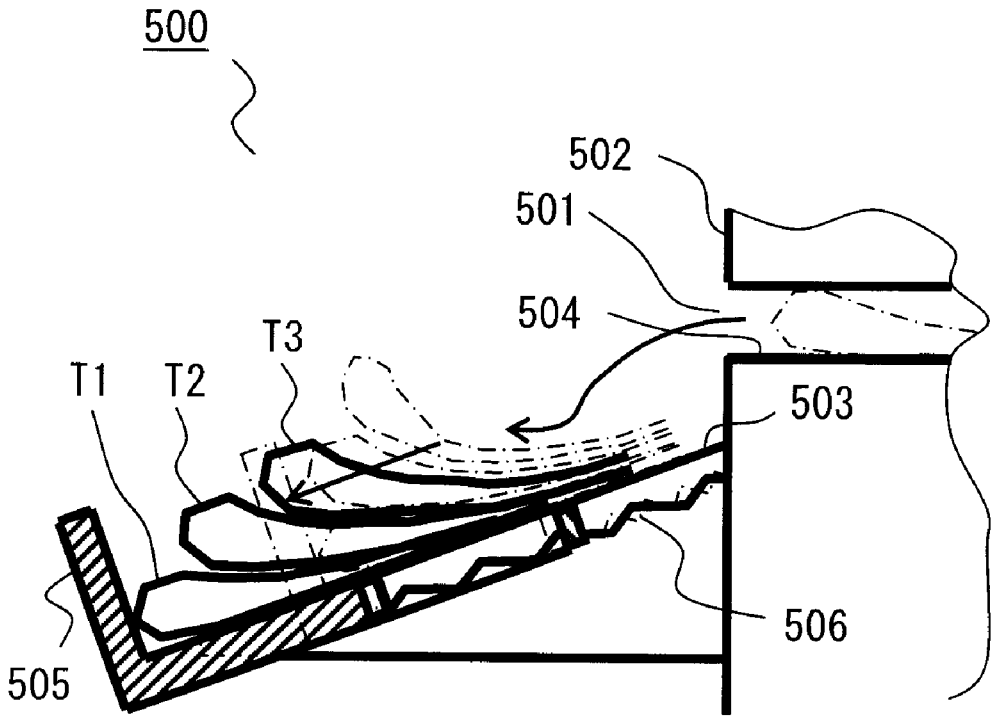
FIG. 29 is a diagram illustrating an exemplary cross-sectional view of a sheet loader according to a third exemplary embodiment.
Figure 30:
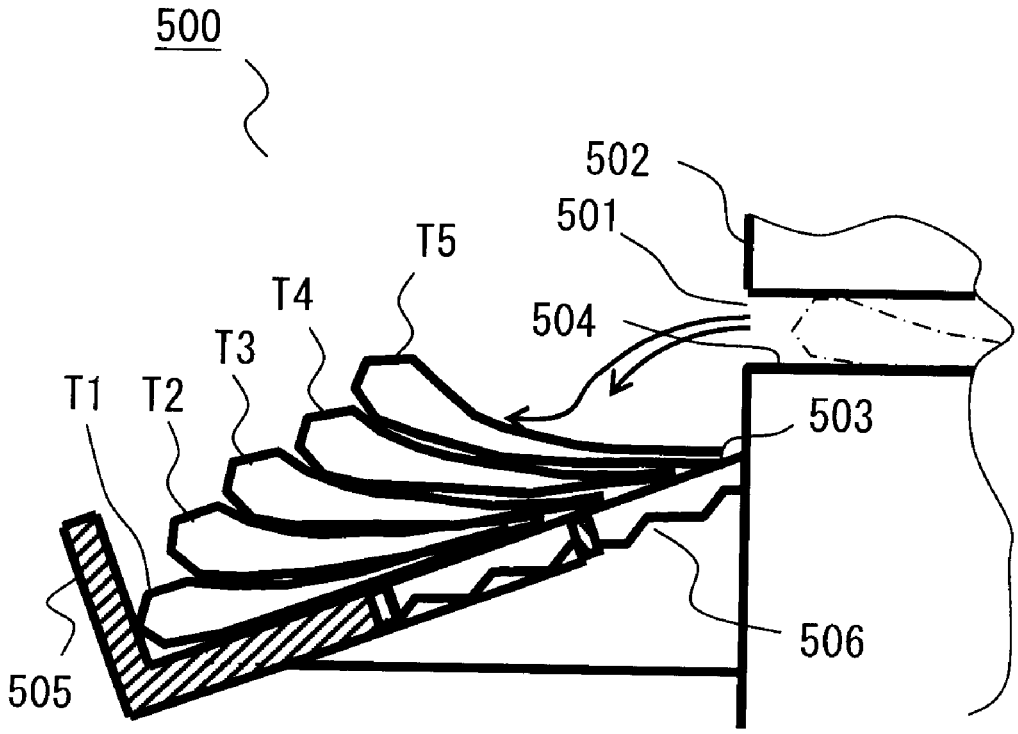
FIG. 30 is a diagram illustrating an exemplary cross-sectional view of a sheet loader according to a third exemplary embodiment.

Although FIGS. 27 and 28 illustrate a situation where the stack does not break apart during the shift of the platform 503, the stack may break apart during the shift by the inertia of the stack as illustrated in FIG. 29 if friction between the sheet bundles is relatively weak. As a result, each bulge portion of the sheet bundles is respectively on a lap portion of a sheet bundle below the sheet bundle. And then, the next following sheet bundles T4 and T5 are put on the platform 503 with their folded edges overlapping on an open end of their respective preceding sheet bundle, as shown in FIG. 30. If the stack on the guard 505 is already broken apart before the stack become unstable, it is unnecessary to be concerned with the stability of the stack.

In addition, the magnet 507 may be a temporary magnet including similar devices to the discharge sensor 304, the button 309, the load sensor 311 and the controller 312 of the sheet loader 500 in Embodiment 1, and change the Act 355 of the FIG. 15 with to release the electromagnetic force of the magnet 507 (of course, the electromagnetic force should work before then). A lock released by a magnetic force of a temporally magnet may be employed to retain the guard 505 at the top of the range.

(2-2-3) Embodiment 4

Figure 31:
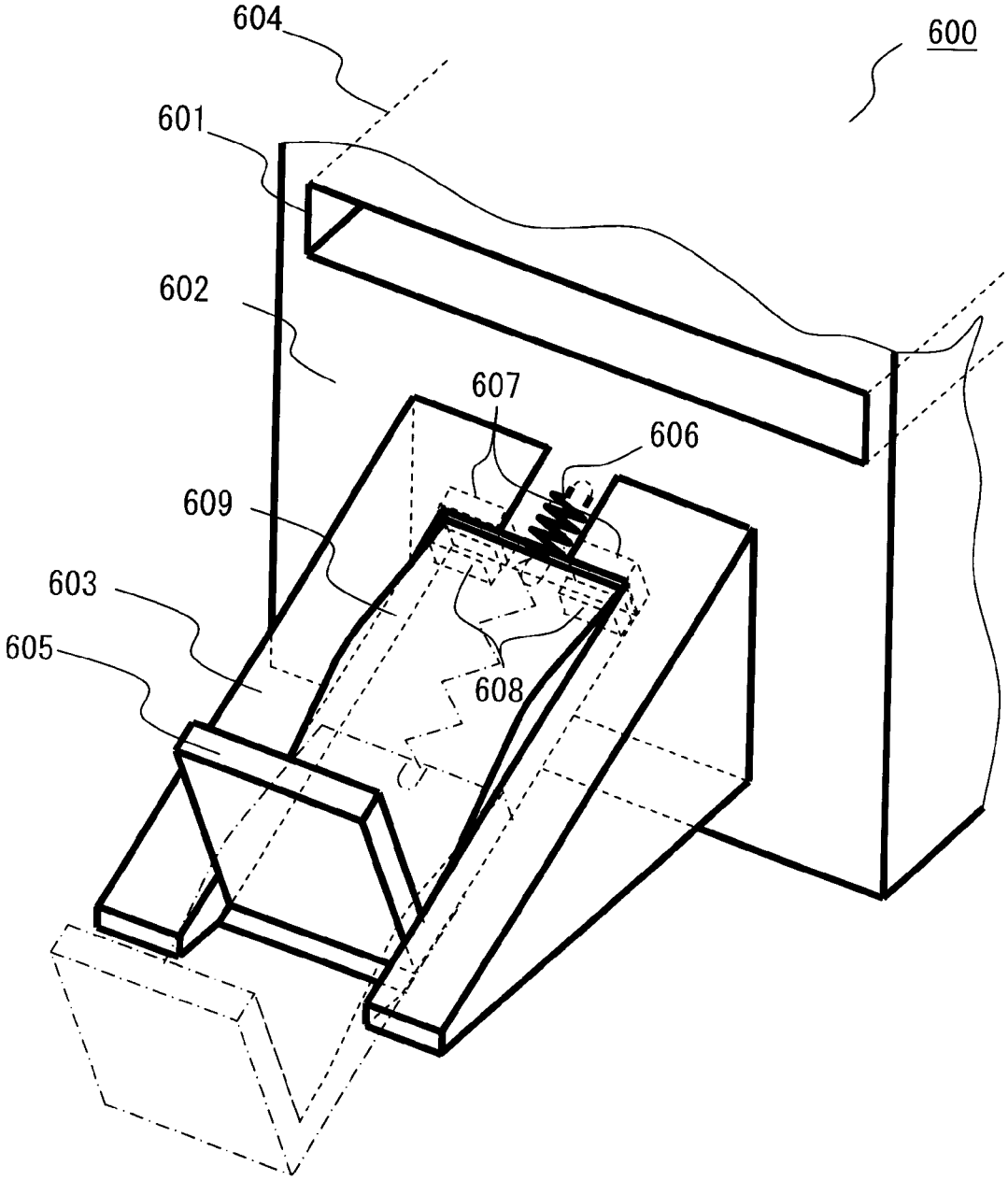
FIG. 31 is a diagram illustrating an exemplary perspective view of a sheet loader according to a fourth exemplary embodiment.

FIG. 31 illustrates a fourth exemplary embodiment of a sheet loader. The sheet loader 600 includes an outlet 601 as a part of a sheet bundle provider, a wall 602, a platform 603 as an undersurface support, a path 604, a guard 605, a spring 606, a magnet 607, and a steel plate 608. They respectively correspond to the outlet 501, the wall 502, the platform 503, the path 504, the guard 505, the spring 506, the magnet 507, and the steel plate 508 of Embodiment 3. The wall 602 and the path 604 may be parts of the sheet bundle provider. The magnet 607 and a steel plate 608 may be parts of a canceller. The guard 605 may be a folded edge blocker.

Figure 32:
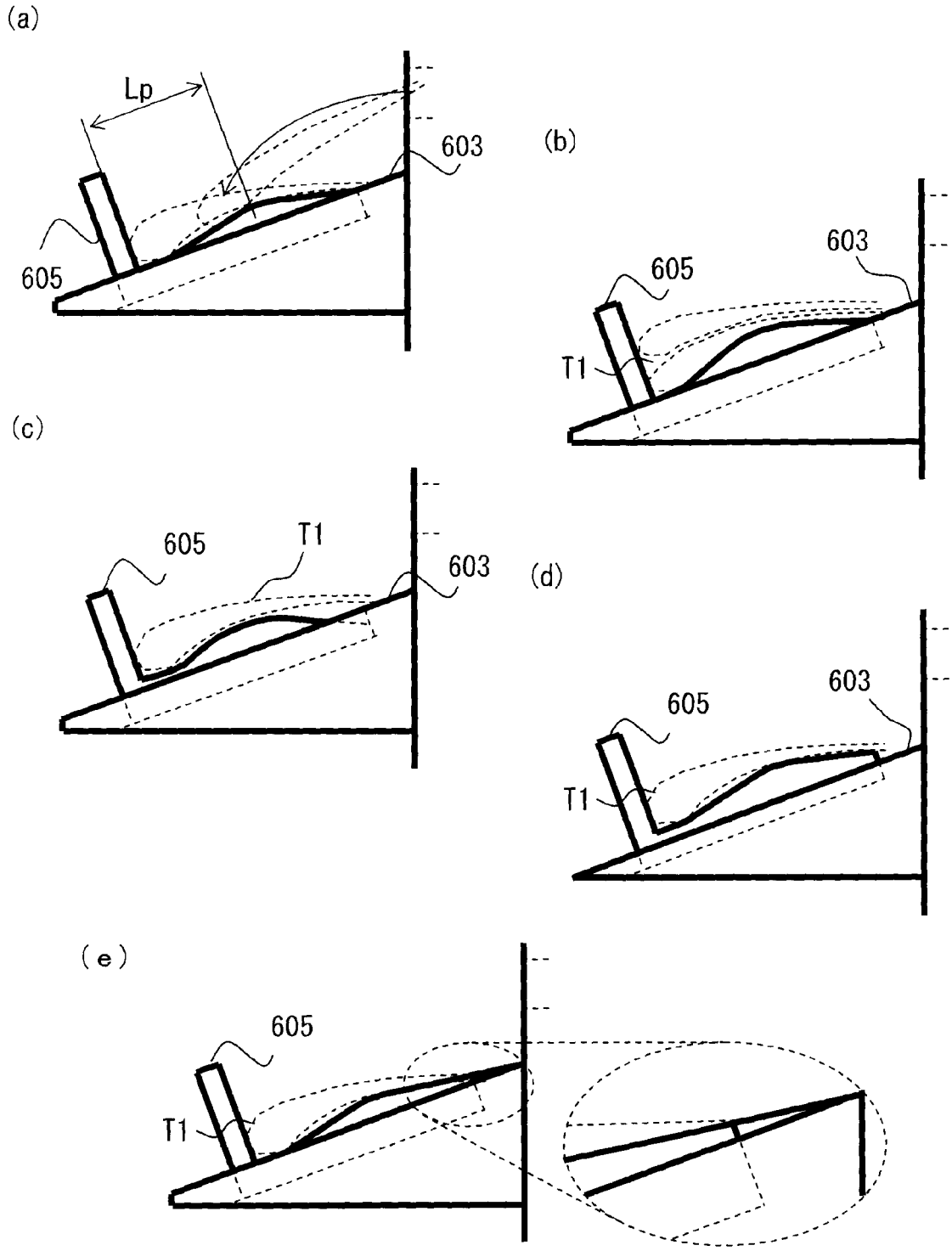
FIG. 32 is a diagram illustrating an exemplary cross-sectional views of a base plate of a sheet loader according to a fourth exemplary embodiment.

A base plate 609 connecting to the guard 605 of this embodiment has a hill or mound across its lateral direction. The hill has a peak or apex. A ridge line of the peak or apex is along a folded edge of a sheet bundle which is supported by the guard 605, a direction along the ridge line of the peak may be perpendicular to a direction where the guard 605 moves back and forth. The peak of the hill may be rounded or cornered. The base plate 609 with the hill may also be the undersurface support. FIG. 32(*a*) is a side view of the sheet loader 600.

A distance Lp indicated in FIG. 32(*a*) is a distance between the peak and a face of the guard 605 which contacts a folded edge of the sheet bundle. The distance Lp is along the direction where the guard 605 moves back and forth. The distance Lp may be shorter than a half of a length of the sheet bundle. If the outlet 601 discharges various sizes of sheet bundles, the distance Lp may be shorter than a half of a length of the maximum size of the various sheet bundles.

A bulge portion of a sheet bundle initially laid on the platform 603 falls into a space between the peak and the face of the guard 605. Although the ridge line of the peak in this embodiment continues through an entire of a width of the guard 605, the ridge line of the peak may include a plurality of independent peaks.

A valley wall is a surface extending on the base plate 609 toward the guard 605 from the peak. A mountain slope is a surface extending on the base plate 609 toward a side by the wall 602 from the peak. The valley wall inclines steeper than the mountain slope. Due to the increased steepness of the valley wall, friction and other resistances in a range between the peak and the guard 605 are reduced, and the folded edge of a first sheet bundle can contact the guard 605 more easily. Additionally, the first sheet bundle can contact with the guard 605 stable.

Such benefit is improved by setting the landing point of the first sheet bundle farther than the peak. Conversely, if the landing point is closer to the wall 602 than the peak, it is necessary to set the discharging speed of the first sheet bundle relatively fast, and to set the decline of the platform 603 steeply, suitably enough to prevent the first sheet bundle from stopping before contacting the guard 605.

The peak has a sufficient height to support the first sheet bundle so as to keep a superolateral surface of the first sheet bundle as convex or flat. The peak may be set sufficiently high enough to keep a superolateral surface of the following several sheet bundles mounting on the first sheet bundle as convex or flat. A reason to keep the superolateral surface of the top sheet bundle of the stack as convex or flat is to prevent the next following sheet bundle from stopping before contacting the guard 605. In many instances, it is undesirable for a subsequent sheet bundle to stop before contacting the guard 605.

The mountain slope of the hill may be set to cross the upper surface of the platform 603 as illustrated in FIG. 32(*c*) to keep open ends of sheet bundles closer to the platform 603. As a result, since both corners of open ends are supported by the platform 603, which is broader than the base plate 609, the sheet bundle is stabilized further.

An end of the mountain slope close to the wall 602 may set above the upper surface of the platform 603 as illustrated in FIG. 32(*d*) and FIG. 32(*e*). As a result, since the open ends of sheet bundles are prevented from contacting the platform 603, the sheet bundles are prevented from stopping before contacting the guard 603 by friction with the platform 603.

An exemplary operation of the sheet loader 600 is explained with snapshots in FIGS. 33 to 36.

Figure 33:
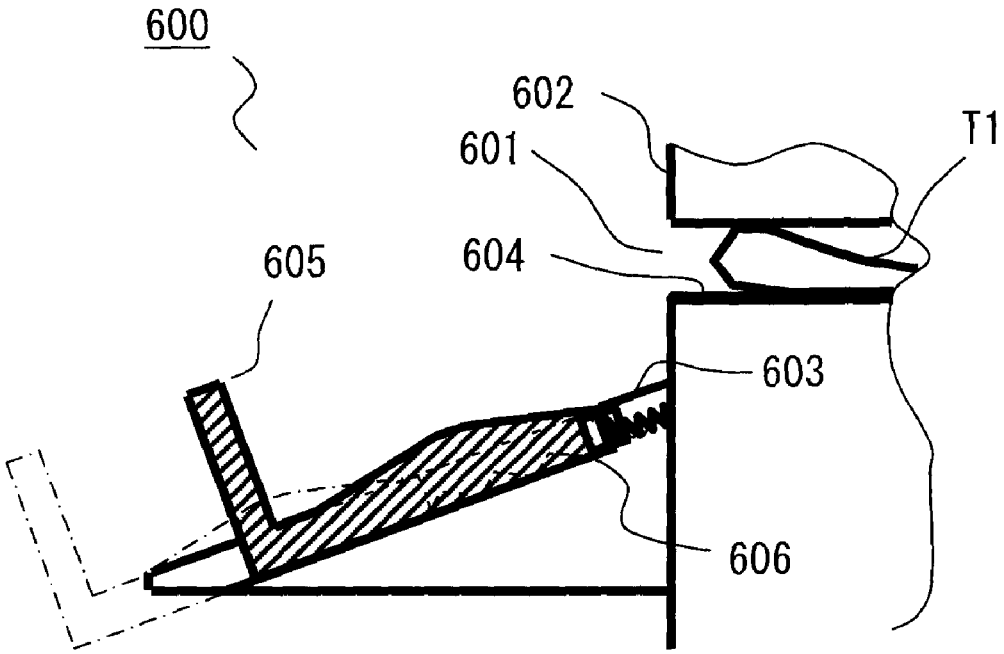
FIG. 33 is a diagram illustrating an exemplary cross-sectional view of a sheet loader according to a fourth exemplary embodiment.

FIG. 33 illustrates a cross-sectional snapshot of the sheet loader 600 before a sheet bundle T1 in the path 604 is discharged to the platform 603. The magnet 607 and the spring 606 bias the guard 605 with their total respective forces, but there is no sheet bundle on the platform 603, so the guard 605 is at the nearest position in the range where the guard 605 can move along the decline of the platform 603.

Figure 34:
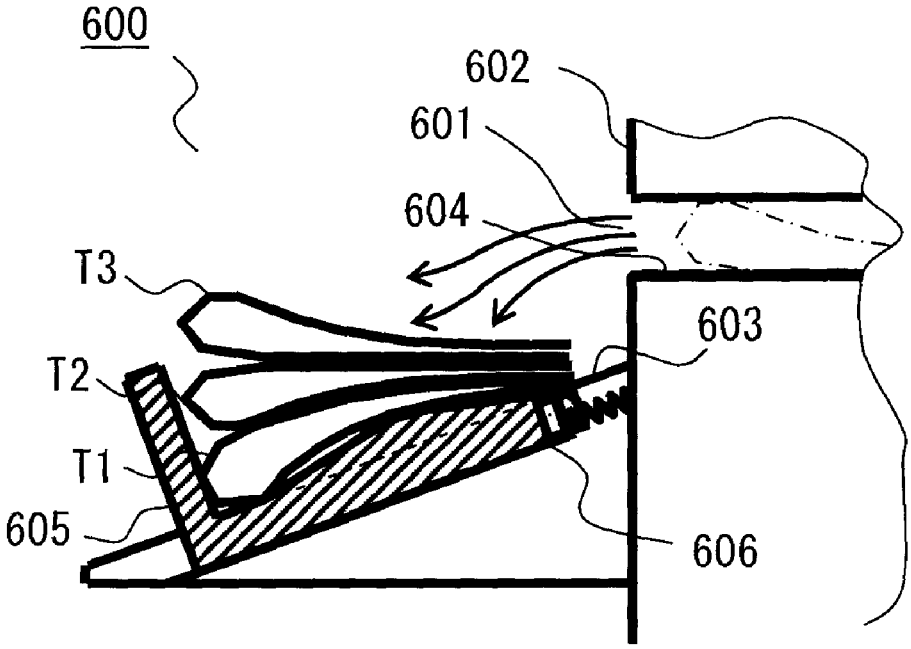
FIG. 34 is a diagram illustrating an exemplary cross-sectional view of a sheet loader according to a fourth exemplary embodiment.

FIG. 34 illustrates a cross-sectional snapshot of the sheet loader 600 after the sheet bundle T1 and the following sheet bundles T2 and T3 are discharged to the platform 603 in numerical order. The guard 605 does not slide down the decline of the platform 603 at this time because the total force of the magnet 607 and the spring 606 sustains a total weight of the sheet bundles T1 through T3. As a result, a stack is formed with the sheet bundles T1 through T3. Since a superolateral surface of the sheet bundle T2 is slightly convex by the benefit of the hill on the base plate 609, the sheet bundle T3 is kept more stable on the sheet bundle T2, and the entire stack is held more stable.

Figure 35:
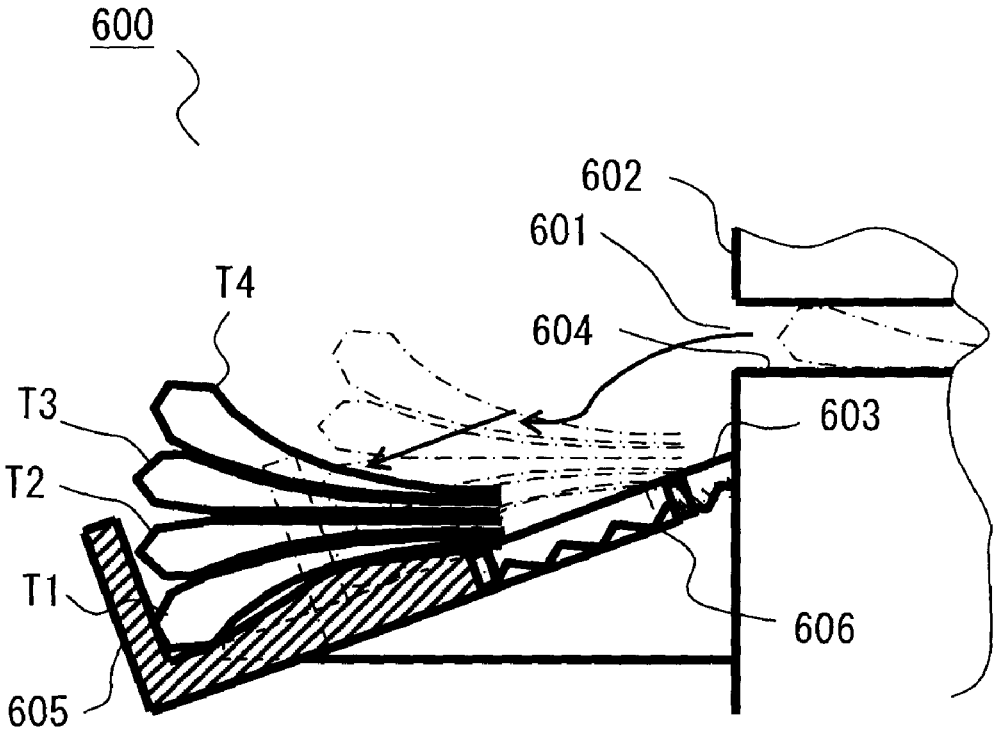
FIG. 35 is a diagram illustrating an exemplary cross-sectional view of a sheet loader according to a fourth exemplary embodiment.

FIG. 35 illustrates a cross-sectional snapshot of the sheet loader 600 after a sheet bundle T4 is discharged on the stack of the sheet bundle T1 through T3. The total force of the magnet 607 and the spring 606 cannot sustain the total weight of the sheet bundles T1 through T4. Then the guard 605 slides down the decline of the platform 603 with the stack. As the result, the stack is ready for being overlapped by a folded edge side of the next following sheet bundle discharged from the outlet 601, on its open end side. It can be understood from the smaller warp of the sheet bundle T3 as illustrated in FIG. 35 than as illustrated in FIG. 27 that the stack is more stable due to the hill on the upper surface of the base plate 609.

Figure 36:
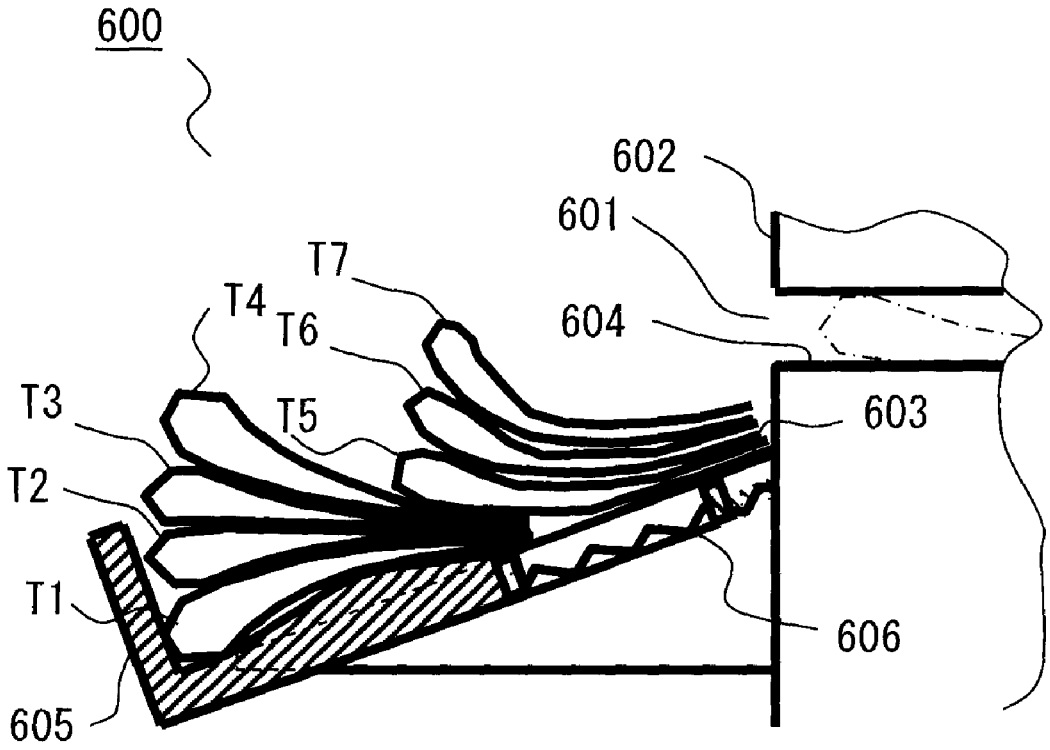
FIG. 36 is a diagram illustrating an exemplary cross-sectional view of a sheet loader according to a fourth exemplary embodiment.

As just described, the stack readies for being overlapped by a folded edge of the following sheet bundle on its lap portion by shifting the stack toward its folded edge side. FIG. 36 illustrates a cross-sectional snapshot of the sheet loader 600 after sheet bundles T5 through T7 are discharged on the stack of sheet bundles T1 through T4, and a folded edge side of a stack of the sheet bundles T5 through T7 overlaps on the open end side of the stack of the sheet bundles T1 through T4.

After the stacks are removed from the platform 603, the guard 605 climbs back to the position just as illustrated in FIG. 33 by the force of the spring 606, and the magnet 607 uses its force to attract the steel plate 608.

Figure 37:
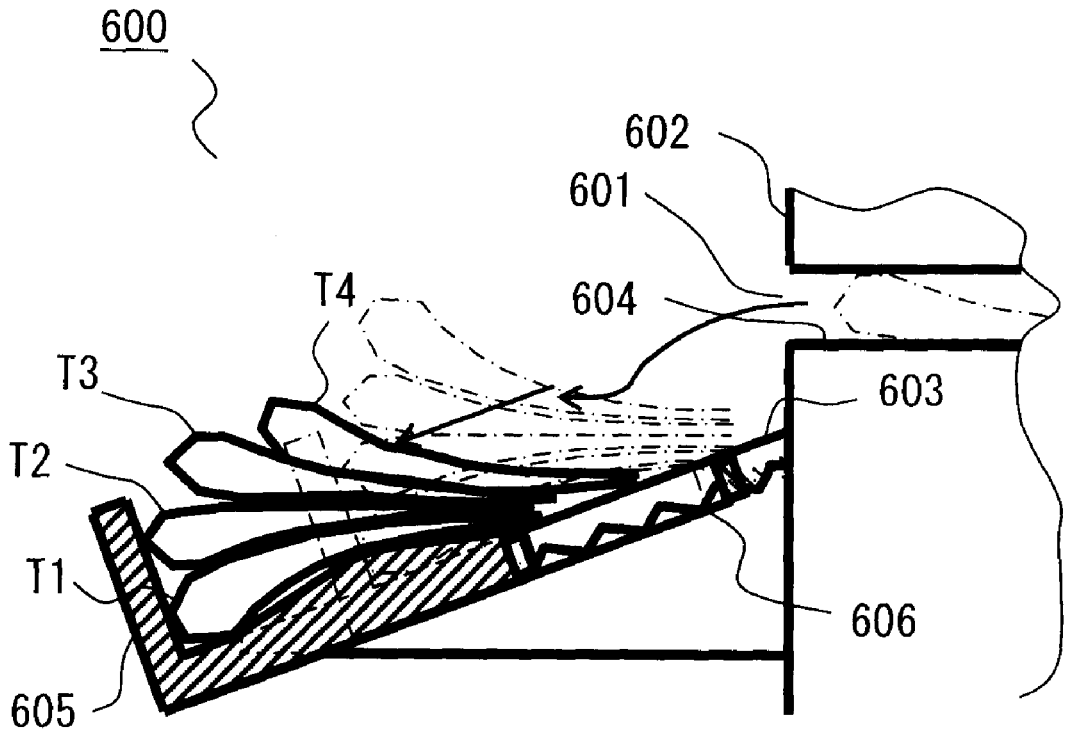
FIG. 37 is a diagram illustrating an exemplary cross-sectional view of a sheet loader according to a fourth exemplary embodiment.
Figure 38:
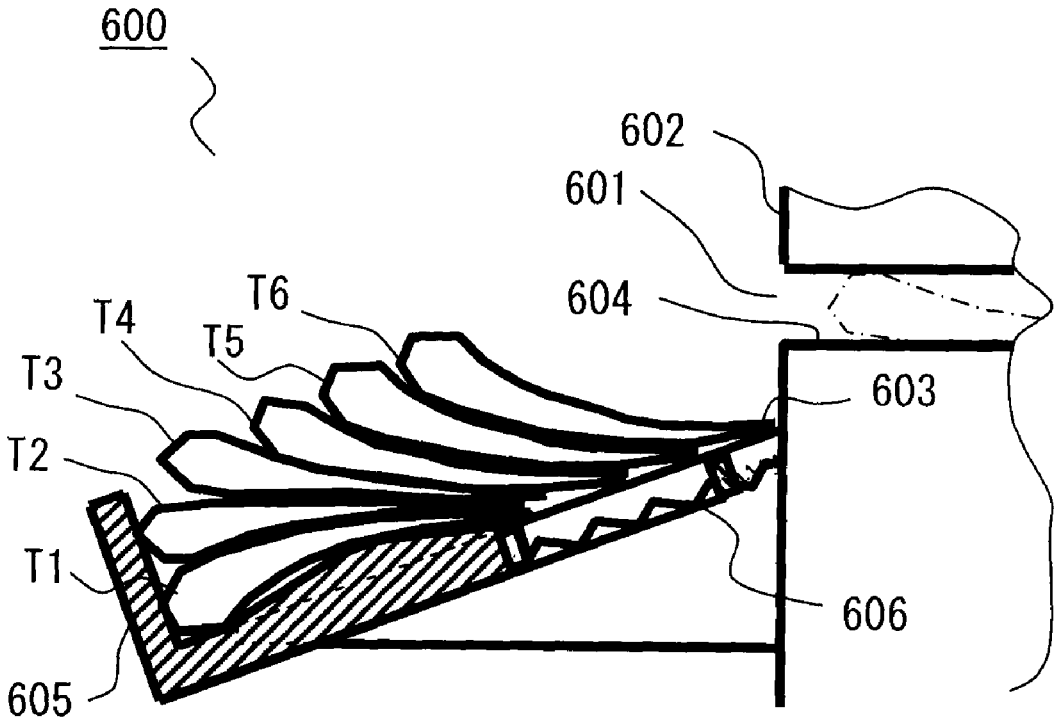
FIG. 38 is a diagram illustrating an exemplary cross-sectional view of a sheet loader according to a fourth exemplary embodiment.

Although FIGS. 35 and 36 illustrate a situation where the stack does not break apart during the shift, the stack may break apart during movement of the stack by the inertia of the stack as illustrated in FIG. 37 if friction between the sheet bundles is not sufficiently strong. As a result, each bulge portion of the sheet bundles is respectively on a lap portion of a sheet bundle below the sheet bundle. And then, the following sheet bundles T5 and T6 are put on the platform 603 with their folded edges overlapping on an open end of their respective preceding sheet bundle, as shown in FIG. 38. If the stack on the guard 605 is already broken apart before the stack become unstable like above, it is unnecessary to be concerned with the stability of the stack.

(2-2-4) Embodiment 5

Figure 39:
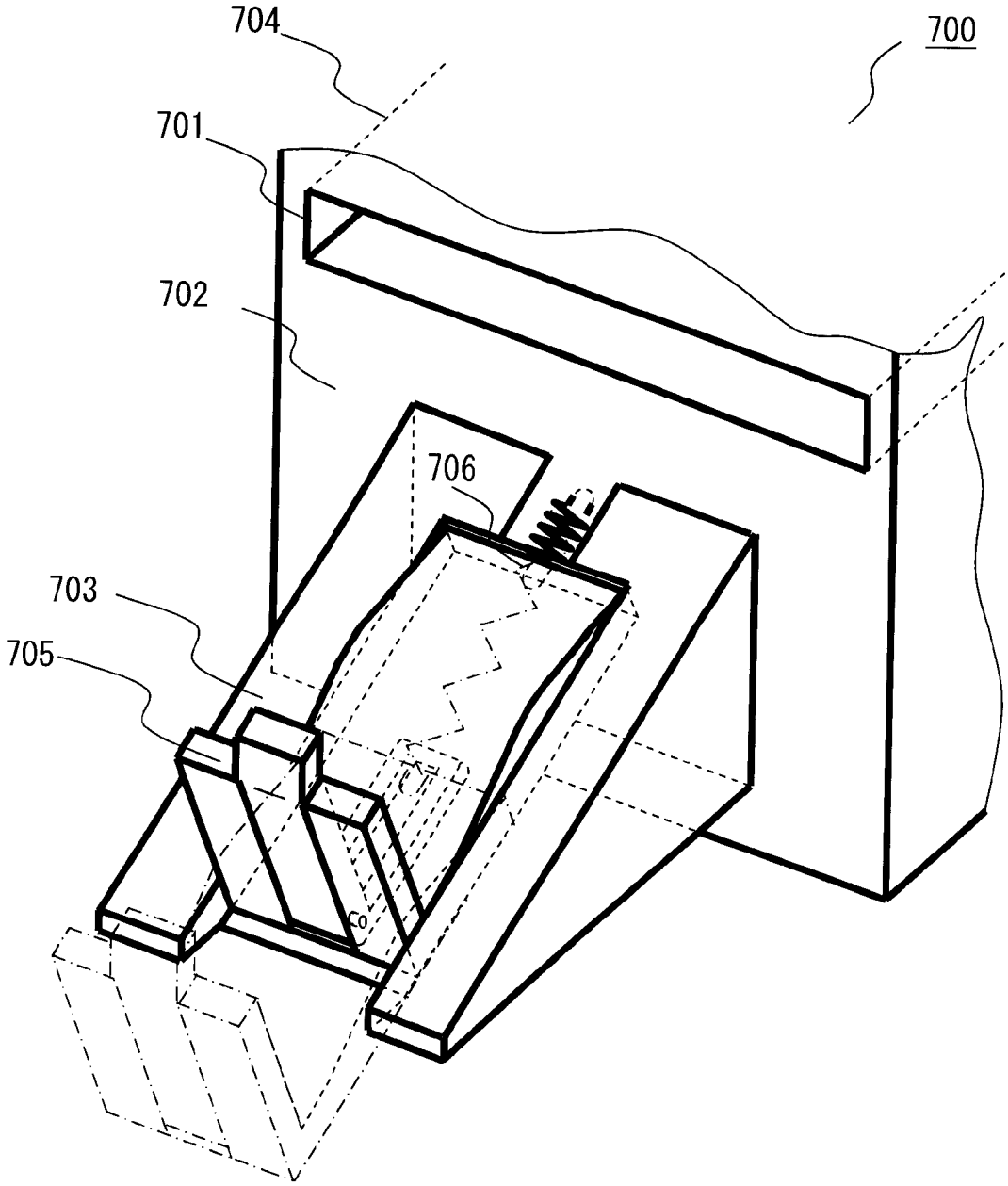
FIG. 39 is a diagram illustrating an exemplary perspective view of a sheet loader according to a fifth exemplary embodiment.

FIG. 39 illustrates a fifth exemplary embodiment of a sheet loader. The sheet loader 700 includes an outlet 701 as a part of a sheet bundle provider, a wall 702, a platform 703 as an undersurface support, a path 704, a spring 706, a magnet 707, and a steel plate 708. These features respectively correspond to the outlet 601, the wall 602, the platform 603, the path 604, the spring 606, the magnet 607, and the steel plate 608 of Embodiment 4. The wall 702 and the path 704 may be parts of the sheet bundle provider.

Figure 40:
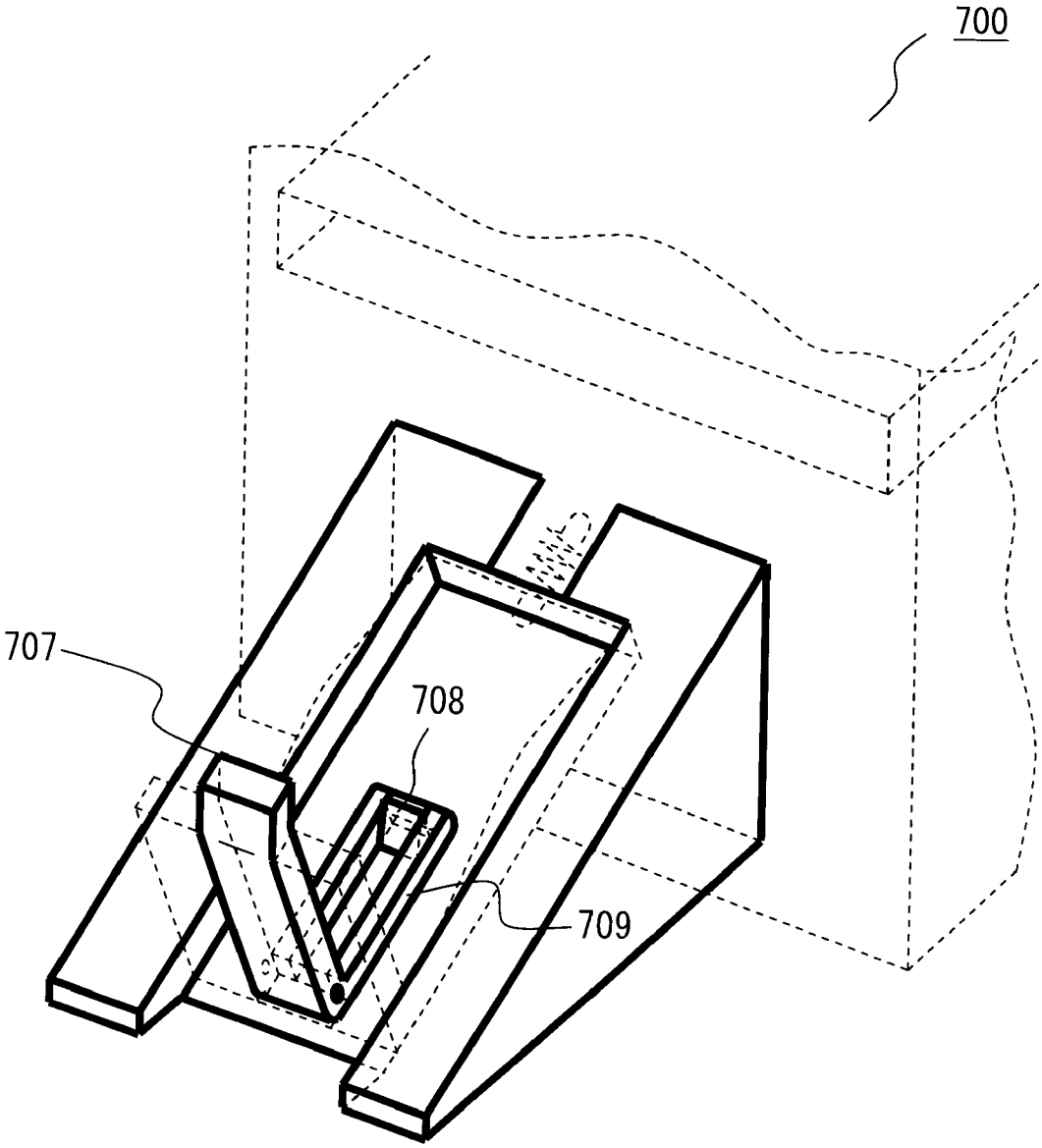
FIG. 40 is a diagram illustrating an exemplary perspective view of a sheet loader according to a fifth exemplary embodiment.

The sheet loader 700 further includes a guard 705 which differs from the guard 605 in Embodiment 4, a lever 707, a stopper 708, and a lever arm 709 as FIG. 40 which illustrates a perspective view of the sheet loader 700. The guard 705 may be a folded edge blocker. The lever 707, the stopper 708, and the lever arm 709 may be parts of a canceller.

The guard 705 rotatably supports the lever 707 at its center in the width direction on an axis along a folded edge of a sheet bundle to be supported by the guard 705.

The lever 707 juts out from the top of the guard 705. The lever 707 is rotated around the axis by a spilt sheet bundle sliding off the top of a stack of sheet bundles after the stack grows higher than the guard 705. The lever 707 has a shape crooked toward the side near the outlet 701 around its top. Such shape provides the benefit of stopping the spilt sheet bundle stable after the lever 707 is pushed into a plane to contact the folded edge of the sheet bundle.

The lower end of the lever 707 connects to the lever arm 709 extended above the decline of the platform 703. The other end of the lever arm 709 engages the stopper 708 on the platform 703. The engagement between the lever arm 709 and the stopper 708 is released if the top of the lever 707 is turned by the push or force of the spilt sheet bundle.

If the height of the stack exceeds a threshold limit, the guard 705 starts to slide down the decline of the platform 703. An initial sliding distance just after then may be longer than a sliding distance of the guard 705 per a sheet bundle.

An exemplary operation of the sheet loader 700 is explained with snapshots in FIGS. 41 to 44.

Figure 41:
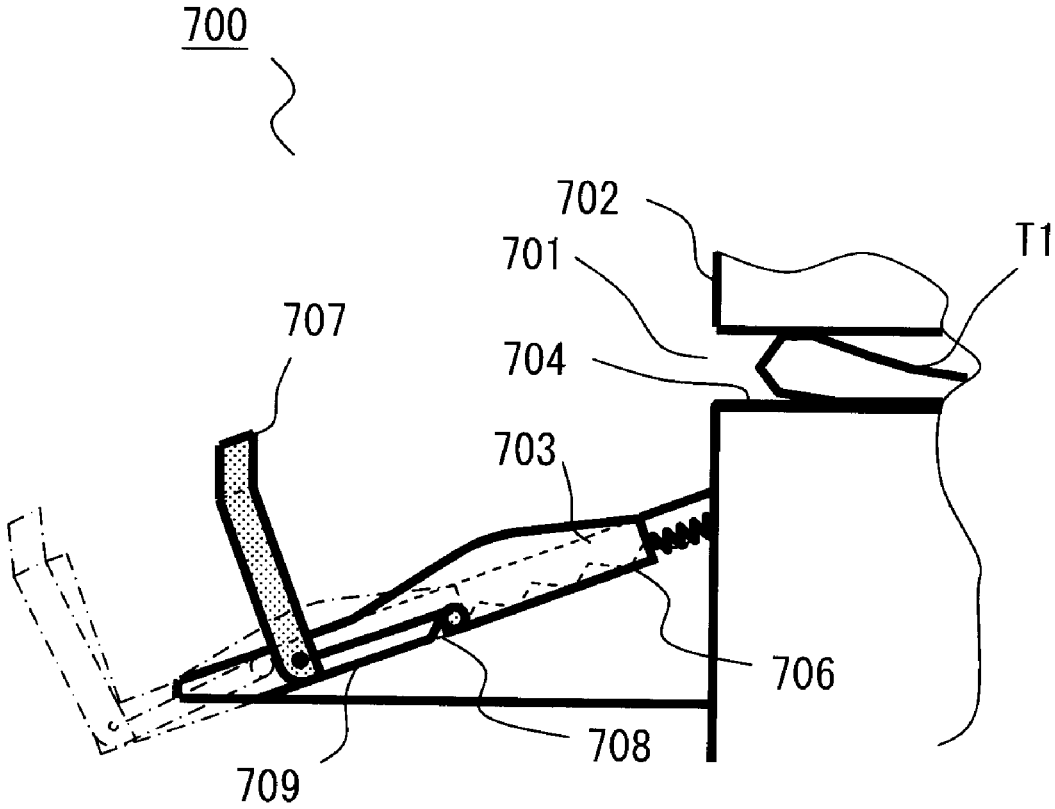
FIG. 41 is a diagram illustrating an exemplary cross-sectional view of a sheet loader according to a fifth exemplary embodiment.

FIG. 41 illustrates a cross-sectional snapshot of the sheet loader 700 before a sheet bundle T1 in the path 704 is discharged to the platform 703. At this time, the stopper 708 catches the lever arm 709, then the guard 705 is kept at the nearest position in a range where the guard 705 can move along the decline of the platform 703.

Figure 42:
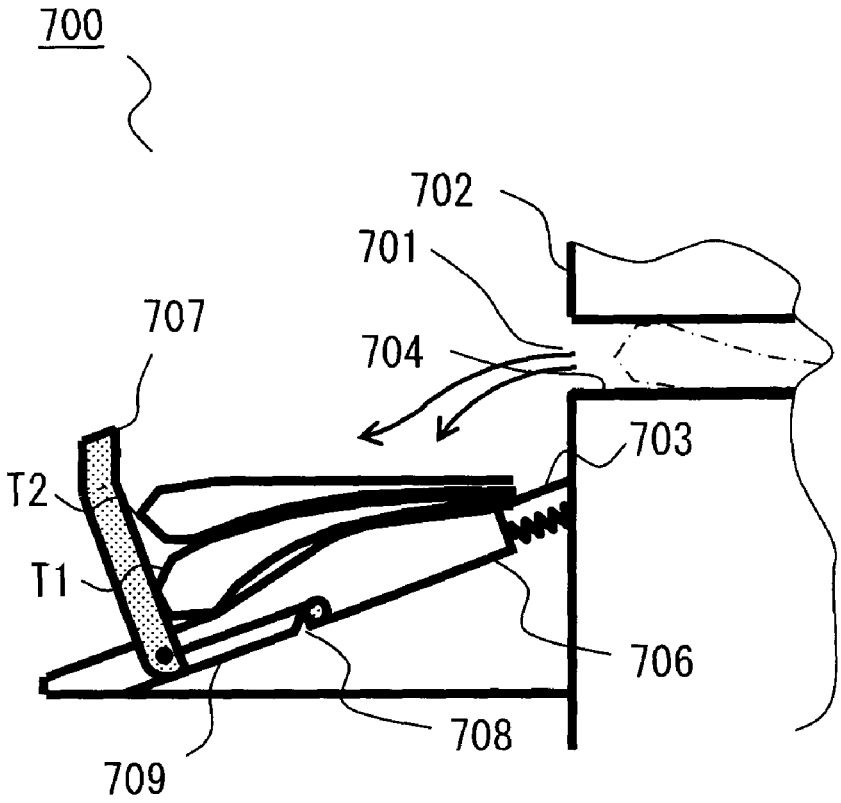
FIG. 42 is a diagram illustrating an exemplary cross-sectional view of a sheet loader according to a fifth exemplary embodiment.

FIG. 42 illustrates a cross-sectional snapshot of the sheet loader 700 after the sheet bundle T1 and the following sheet bundle T2 are discharged to the platform 703. Since the stopper 708 still catches the lever arm 709, the guard 705 is kept at the same position. As a result, a stack is formed with the sheet bundles T1 and T2, and the following sheet bundles mount on the stack.

Figure 43:
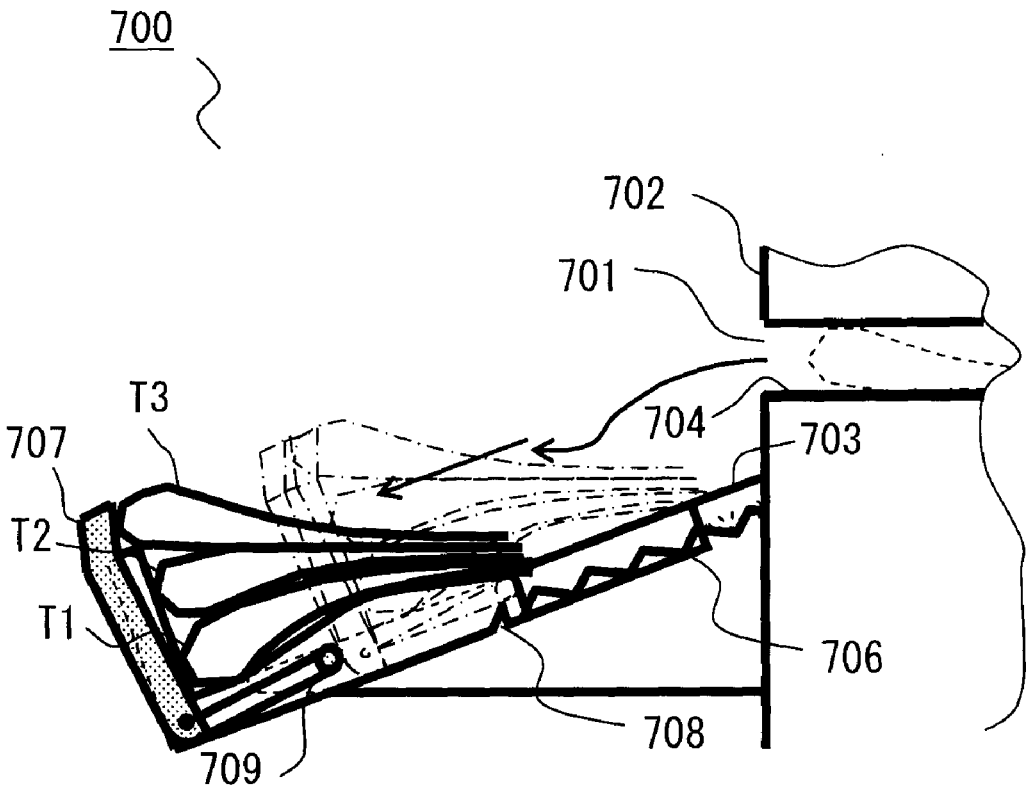
FIG. 43 is a diagram illustrating an exemplary cross-sectional view of a sheet loader according to a fifth exemplary embodiment.

FIG. 43 illustrates a cross-sectional snapshot of the sheet loader 700 after a sheet bundle T3 is discharged on the stack of the sheet bundle T1 and the sheet bundle T2. Since the stack is sufficiently high, the sheet bundle T3 slides off the top of the stack and pushes the top of the lever 707. As a result, the lever 707 turns with the lever arm 709 to releases the stopper 708. Since the guard 705 is not longer coupled to the stopper 708, the guard 705 slides down the decline of the platform 703 with the stack including the sheet bundles T1 through T3. As the result, the stack is ready for being overlapped by a folded edge side of the following sheet bundle discharged from the outlet 701, on its open end side.

Figure 44:
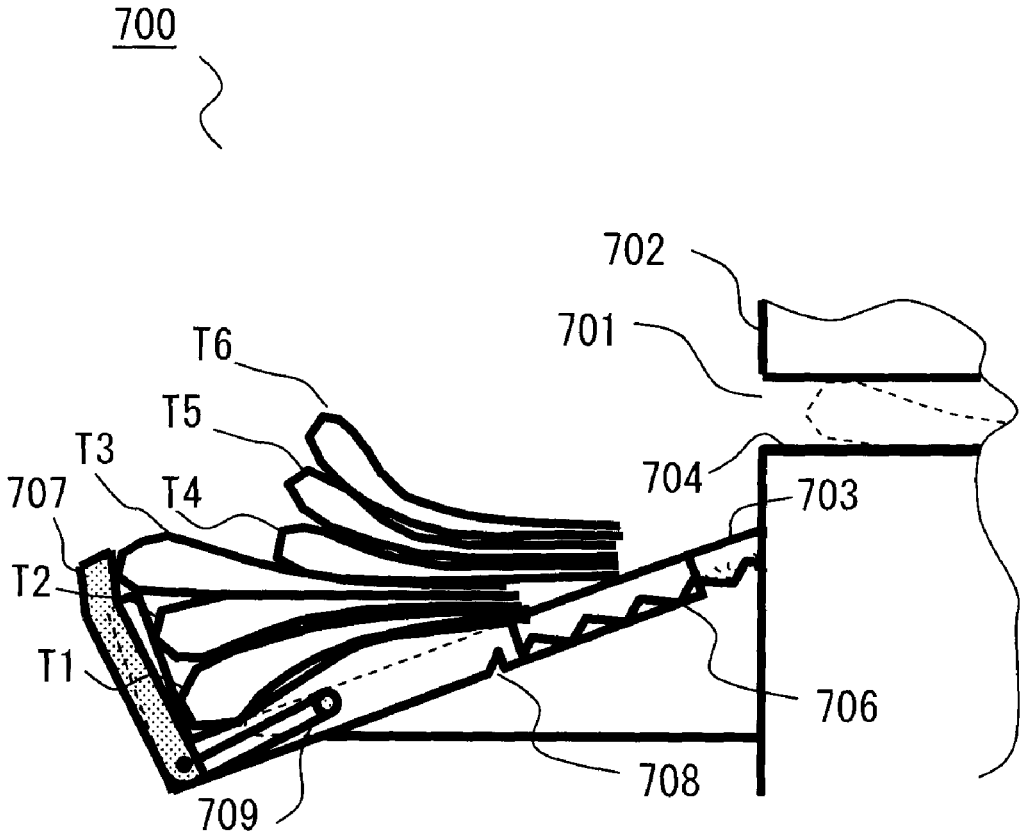
FIG. 44 is a diagram illustrating an exemplary cross-sectional view of a sheet loader according to a fifth exemplary embodiment.

As just described, the stack is ready for being overlapped by a folded edge of the following sheet bundle on its lap portion by shifting the stack toward its folded edge side. FIG. 44 illustrates a cross-sectional snapshot of the sheet loader 700 after sheet bundles T4 through T6 are discharged on the stack of the sheet bundles T1 through T3, and a folded edge side of the stack of the sheet bundles T4 through T6 overlaps on the open end side of the stack of the sheet bundles T1 through T3.

After the stacks are removed from the platform 703, the guard 705 climbs back to the position just as illustrated in FIG. 41 by the force of the spring 706, and the lever 707 restores its posture to engage the lever arm 709 and the stopper 710.

Figure 45:
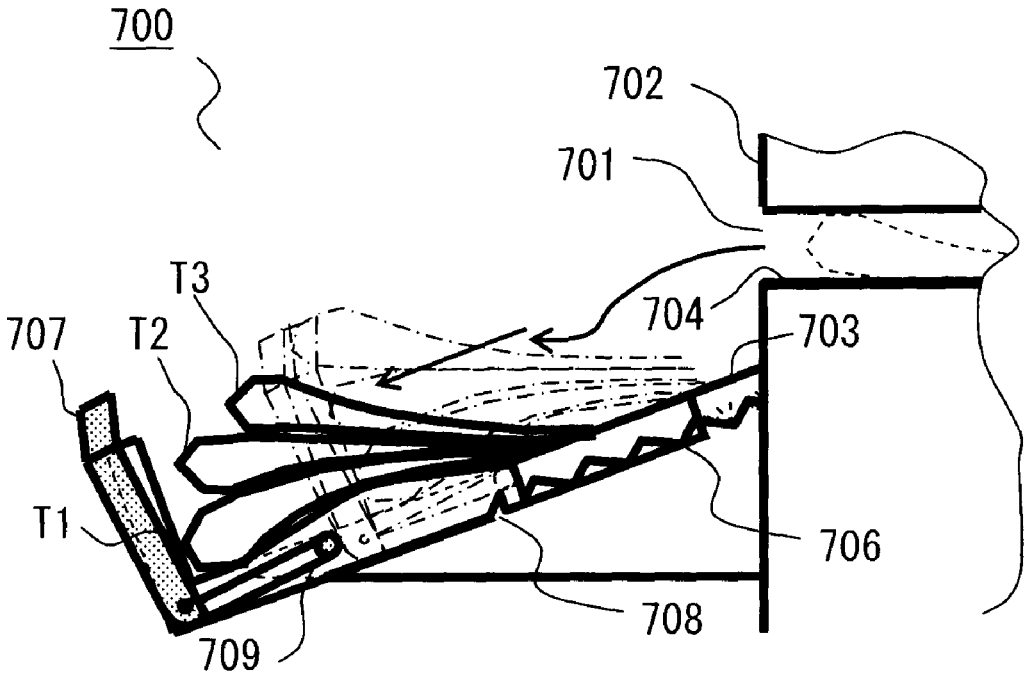
FIG. 45 is a diagram illustrating an exemplary cross-sectional view of a sheet loader according to a fifth exemplary embodiment.
Figure 46:
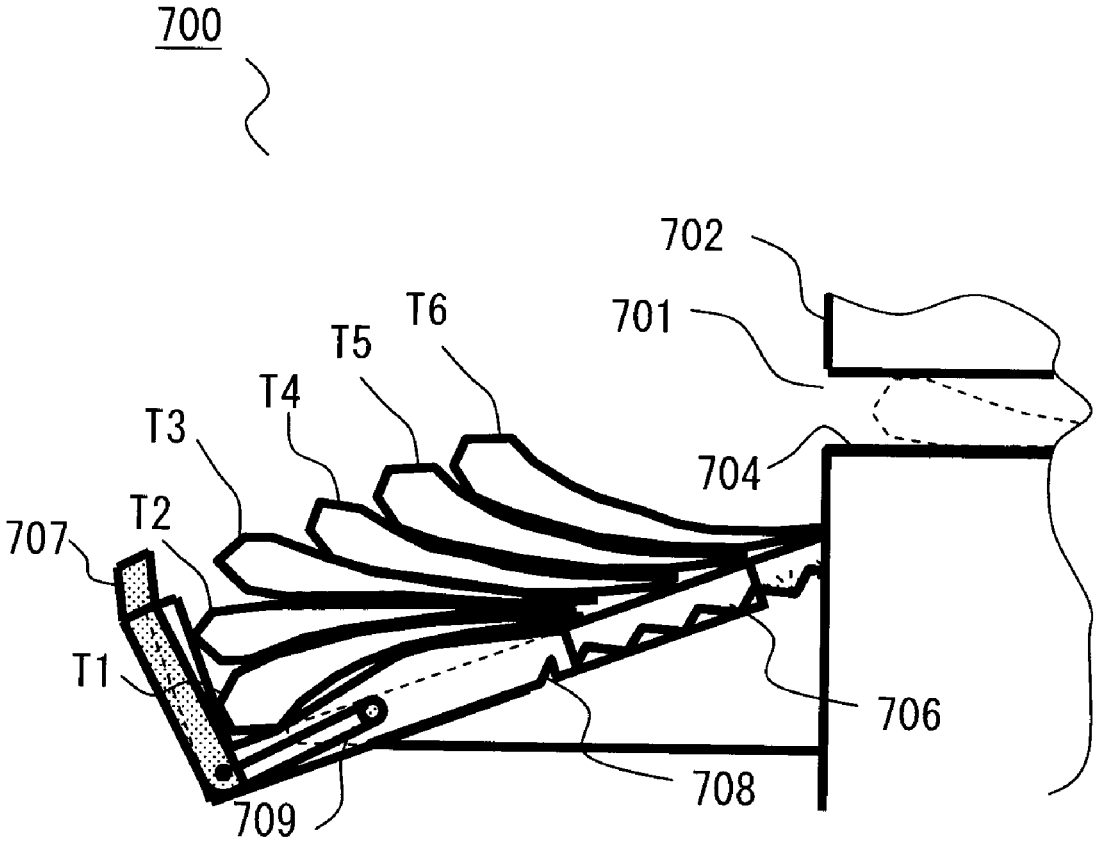
FIG. 46 is a diagram illustrating an exemplary cross-sectional view of a sheet loader according to a fifth exemplary embodiment.

Although FIGS. 43 and 44 illustrates a situation where the stack does not break apart during the shift, the stack may break apart on the shift by the inertia of the stack as illustrated in FIG. 45 if friction between the sheet bundles are not relatively strong. As a result, each bulge portion of the sheet bundles is respectively on a lap portion of a sheet bundle below and adjacent the sheet bundle. And then, the following sheet bundles T4 through T6 are put on the platform 703 with their folded edges overlapping on an open end of their respective preceding sheet bundle, as shown in FIG. 46. If the stack on the guard 705 is already broken apart before the stack becomes unstable like above, it is unnecessary to provide concern for the stability of the stack.

(2-2-5) Embodiment 6

Figure 47:
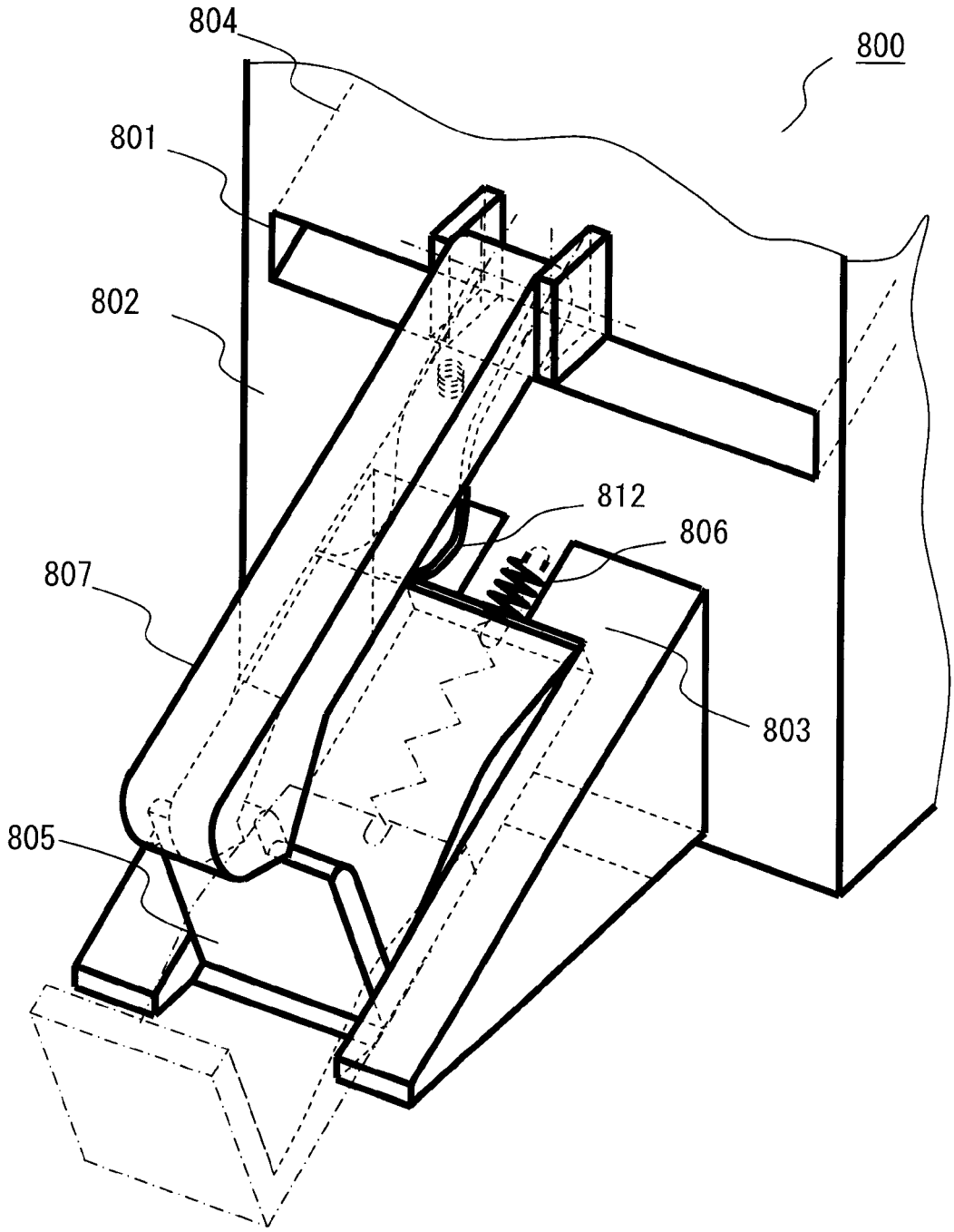
FIG. 47 is a diagram illustrating an exemplary perspective view of a sheet loader according to a sixth exemplary embodiment.

FIG. 47 illustrates a sixth exemplary embodiment of a sheet loader. The sheet loader 800 includes an outlet 801 as a part of a sheet bundle provider, a wall 802, a platform 803 as an undersurface support, a path 804 and a spring 806. These features respectively correspond to the outlet 601, the wall 602, the platform 603, the path 604 and the spring 606 of Embodiment 4. The wall 802 and the path 804 may be parts of the sheet bundle provider.

Figure 48:
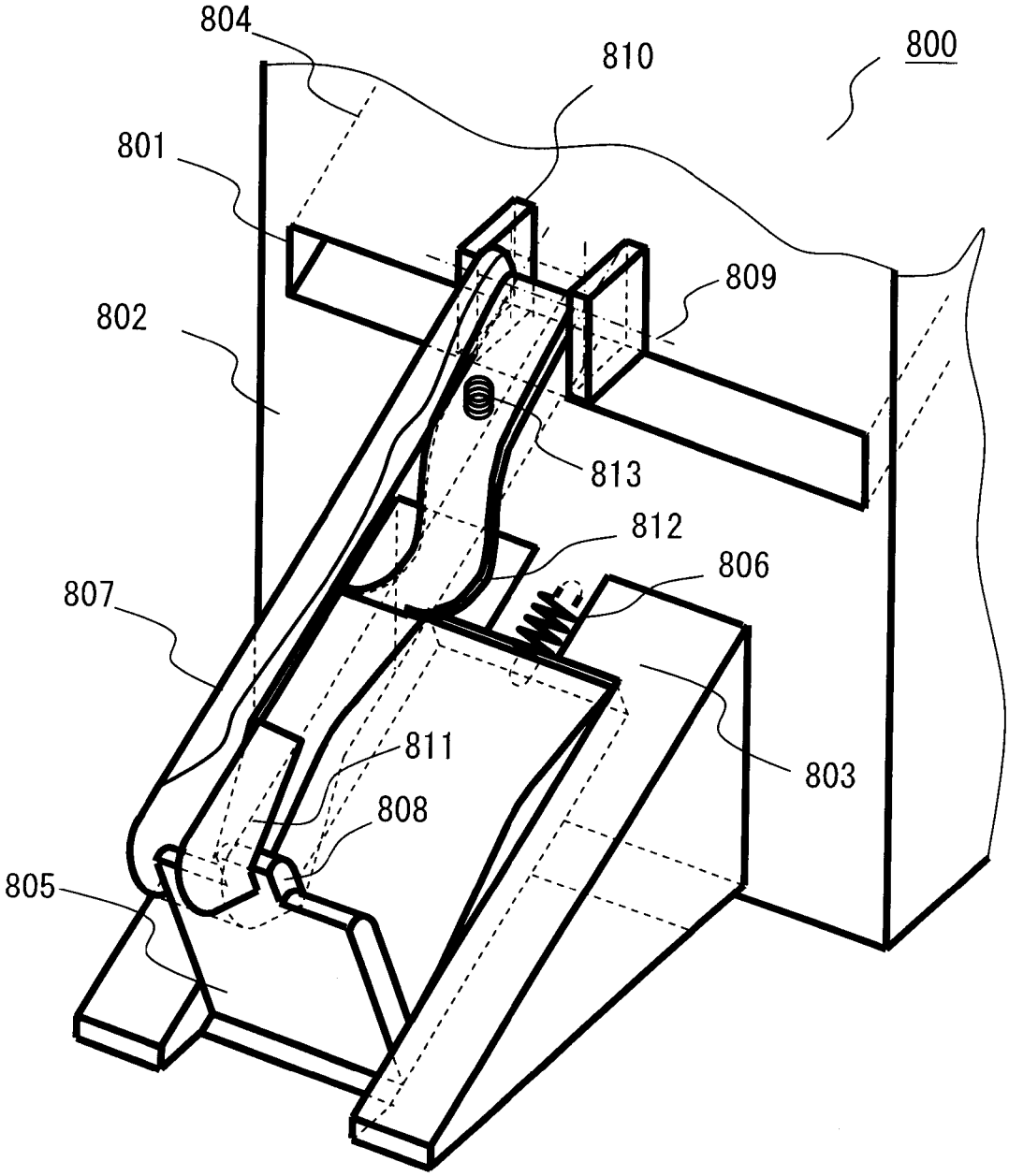
FIG. 48 is a diagram illustrating an exemplary perspective view of a sheet loader according to a sixth exemplary embodiment.

The sheet loader 800 further includes a guard 805 which differs from the guard 605 in Embodiment 4, a stopper arm 807 and a tongue 812 as a cushion member, as FIG. 48 which illustrates a perspective view of the sheet loader 800. The guard 805 may be a folded edge blocker. The stopper arm 807 may be a part of a canceller.

The guard 805 has a prong 808 on its top. The prong 808 is around the center of the width of the guard 805. An upper end of the guard 805 is on both sides of the prong 808. The prong 808 is positioned higher than the upper ends of the guard 805. The prong 808 may also be a part of a canceller.

An end of the stopper arm 807 engages the prong 808, and connects the guard 805 to the wall 802. The other end of the stopper arm 807 rotates around a shaft 809 supported by an arm support 810 above the outlet 801 on the wall 802. The stopper arm 807 is formed as a bath tub shape with its opening having a downward facing concave orientation. The one end of the stopper arm 807 has a rib 811 in the concave portion. The rib 811 is around a center of a width of the stopper arm 807. The rib 811 is formed with a hook shape.

Both sidewalls of the stopper arm 807 have silhouettes like the rib 811 with infilling the crena of the rib 811. The sidewalls prevent the stopper arm 807 from losing engagement with the prong 808 by sliding in the width direction.

A distance between the platform 803 and the sidewalls become progressively narrower with a distance from the other end of the stopper arm 807 at the time the stopper arm 807 engages the prong 808. Therefore, if a stack has a sufficient enough height, a bulge portion of a sheet bundle sliding off the top of the stack pushes up the stopper arm 807 to release the engagement with the prong 808.

If the height of the stack exceeds a threshold limit, the guard 805 starts to slide down the decline of the platform 803. An initial sliding distance just after exceeding the threshold limit may be longer than a sliding distance of the guard 805 per a sheet bundle after then.

Furthermore, the stopper arm 807 has an attack angle for the guard 805 climbing back the decline of the platform 803. Therefore, the one end of the stopper arm 807 can hurdle the prong 808 and re-engage it easily when the guard 805 climbs back the decline of the platform 803.

The tongue 812 has an attack angle for a direction where a sheet bundle discharged from the outlet 801 comes along. The tongue 812 cushions an impact of the sheet bundle on the stopper arm 807.

The tongue 812 rotates around the shaft 809 which the stopper arm 807 rotates around. The tongue 812 rotates across the concave portion of the stopper arm 807. The tongue 812 has an arc downward facing convex shape. The convex portion has an attack angle for the direction where the sheet bundle discharged from the outlet 801 comes along, in the time the convex region sticks out from the bottom of the stopper arm 807. The spring 813 stretches between the ceiling of the stopper arm 807 and a roof of the tongue 812 and pushes the tongue 812 out from the concave portion of the stopper arm 807.

An exemplary operation of the sheet loader 800 is explained with snapshots in FIGS. 49 to 54.

Figure 49:
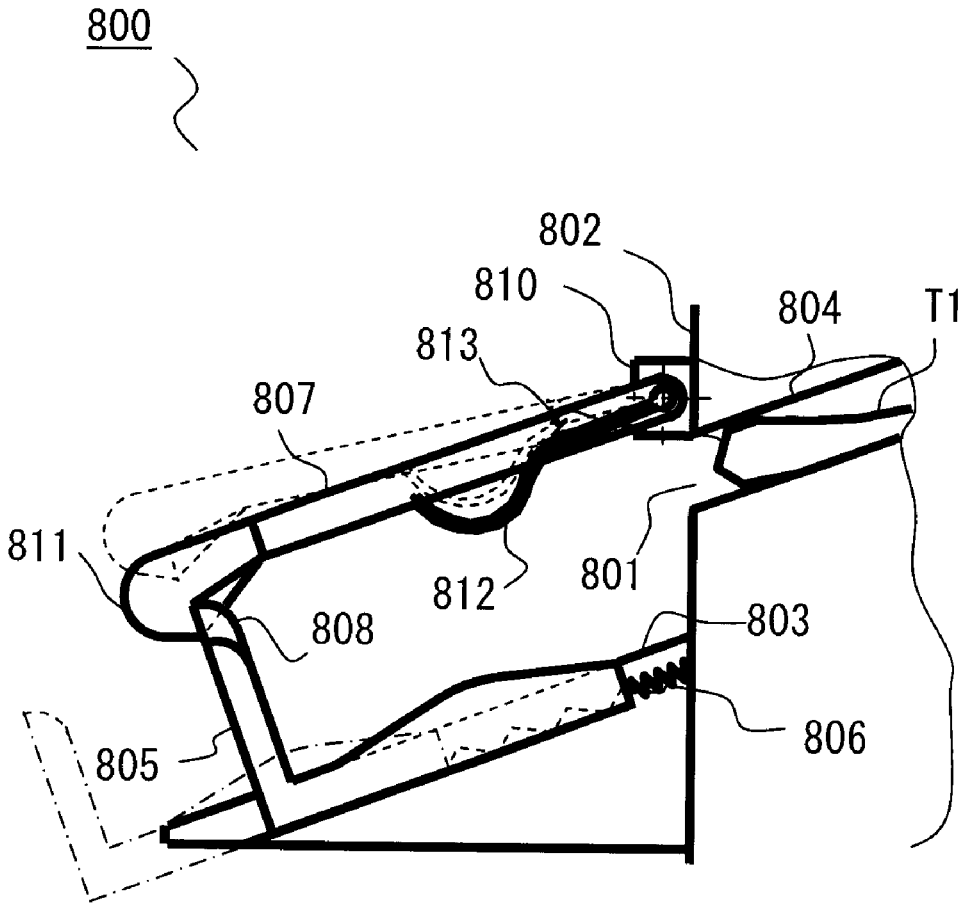
FIG. 49 is a diagram illustrating an exemplary cross-sectional view of a sheet loader according to a sixth exemplary embodiment.

FIG. 49 illustrates a cross-sectional snapshot of the sheet loader 800 before a sheet bundle T1 in the path 804 is discharged to the platform 803. At this time, the stopper arm 807 catches the prong 808, then the guard 805 is kept at the nearest position in a range where the guard 805 can move along the decline of the platform 803.

Figure 50:
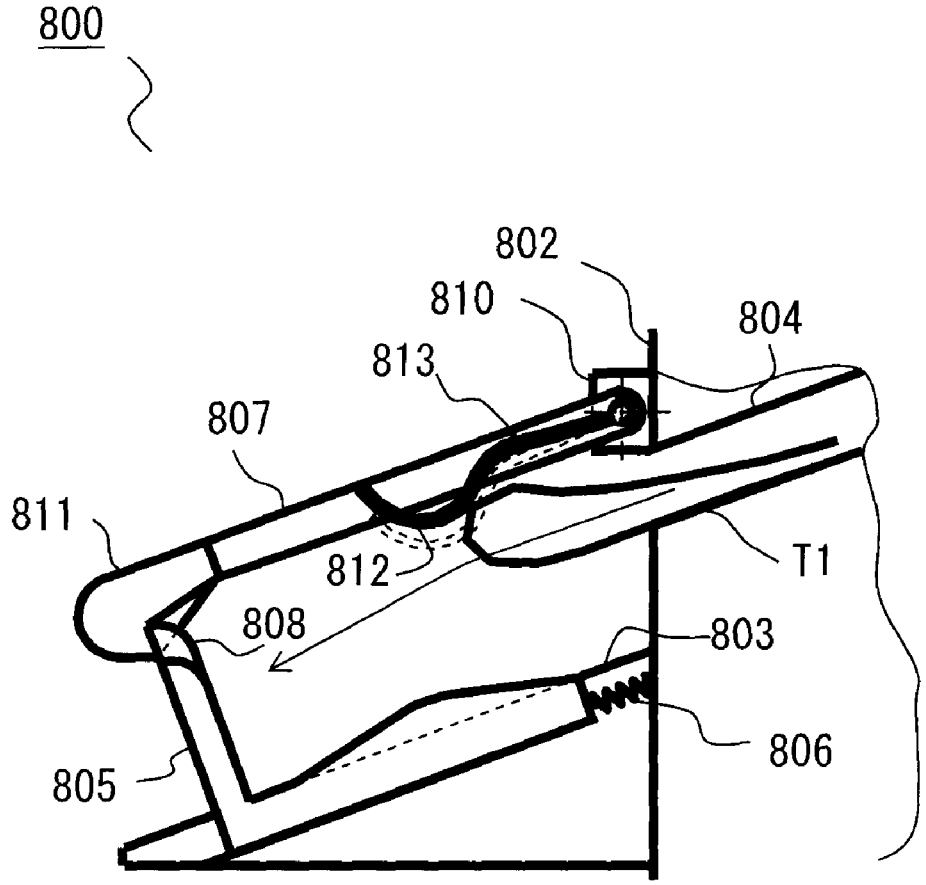
FIG. 50 is a diagram illustrating an exemplary cross sectional view of a sheet loader according to a sixth exemplary embodiment.

FIG. 50 illustrates a cross-sectional snapshot of the sheet loader 800 when the sheet bundle T1 puts out its folded edge from the outlet 801. The sheet bundle T1 hits the convex portion of the tongue 812, and pushes the convex portion of the tongue 812 upwards. As a result, the shock of the sheet bundle T1 for the stopper arm 807 is cushioned by the tongue 812, as well as reducing the momentum of the sheet bundle T1 to land on the platform 803 stable without serious flopping.

Figure 51:
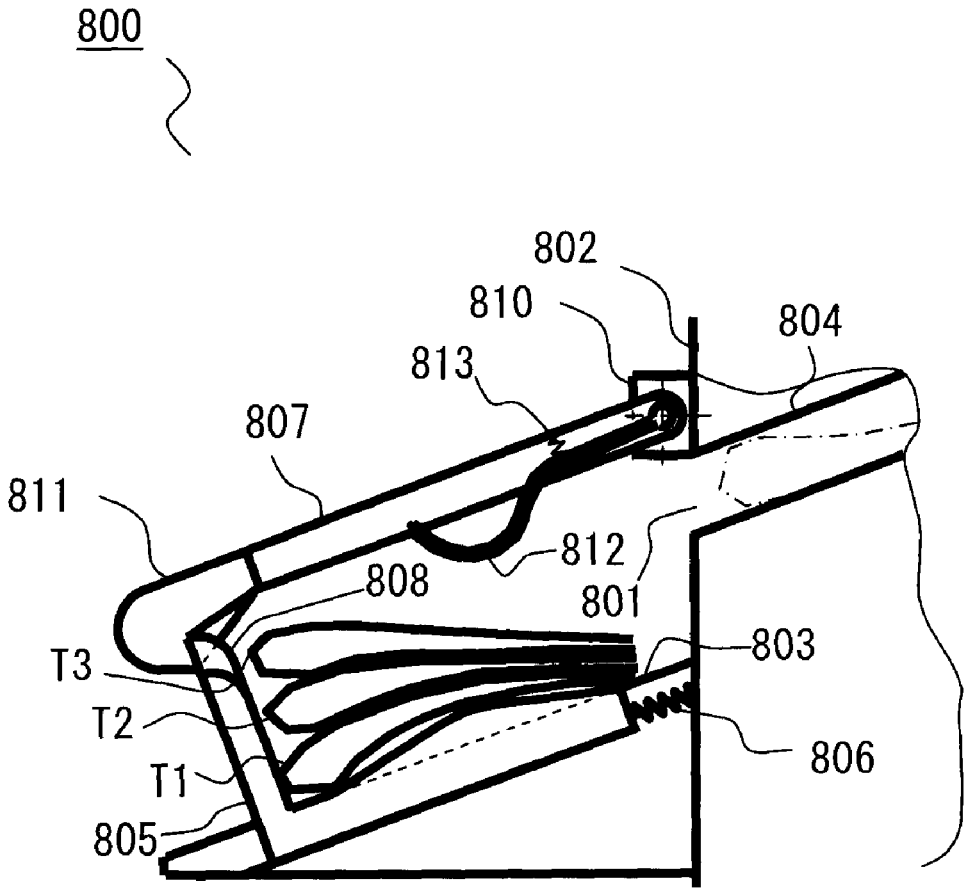
FIG. 51 is a diagram illustrating an exemplary cross-sectional view of a sheet loader according to a sixth exemplary embodiment.

FIG. 51 illustrates a cross-sectional snapshot of the sheet loader 800 after the sheet bundles T1 through T3 are discharged to the platform 803 in numerical order. Since the stopper arm 807 still catches the prong 808, the guard 805 is kept at the same position. As a result, a stack is formed with the sheet bundles T1 through T3, and the following sheet bundles mount on the stack.

Figure 52:
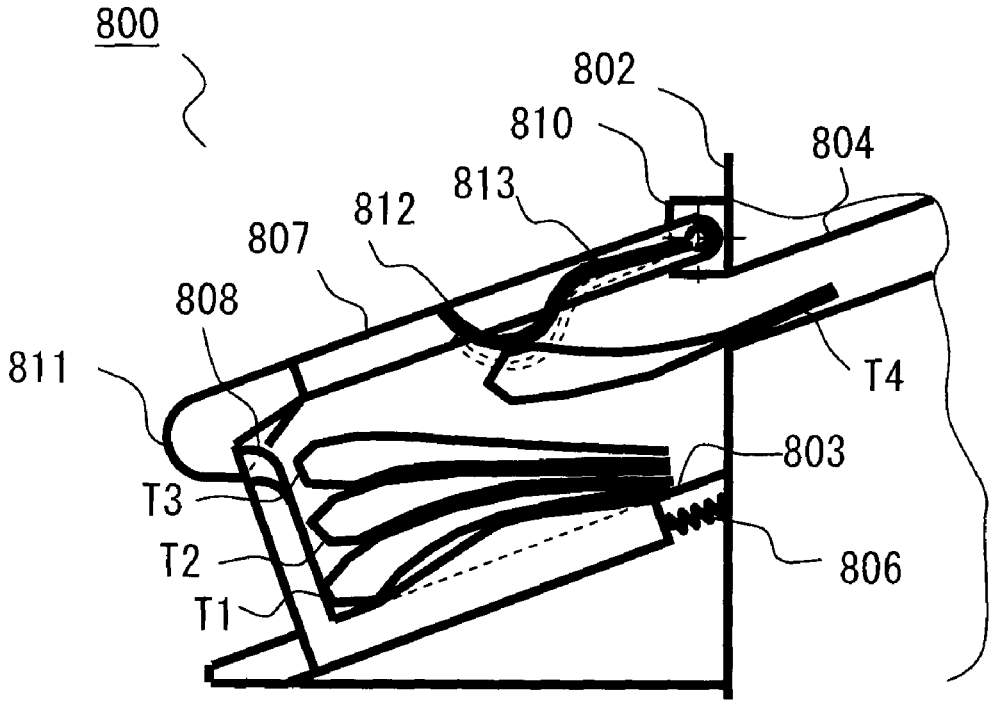
FIG. 52 is a diagram illustrating an exemplary cross-sectional view of a sheet loader according to a sixth exemplary embodiment.

FIG. 52 illustrates a cross-sectional snapshot of the sheet loader 800 when the sheet bundle T4 puts out its folded edge from the outlet 801. As same as the explanation in connection with FIG. 50, the sheet bundle T4 hits on the convex portion of the tongue 812, and pushes the convex portion of the tongue 812 upwards. As a result, the shock of the sheet bundle T4 for the stopper arm 807 is cushioned by the tongue 812, as well as reducing the momentum of the sheet bundle T4 so that its lands on the stack stable without serious flopping.

Figure 53:
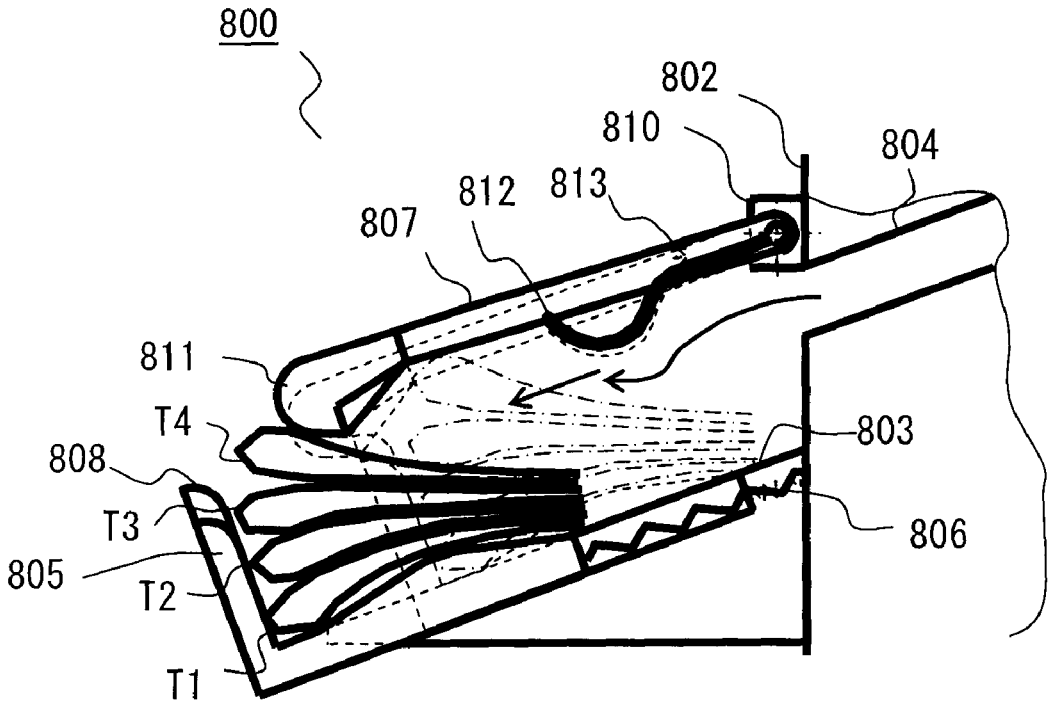
FIG. 53 is a diagram illustrating an exemplary cross-sectional view of a sheet loader according to a sixth exemplary embodiment.

FIG. 53 illustrates a cross-sectional snapshot of the sheet loader 800 after the sheet bundle T4 is discharged on the stack of the sheet bundles T1 through T3. Since the stack is already of sufficient size, the sheet bundle T4 slides off the top of the stack and pushes the stopper arm 807 upwards. As a result, the stopper arm 807 releases the prong 808. Since the guard 805 loses support of the stopper arm 807, the guard 805 slides down the decline of the platform 803 with the stack including the sheet bundles T1 through T4. As the result, the stack is ready for being overlapped by a folded edge side of the following sheet bundle discharged from the outlet 801, on its open end side.

Figure 54:
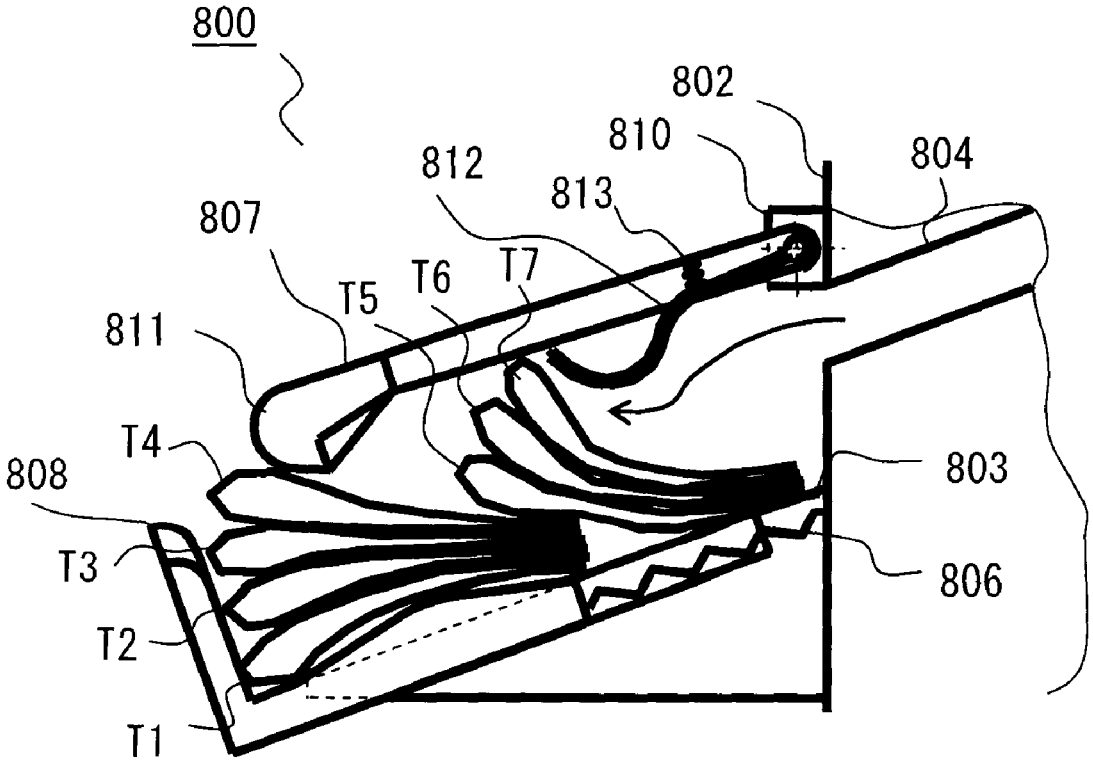
FIG. 54 is a diagram illustrating an exemplary cross-sectional view of a sheet loader according to a sixth exemplary embodiment.

As just described, the stack is ready for being overlapped by a folded edge of the following sheet bundle on its lap portion by shifting the stack toward its folded edge side. FIG. 54 illustrates a cross-sectional snapshot of the sheet loader 800 after sheet bundles T5 through T7 are discharged on the stack of the sheet bundles T1 through T4, and a folded edge side of the stack of the sheet bundles T5 through T7 overlaps on the open end side of the stack of the sheet bundles T1 through T4.

After the stacks are removed from the platform 803, the guard 805 climbs back to the position just as illustrated in FIG. 49 by the force of the spring 806, and the stopper arm 807 restores its posture to engage with the prong 808.

Figure 55:
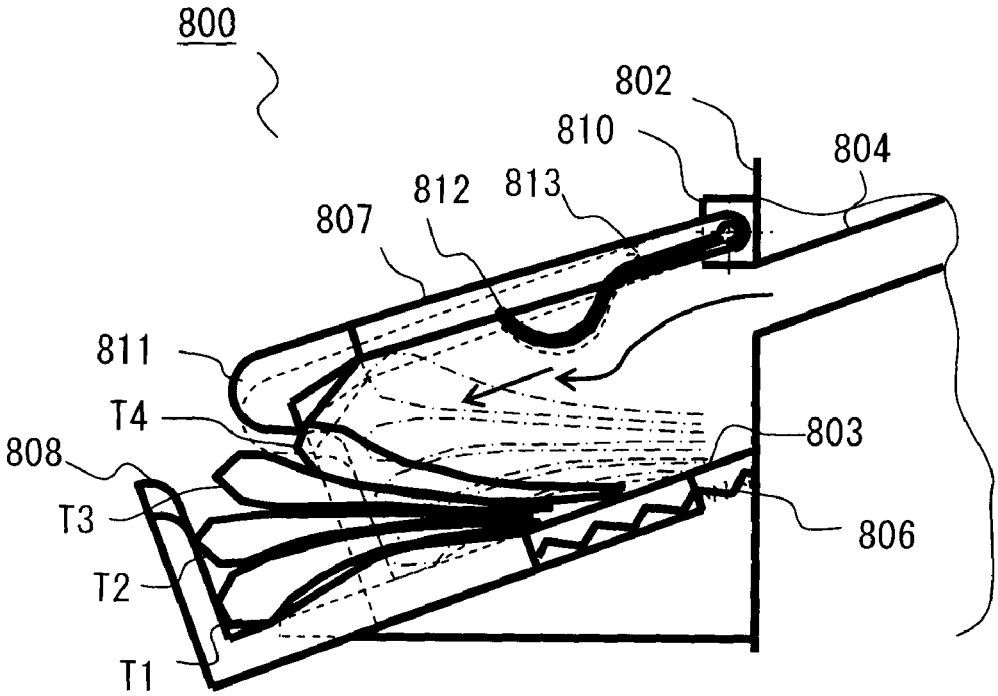
FIG. 55 is a diagram illustrating an exemplary cross-sectional view of a sheet loader according to a sixth exemplary embodiment.
Figure 56:
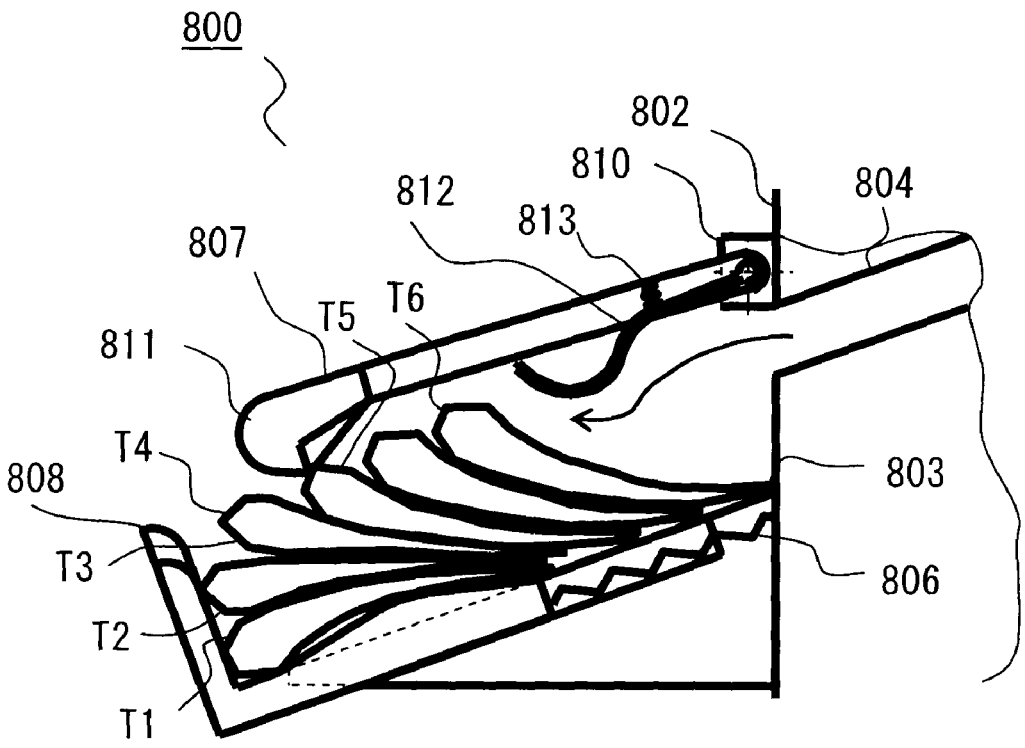
FIG. 56 is a diagram illustrating an exemplary cross-sectional view of a sheet loader according to a sixth exemplary embodiment.

Although FIGS. 53 and 54 illustrate a situation where the stack does not break apart during the shift, the stack may break apart on the shift by the inertia of the stack as illustrated in FIG. 55 if friction between the sheet bundles is not sufficiently strong. As a result, each bulge portion of the sheet bundles is respectively on a lap portion of a sheet bundle below and adjacent the sheet bundle. And then, the following sheet bundles T5 and T6 are put on the platform 803 with their folded edges overlapping on an open end of their respective preceding sheet bundle, as shown in FIG. 56. If the stack on the guard 805 is already broken apart before the stack become unstable like above, it is unnecessary to provide concern for the stability of the stack.

(2-2-6) Embodiment 7

Figure 57:
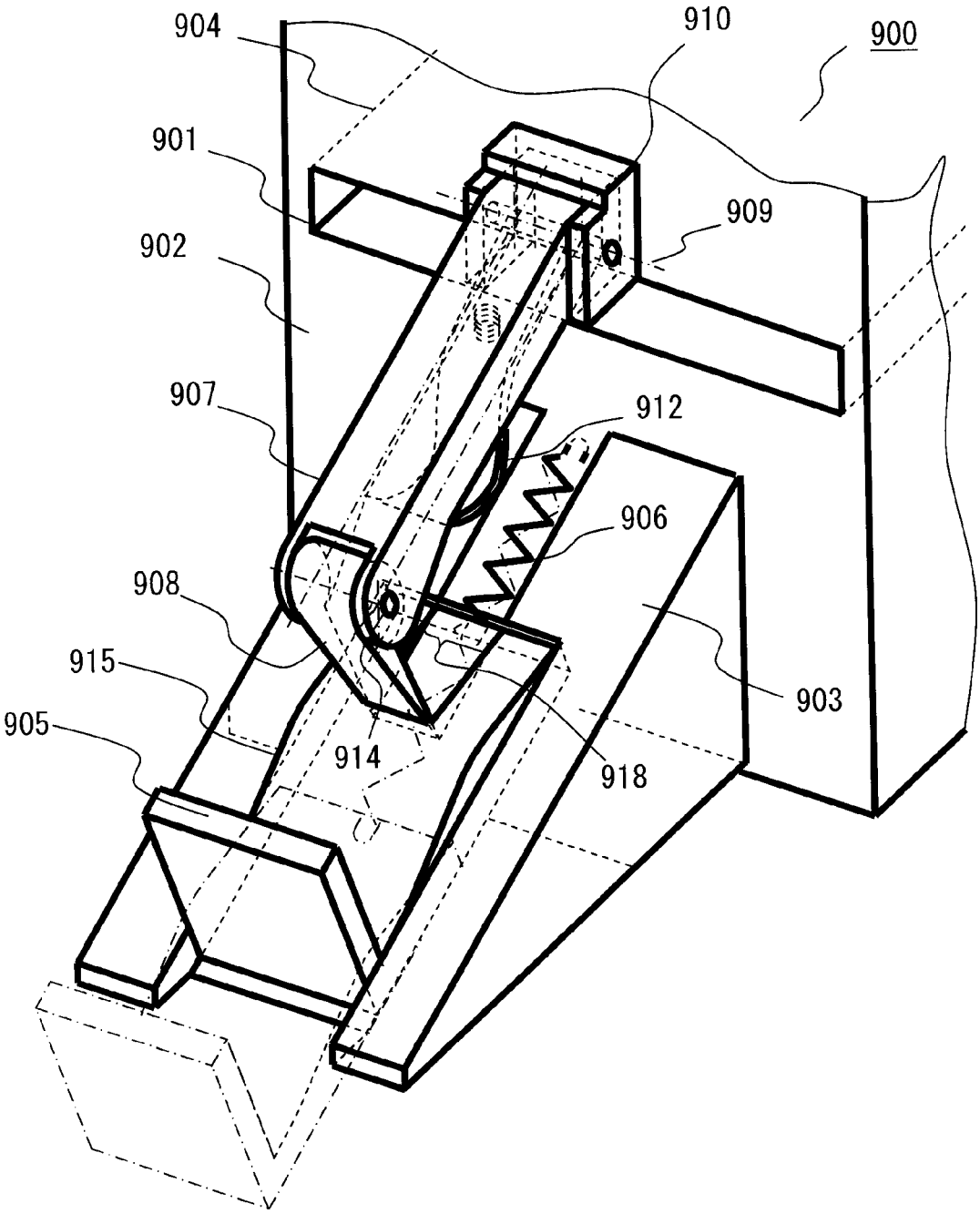
FIG. 57 is a diagram illustrating an exemplary perspective view of a sheet loader according to a seventh exemplary embodiment.

FIG. 57 illustrates a seventh exemplary embodiment of a sheet loader.

The sheet loader 900 includes an outlet 901 as part of a sheet bundle provider, a wall 902, a platform 903 as an under-surface support, a path 904, a spring 906, an arm support 910, a tongue 912 as a cushion member, and a spring 913. These features respectively correspond to the outlet 801, the wall 802, the platform 803, the path 804, the spring 806, the arm support 810, the tongue 812, and the spring 813 of Embodiment 6. The wall 902 and the path 904 may be parts of the sheet bundle provider.

The sheet loader 900 further includes a guard 905 which differs from the guard 805 in Embodiment 6, an upper arm 907 as a canceller and a forearm 908 as a folded edge blocker.

The guard 905 connects to a base plate 915. The base plate 915 corresponds to the base plate 609 of Embodiment 4. The base plate 915 has a hill similar to Embodiment 4, as well.

An end of the upper arm 907 rotates around a shaft 909 supported by an arm support 910 above the outlet 901 on the wall 902. The upper arm 907 is formed as a bath tub shape with a downward facing concave opening. The tongue 912 rotates around the shaft 909 which the upper arm 907 rotates around. The tongue 912 rotates across the concave portion of the upper arm 907.

The upper arm 907 supports a shaft 914 around its other end. The forearm 908 rotates around the shaft 914. When a straight line between the shaft 914 and the shaft 909 is parallel to the decline of the platform 903 and the guard 905 is set at the nearest position in a range where the guard 905 can move along the decline, the shaft 914 is at a higher position on a direction perpendicular to the decline than an upper end of the peak and is at an upper region on a direction along the decline than the peak.

The upper arm 907 has a prong 917 on its outer surface rounded around the shaft 909 to avoid over rotation. The prong 917 contacts the ceiling of the arm support 910 to prevent the upper arm 907 from dropping down the shaft 914 lower than a position of the shaft 914 when the straight line between the shaft 914 and the shaft 909 is parallel to the decline.

The base plate 915 has a slot 918 on its mountain slope. The slot 918 is positioned at about a middle region of a width of the base plate 915 along the ridge line of the peak.

Figure 58:
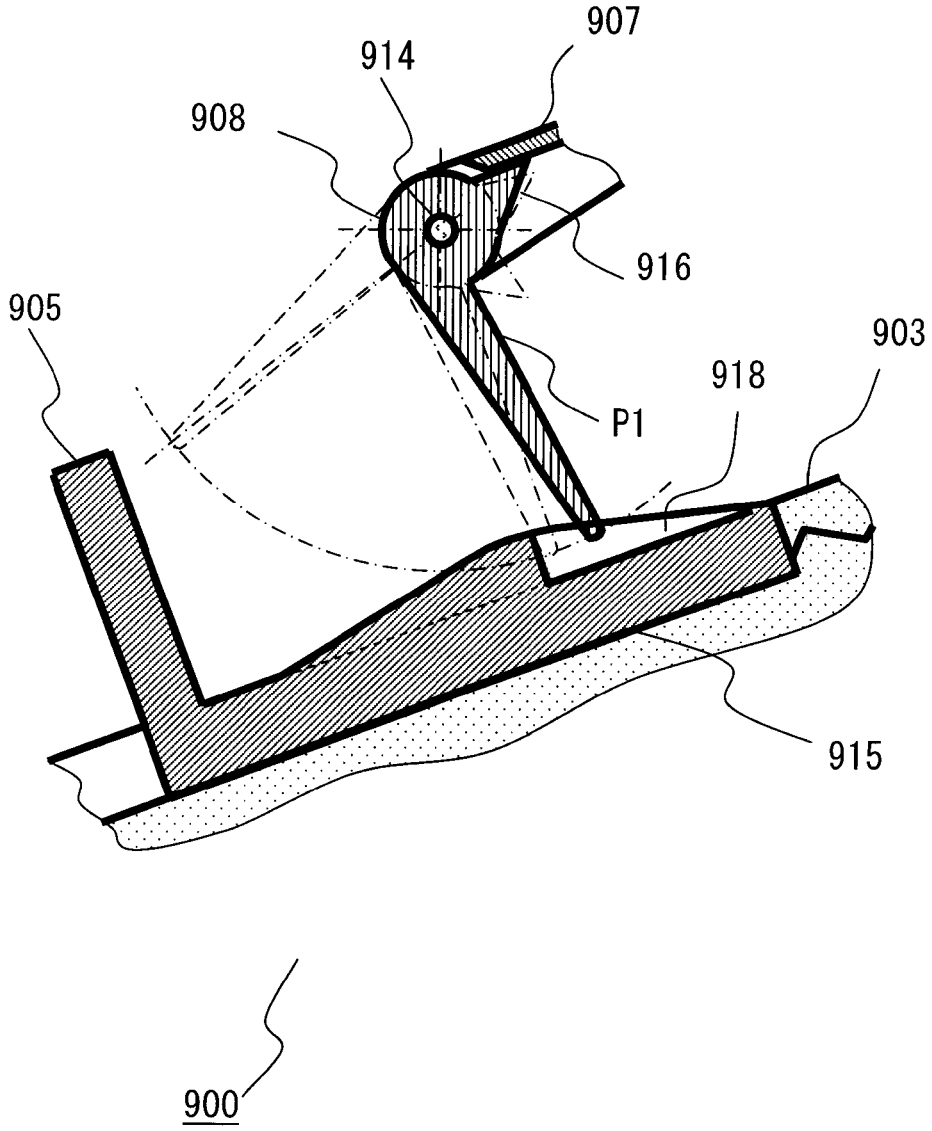
FIG. 58 is a diagram illustrating an exemplary cross-sectional view around a forearm and a base plate of a sheet loader according to a seventh exemplary embodiment.

FIG. 58 illustrates a cross-sectional view of the sheet loader 900 around the other end of the upper arm 907, the forearm 908, and the guard 905 with the base plate 915. The bottom of the slot 918 is a plane almost parallel to a direction where the guard 905 shifts along. One end of the slot 918 by the side of the peak connects to a cliff rising steeply against the direction where the guard 905 shifts along.

The forearm 908 hangs down from the shaft 914. The lower end of the forearm 908 fits into the slot 918. The forearm 908 has an obverse face which faces the guard 905, and a reverse face which faces the outlet 801. The forearm 908 is biased around the shaft 914 so that the lower end climbs up a valley wall to get close to the wall 902. On the other hand, the prong 916 contacts a ceiling of the upper arm 907 to prevent the forearm 908 from rolling its lower end up over the surface of the mountain slope by the bias so as not to make a gap to let a sheet bundle through and between the lower end and the mountain slope.

When the platform 903 does not load a sheet bundle, the forearm 908 is positioned in a gap between the obverse face and the base plate 905 shown as a posture P1 illustrated with solid line in FIG. 58 to prevent itself from abrasion against the base plate 905. Sheet bundles loaded on the mountain slope push the reverse face and the obverse face contacts the cliff on the one end of the slot 918.

The forearm 908 may be designed to contact the cliff without pushing by the sheet bundle to avoid a knock sound generated between the forearm 908 and the cliff. Furthermore, the cliff may have a cushion to mitigate the knock sound.

The reverse face of the forearm 908 may be vertical or inclined toward the guard 905 when the obverse face contacts the cliff of the guard 905 at the nearest position in the range of motion. Furthermore, the reverse face may be vertical at the time the forearm 908 is released from the cliff of the guard 905 sliding down the decline by the push of sheet bundles on the mountain slope. Of course, the forearm 908 is not limited to the above configuration.

If a drop distance between an open end and a folded edge of a sheet bundle held by the reverse face is too steep for a length of the sheet bundle, an open end of the sheet bundles opens enough to take the following sheet bundle into its pages. However, the mountain slop makes the drop distance sufficiently small enough to prevent the open end from opening.

An exemplary operation of the sheet loader 900 is explained with snapshots in FIGS. 59 to 65.

Figure 59:
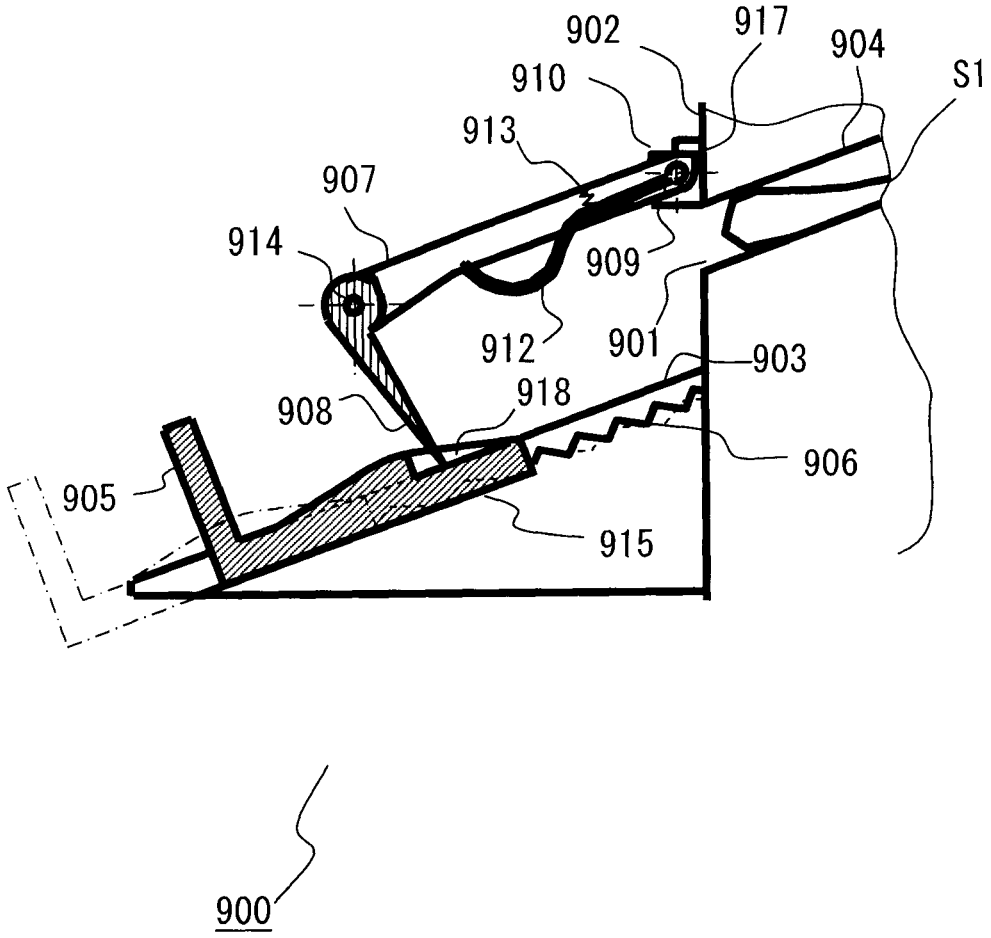
FIG. 59 is a diagram illustrating an exemplary cross-sectional view of a sheet loader according to a seventh exemplary embodiment.

FIG. 59 illustrates a cross-sectional snapshot of the sheet loader 900 before a sheet bundle T1 in the path 904 is discharged to the platform 903. At this time, the straight line between shafts 909 and 914 is almost parallel to the decline of the platform 903, and the lower end of the forearm 908 is in the slot 918 of the hill on the base plate 915. Furthermore, the guard 905 is kept at the nearest position in the range where the guard 905 can move along the decline by the bias of the spring 906.

Figure 60:
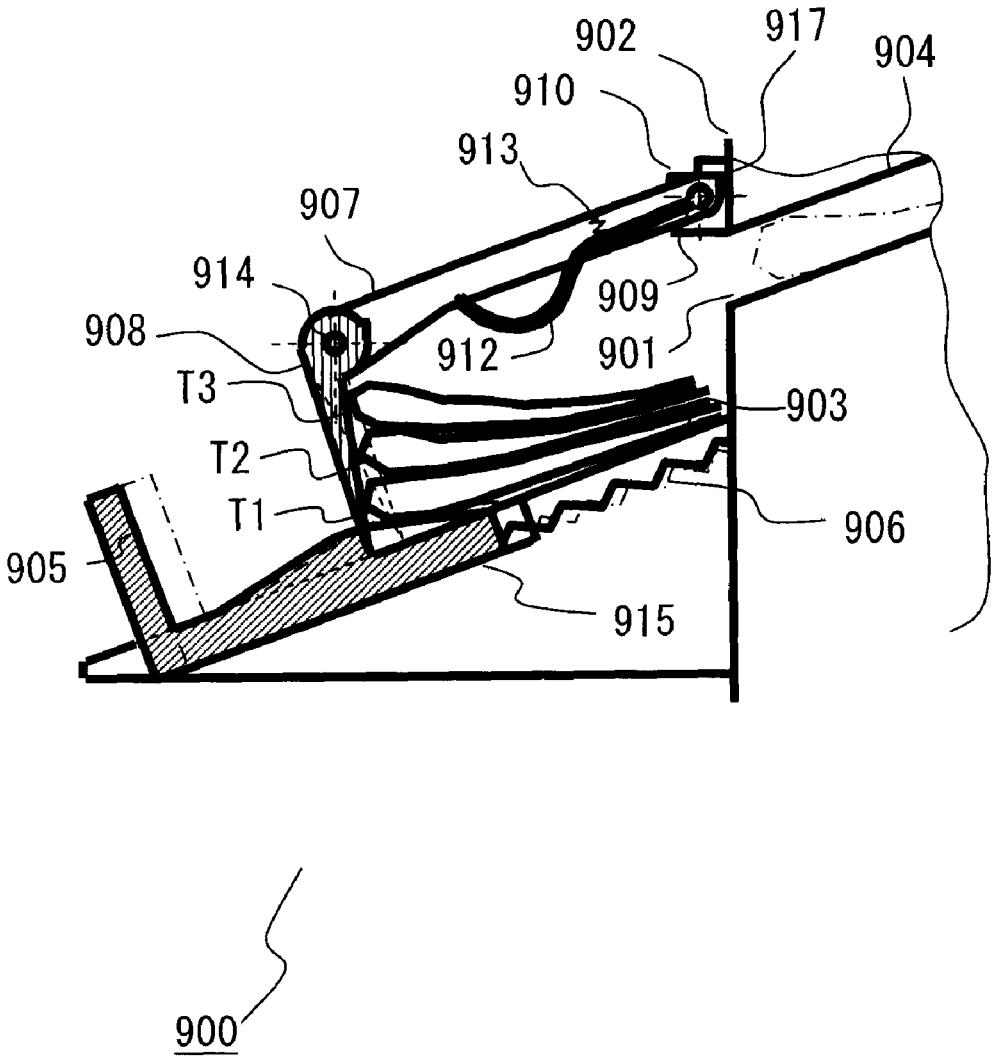
FIG. 60 is a diagram illustrating an exemplary cross-sectional view of a sheet loader according to a seventh exemplary embodiment.

FIG. 60 illustrates a cross-sectional snapshot of the sheet loader 900 after the sheet bundle T1 and the following sheet bundles T2 and T3 are discharged to the platform 903 in numerical order. The sheet bundles T1 through T3 push the reverse face of the forearm 908, and the obverse face of the forearm 908 contacts the cliff of the hill. The sheet bundles T1 through T3 are stopped by the reverse face of the forearm 908 to form a stack.

Since a first position on the reverse face where a folded edge of the sheet bundle T1 contacts at is far from the shaft 914, the guard 905 slides down the decline a relatively long distance. However, a moment caused by the sheet bundle T2 is smaller than the one the sheet bundle T1 causes because a second position on the reverse face where a folded edge of the sheet bundle T2 contacts is closer to the shaft 914 than the first position. As a result, the guard 905 slides down the decline a relatively short distance. Moreover, a moment caused by the sheet bundle T3 is smaller than the one the sheet bundle T2 causes because a third position on the reverse face of the forearm 908 where a folded edge of the sheet bundle T3 contacts is closer to the shaft 914 than the second position. As a result, the guard 905 slides down the decline an even shorter distance. That is, the sliding distance downward of the guard 905 per one sheet bundle becomes increasingly smaller according to a number of sheet bundles on the base plate 915.

Although a stack becomes more unstable according to its height (typically the higher the stack, the more unstable the stack), making the sliding down distance of the guard 905 per one sheet bundle increasingly smaller according to the number of sheet bundles in a stack on the base plate 915 is effective for avoiding the stack breaking apart.

Although the forearm 908 rotates around the shaft 914 because of the weight of the sheet bundles T1 through T3, the guard 905 does not slide down the decline sufficiently enough to release the forearm 908 from the cliff, yet at the time illustrated in FIG. 60. Therefore, the following sheet bundles mount on the stack.

Figure 61:
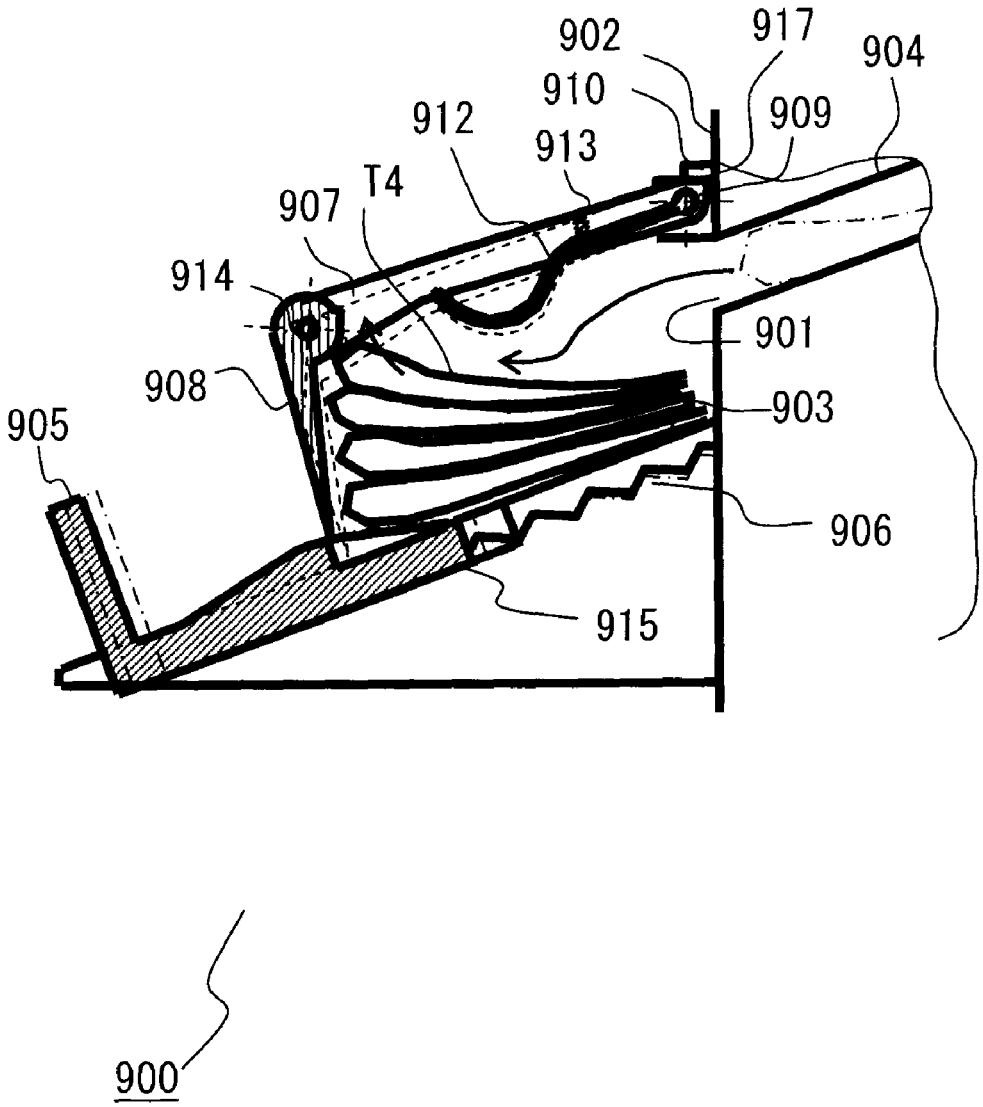
FIG. 61 is a diagram illustrating an exemplary cross-sectional view of a sheet loader according to a seventh exemplary embodiment.

FIG. 61 illustrates a cross-sectional snapshot of the sheet loader 800 after a sheet bundle T4 is discharged on the stack of the sheet bundles T1 through T3. Since the stack is already of sufficient enough size, the sheet bundle T4 slides off the top of the stack and pushes the upper arm 907 upwards. As a result, the lower end of the forearm 908 is released from the cliff by the pull of the upper arm 907.

Even if the stack does not have a sufficiently high enough height to push the upper arm 907 upwards, the guard 905 slides enough distance down to release the forearm 908 from the cliff when the weight of the stack is sufficient to cause release of the forearm 908.

Figure 62:
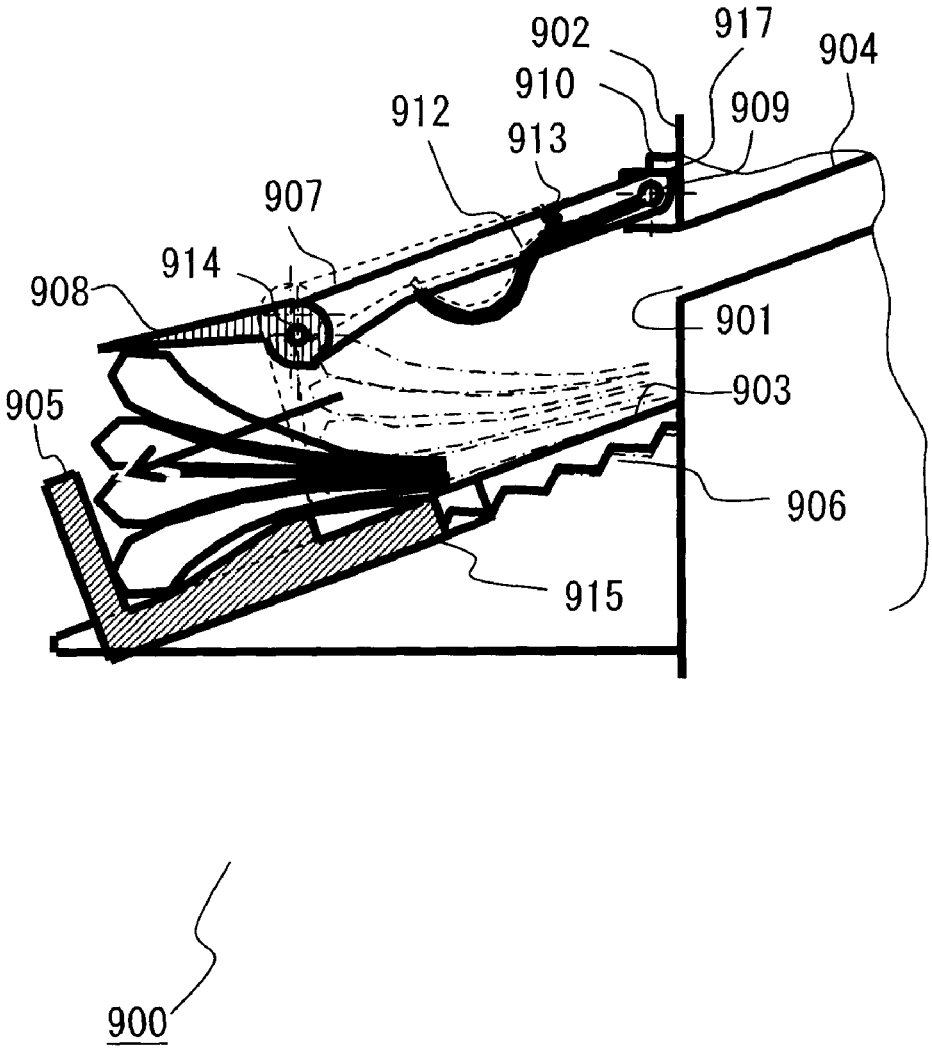
FIG. 62 is a diagram illustrating an exemplary cross-sectional view of a sheet loader according to a seventh exemplary embodiment.
Figure 63:
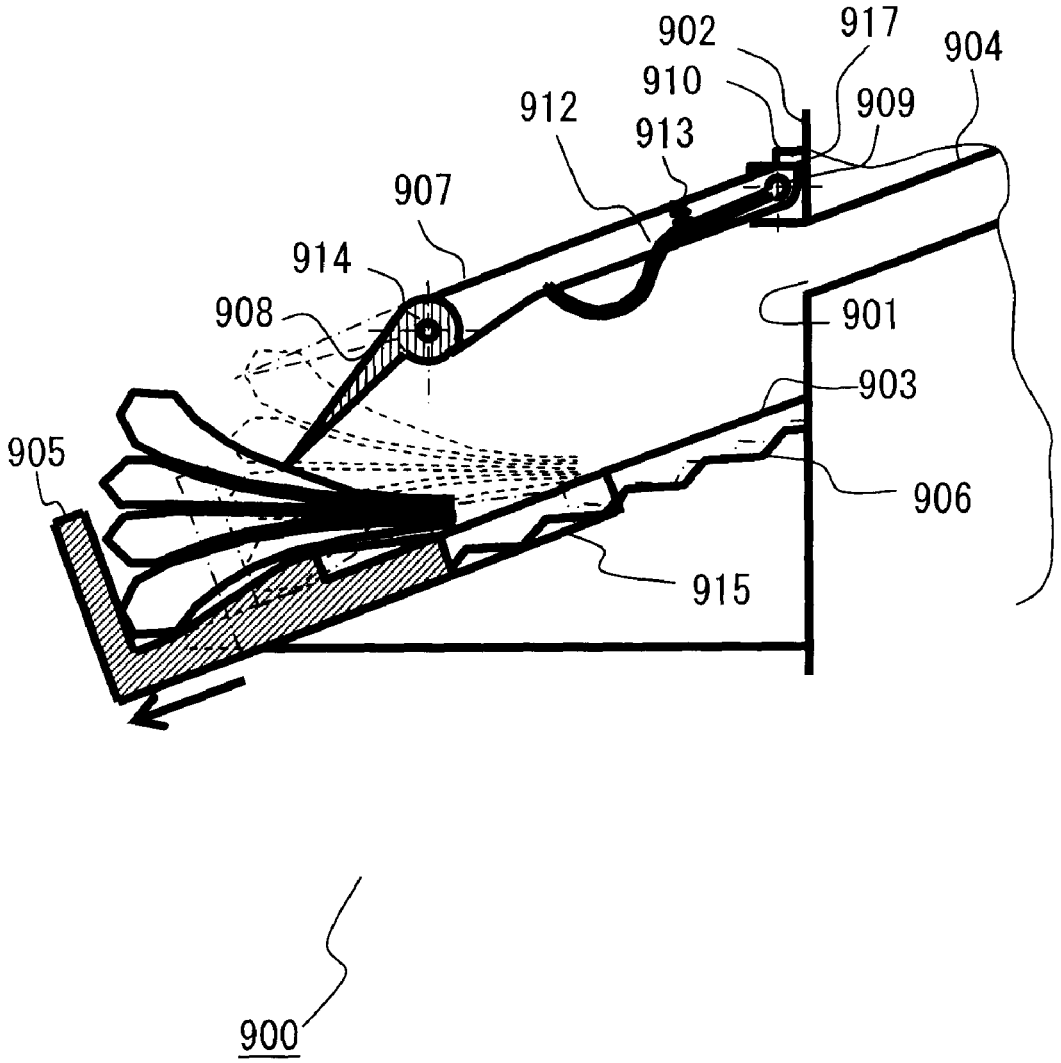
FIG. 63 is a diagram illustrating an exemplary cross-sectional view of a sheet loader according to a seventh exemplary embodiment.

FIG. 62 illustrates a cross-sectional snapshot of the sheet loader 800 after the forearm 908 is released from the slot 918, and FIG. 63 illustrates a cross-sectional snapshot of the sheet loader 800 later than the time illustrated in FIG. 62. The stack of sheet bundles T1 through T4 which is previously supported by the forearm 908 slides down and contacts the guard 905. The guard 905 receives the whole weight of the stack and slides down further.

Figure 64:
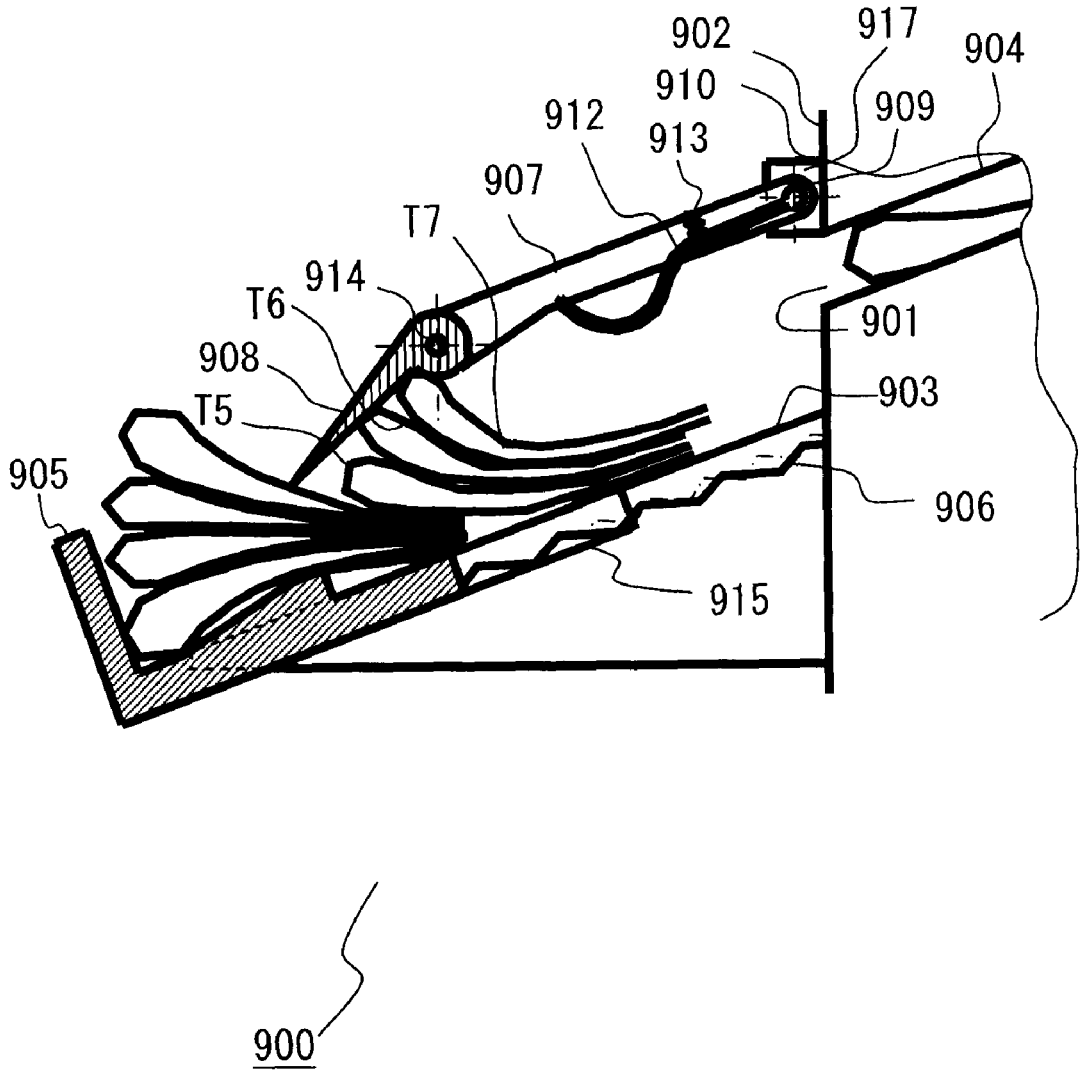
FIG. 64 is a diagram illustrating an exemplary cross-sectional view of a sheet loader according to a seventh exemplary embodiment.

As just described, the stack is ready for being overlapped by a folded edge of the following sheet bundle on its lap portion by shifting the stack toward its folded edge side. FIG. 64 illustrates a cross-sectional snapshot of the sheet loader 900 after sheet bundles T5 through T7 are discharged on the stack of sheet bundles T1 through T4, and a folded edge side of a stack of the sheet bundles T5 and T7 overlaps on the open end side of the stack of the sheet bundles T1 through T4.

Figure 65:
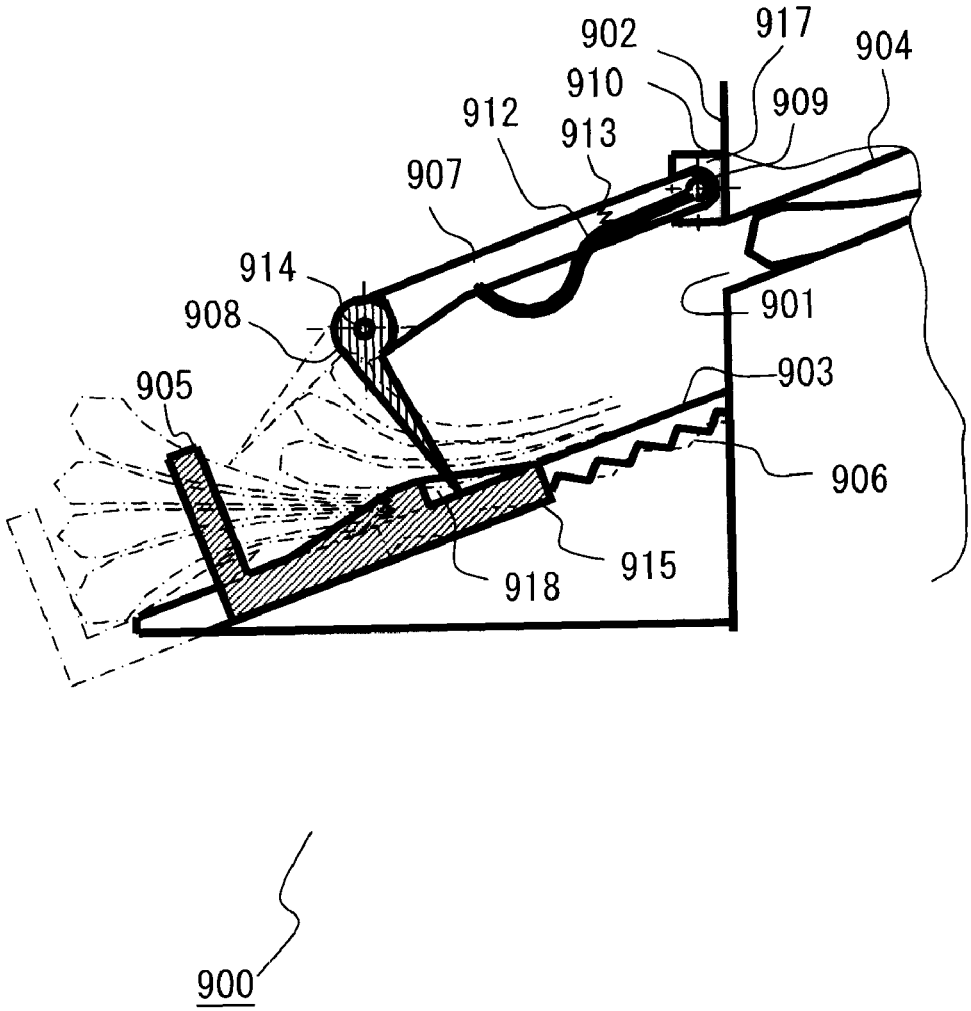
FIG. 65 is a diagram illustrating an exemplary cross-sectional view of a sheet loader according to a seventh exemplary embodiment.

After the stacks are removed from the platform 903, the guard 905 climbs back to the position just as illustrated in FIG. 59 by the force of the spring 906, and the forearm 908 is rolled upwards by the biasing force around the shaft 914 to engage the lower end with the cliff as shown in FIG. 65.

Figure 66:
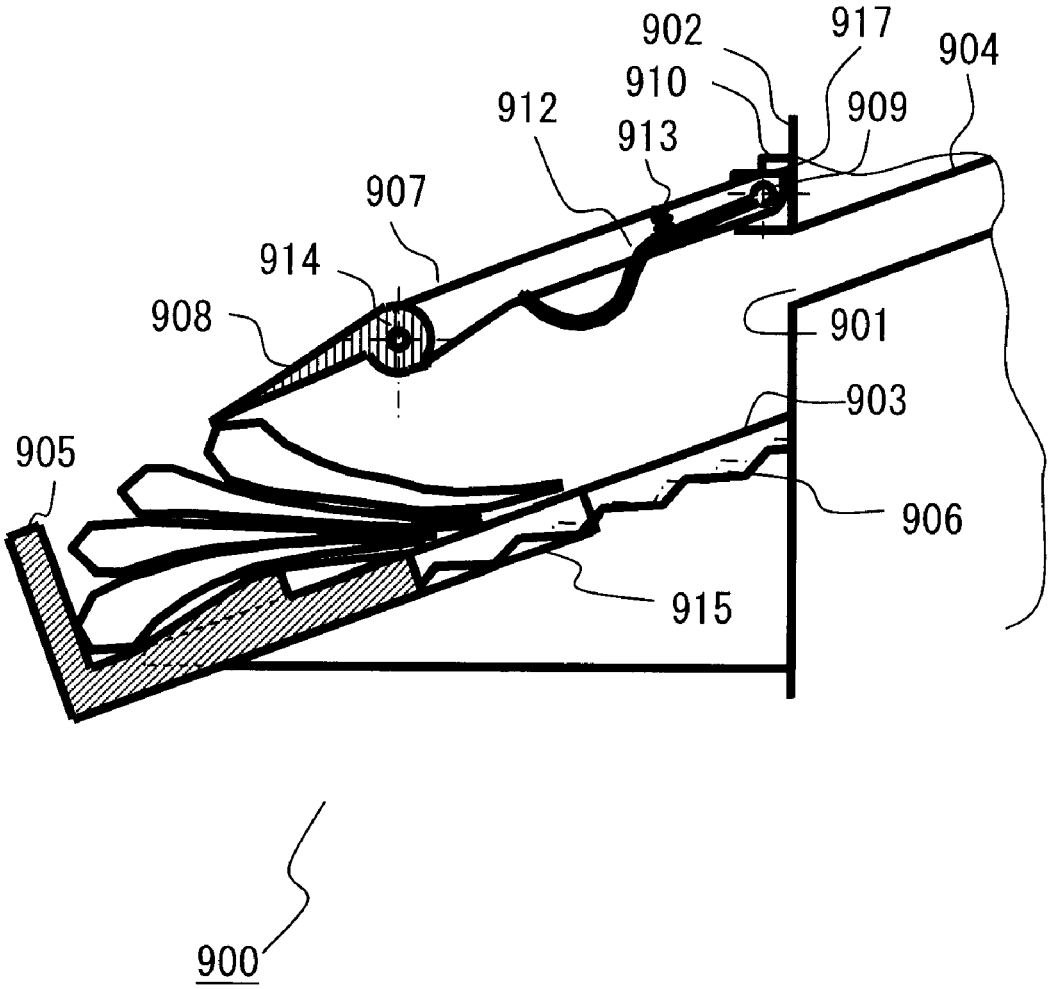
FIG. 66 is a diagram illustrating an exemplary cross-sectional view of a sheet loader according to a seventh exemplary embodiment.
Figure 67:
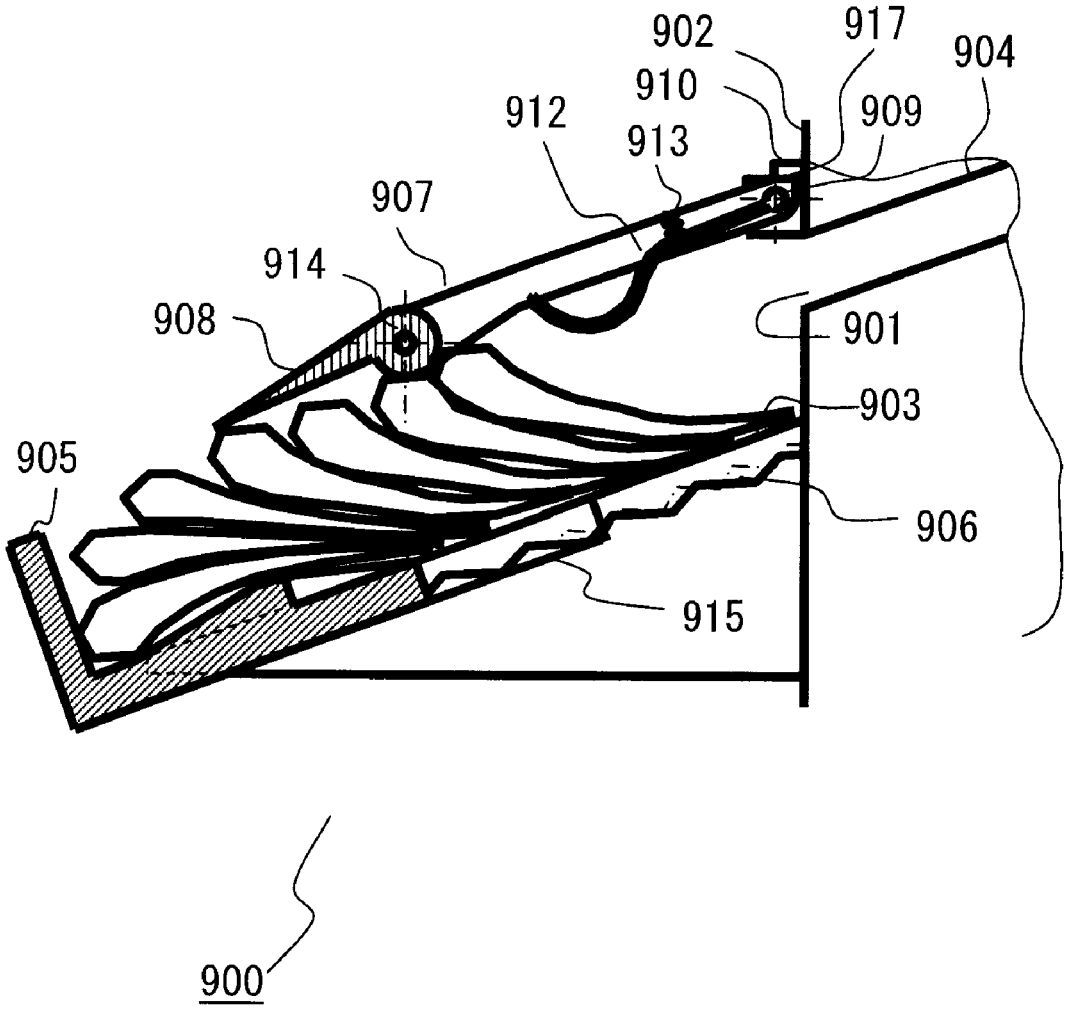
FIG. 67 is a diagram illustrating an exemplary cross-sectional view of a sheet loader according to a seventh exemplary embodiment.

Although FIGS. 62 through 64 illustrate a situation where the stack does not break apart during the movement of the platform 903, the stack may break apart during movement of the platform 903 by the inertia of the stack as illustrated in FIG. 66 if friction between the sheet bundles is not sufficiently strong. As a result, each bulge portion of the sheet bundles is respectively on a lap portion of a sheet bundle below the sheet bundle. And then, the following sheet bundles T5 through T7 are put on the platform 903 with their folded edges overlapping on an open end of their respective preceding sheet bundle, as shown in FIG. 67. Such situation is easier to conduct in this embodiment than in other embodiments because the lower end of the forearm 908 lugs against the momentum of the top of the stack. If the stack on the guard 805 is already broken apart before the stack becomes unstable like above, it is unnecessary to provide concern for stability of the stack.

Moreover, although the forearm 908 is biased around the shaft 914 so that the lower end climbs up the valley wall of the hill to get close to the wall 902, the lower end can not climb up the valley wall sufficiently enough to cross over the peak to refit into the slot 918 if the biasing force is too weak.

Figure 68:
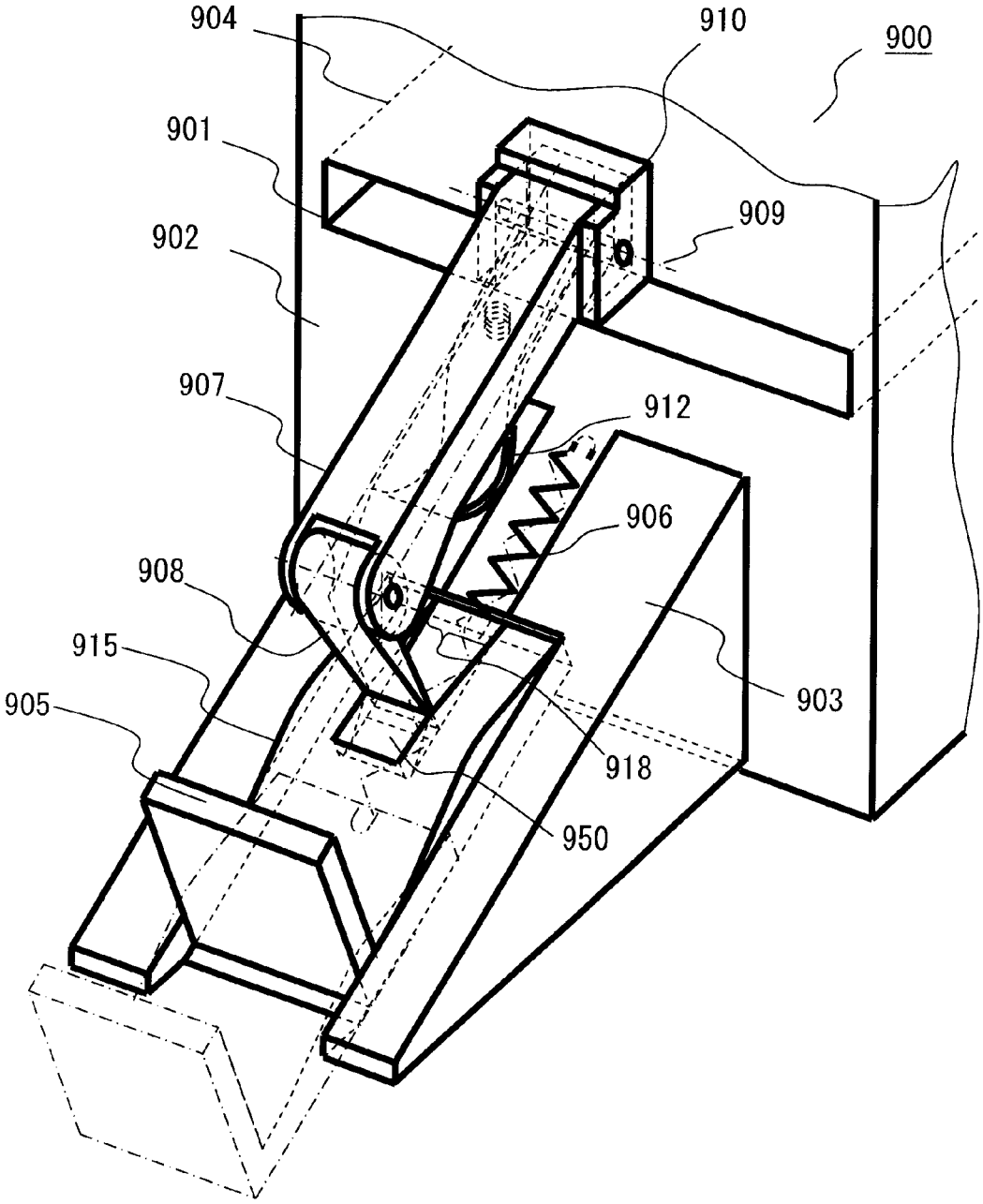
FIG. 68 is a diagram illustrating an exemplary perspective view of a sheet loader according to a modification of a seventh exemplary embodiment.

To avoid such a situation, the cliff may be constructed as an end of a roof of a flap 950 as illustrated in FIG. 68. The flap 950 covers a hole connecting and through to the one end of the slot 918 on the valley wall, and can be pushed down under the valley wall. The flap 950 may be a joint.

Figure 69:
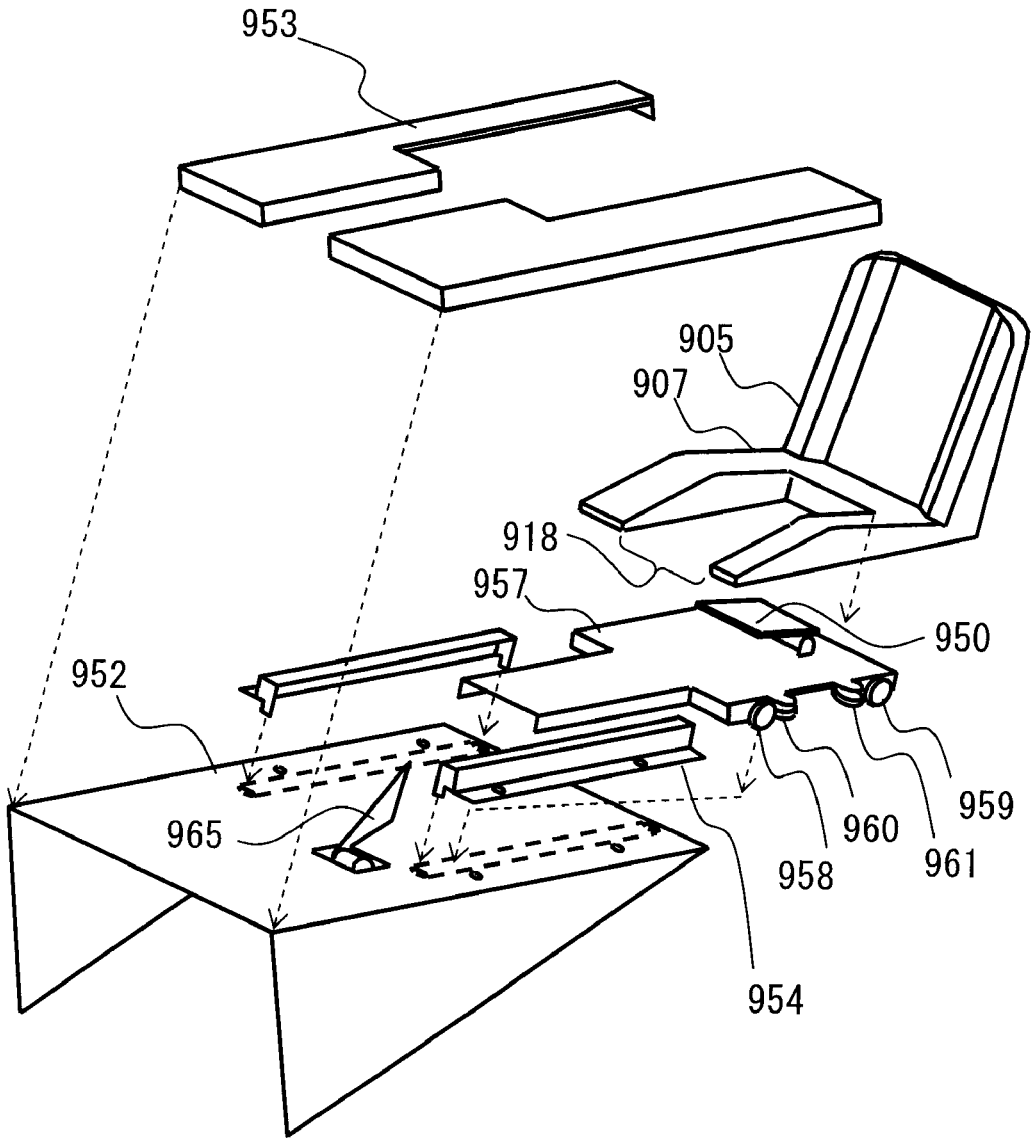
FIG. 69 is a diagram illustrating an exemplary perspective view around a guard and a base plate of a sheet loader according to a modification of a seventh exemplary embodiment.

FIG. 69 is an exploded perspective view around the platform 903 of the sheet loader 900 with the flap 950. The guard 905 connects the base plate 907 in the same width. The guard 905 and the base plate 907 ride on a chassis 957. The chassis 957 slides on an upper surface of a slope 952 which is parallel to the decline of the platform 903. Rollers 958 and 959 support the chassis 957 on the slope 952, and roll on the region surrounded with broken lines on the slope 412.

A roller cover 954 covers a space above the region with its ceiling. The rollers 958 and 959 fit in the space between the slope 952 and the ceiling of the roller cover 954. The roller cover 954 has walls on the top end and bottom end in the direction along the slope 952 of the region to limit travel of the rollers 958 and 959.

Furthermore, the chassis 957 has other rollers 960 and 961. Rollers 960 and 961 are supported by the chassis 957 rotatably around axis perpendicular to the slope 952. The roller cover 954 additionally has a guide wall which perpendicularly stands on the slope 952 along the decline of the slope 952. The rollers 960 and 961 roll on the guide wall. The guide wall supports the rollers 960 and 961 to prevent the chassis 957 from running off track.

A bedcover 953 covers the slope 952 except for regions covered with the guard 905 and the base plate 907. On a direction perpendicular to the decline of the slope 952, the height of a roof of the bedcover 953 from the slope 952 is lower than the height of the peak from the slope 952. The bedcover 953 is fixed to the slope 952.

The chassis 957 supports the flap 950 rotatably on a fulcrum set under the roof of the flap 950.

The base plate 907 does not cover regions overlapping the roof of the flap 950 and a sheet sensor 965 as a probe.

A sheet sensor 965 has a fulcrum on the slope 952. The tip of the sheet sensor 965 projects above the upper surface of the base plate 905 when no sheet is on the platform 903. The tip of the sheet sensor 965 is depressed into the base plate 905 by rotating around the fulcrum due to the presence of the sheet on the platform 903.

Figure 70:
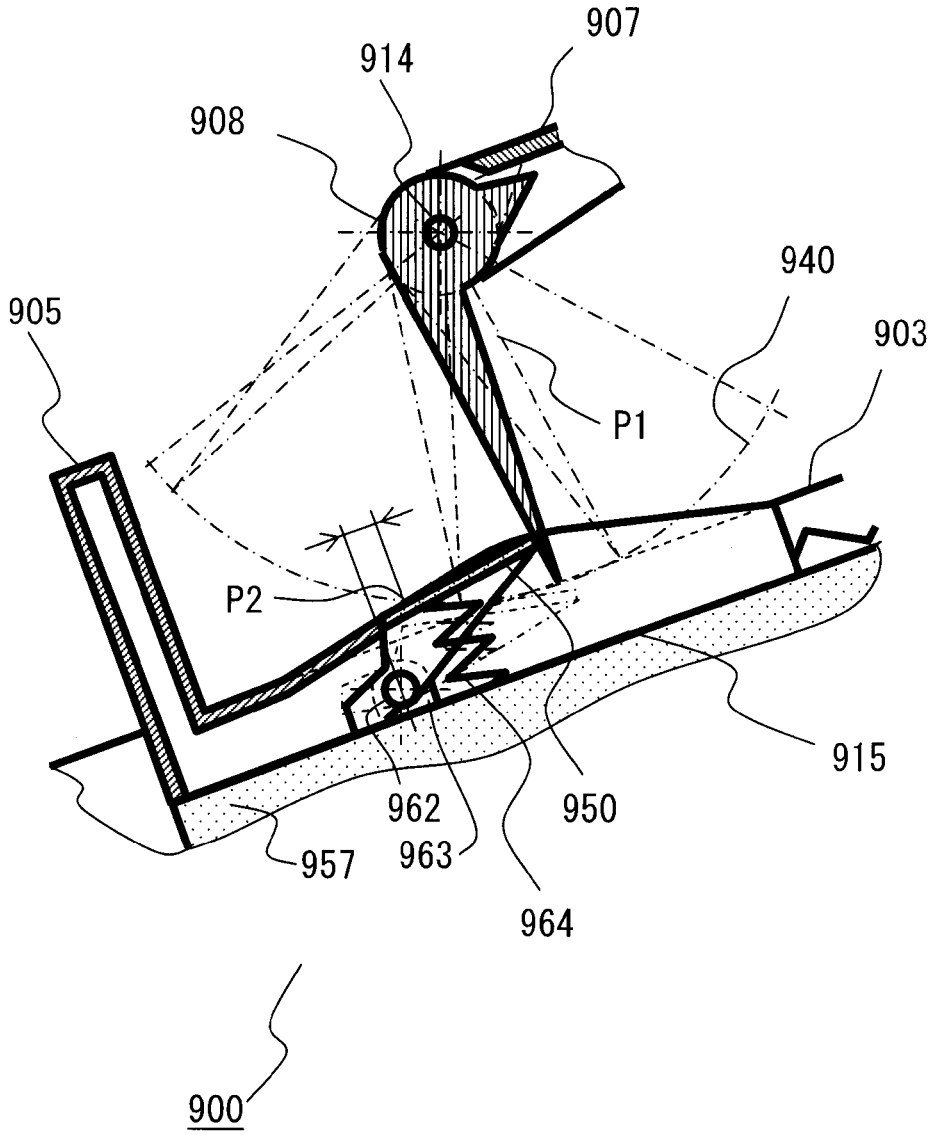
FIG. 70 is a diagram illustrating an exemplary cross-sectional view around a flap of a sheet loader according to a modification of a seventh exemplary embodiment.

FIG. 70 illustrates a cross-sectional view of the sheet loader 900 with the flap 950 around the other end of the upper arm 907, the forearm 908, and the guard 905 with the base plate 915. The chassis 957 is exposed through the bottom of the slot 918. One end of the roof of the flap 950 forms the cliff at the first end of the slot 918 near the side of the peak.

The flap 950 rotates around the fulcrum 962 supported by a stay 963 fixed on the chassis 957. The fulcrum 962 is set under the other end of roof of the flap 950.

A circular arc 940 illustrated with a dashed line presents an orbit of the lower end of the forearm 908 when the guard 905 is set at the nearest position in the range of motion and a straight line between the shaft 914 and the shaft 909 is parallel to the decline of the platform 903. The fulcrum 962 is set more closely to the guard 905 than a position P2 where the circular arc 940 crosses with the surface of the valley wall of the base plate 915 in a direction along which the chassis 957 slides. The fulcrum 962 is set more closely to the slope 952 than the position P2 in a direction perpendicular to the slope 952, as well.

The roof of the flap 950 is kept in plane with, or under, the valley wall by a spring 964 stretching between the chassis 957 and the ceiling of the flap 950. On the other hand, the flap 950 has a stopper around the fulcrum 962 to prevent the roof of the flap 950 from projecting over the valley wall.

Figure 71:
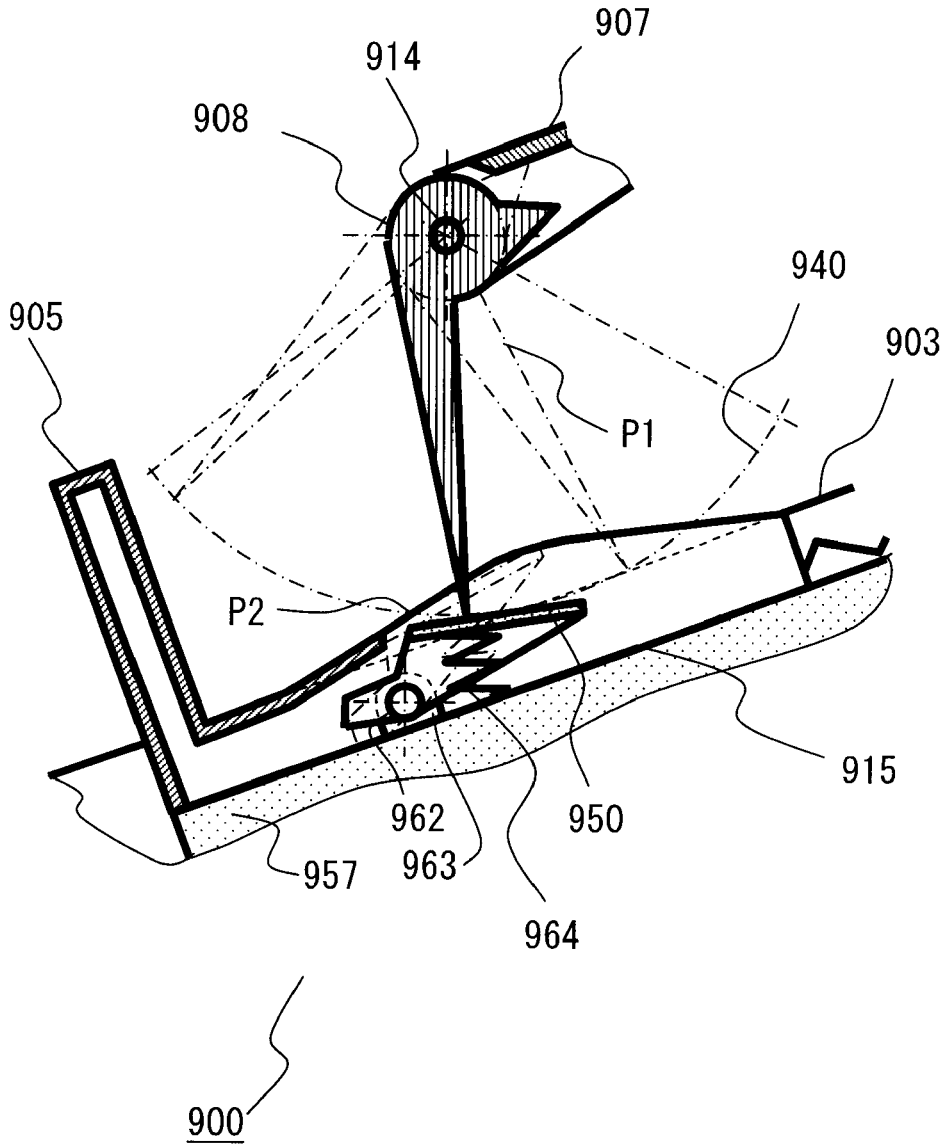
FIG. 71 is a diagram illustrating an exemplary cross-sectional view around a flap of a sheet loader according to a modification of a seventh exemplary embodiment.

As illustrated in FIG. 71, the flap 950 moves from the circular arc 940 by the push of the lower end of the forearm 908 passing along the circular arc 940 through a section from the position P2 to a position where the obverse face of the forearm 908 contacts the first end of the roof of the flap 950.

After the lower end of the forearm 908 passes by the position where the obverse face of the forearm 908 contacts the first end of the roof of the flap 950, the first end of the roof of the flap 950 raises up to be in plane with, or under, the valley wall by the expansion force of the spring 964. As a result, the forearm 908 can go back to the position illustrated in FIG. 59 to contact the first end of the roof of the flap 950 more easily.

(3) Embodiments of a Sheet Folding Apparatus and a Sheet Finishing System

Figure 72:
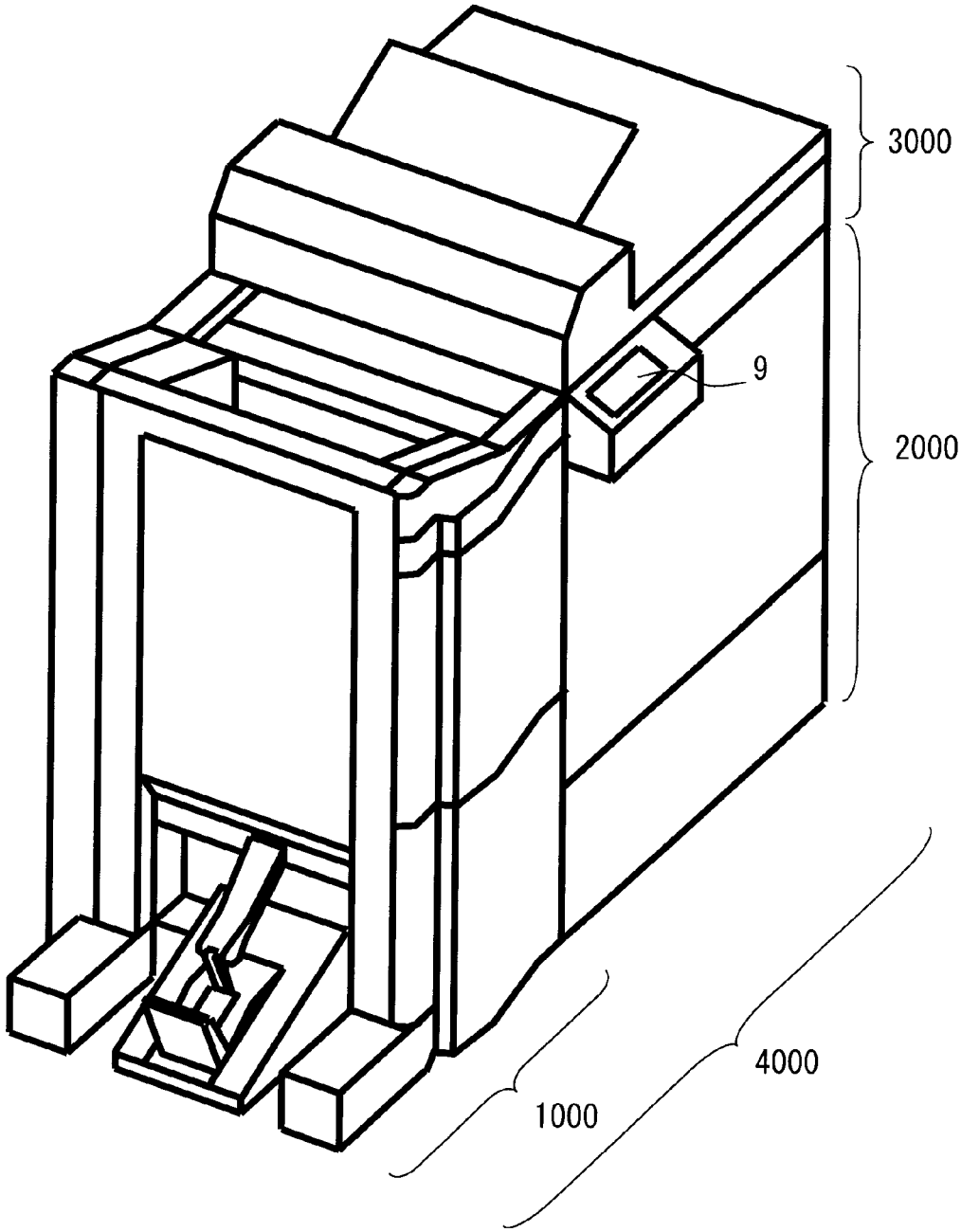
FIG. 72 is a diagram illustrating an exemplary perspective view of a sheet finishing system.

FIG. 72 illustrates a perspective view of a sheet finishing system 4000 as an exemplary embodiment. The sheet finishing system 4000 includes a scanner 3000, a printer 2000, and a sheet folding apparatus 1000. Generally, a side with the operation panel 9 of the printer 2000 is a so called front side, and the opposite side is a so called rear side.

Figure 73:
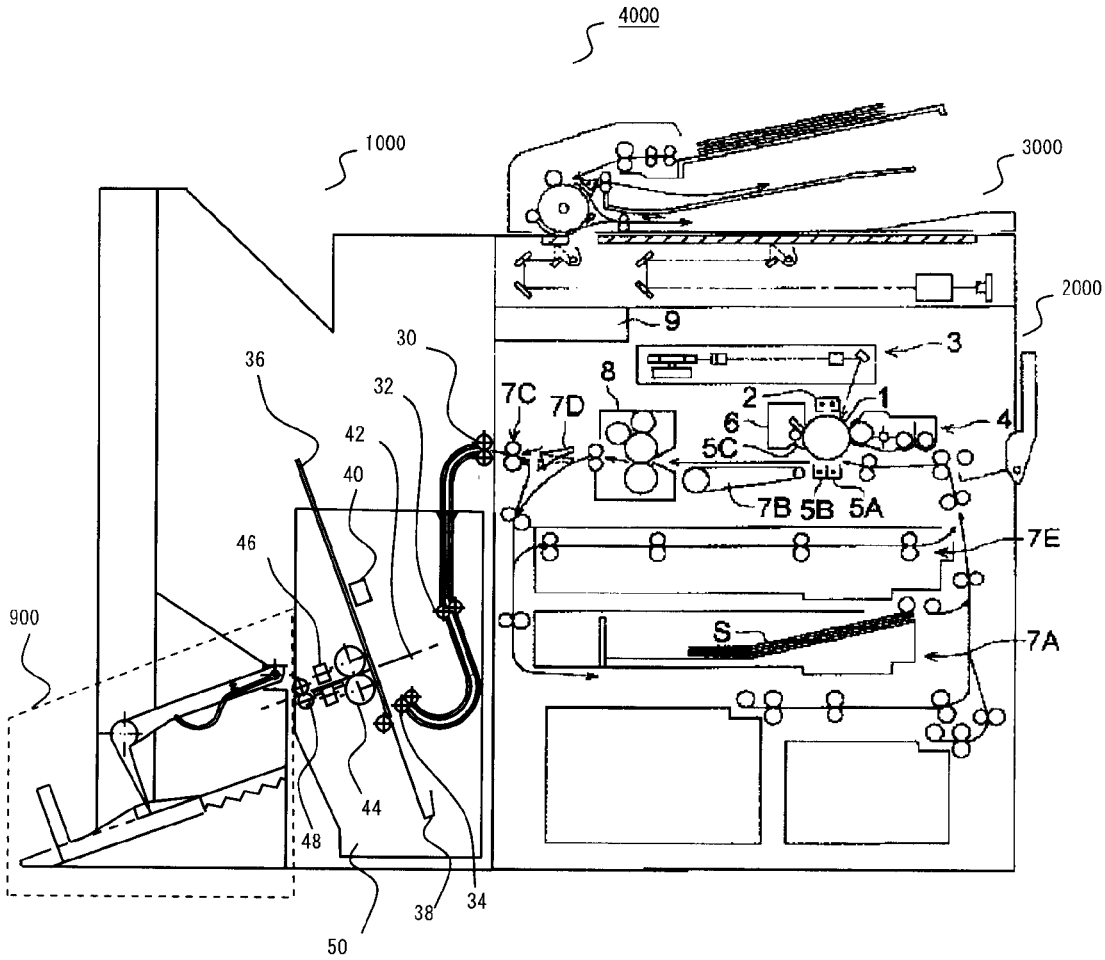
FIG. 73 is a diagram illustrating an exemplary cross-sectional view of a sheet finishing system.

FIG. 73 illustrates a cross-sectional view of the sheet finishing system 4000. The scanner 3000 above the printer 2000 scans an image of a manuscript.

The printer 2000 may have the operation panel 9 on its upper front side. The operation panel 9 may have a button to start the scanning, and may have buttons to select a mode for an image processing and a mode for a sheet finishing from pluralities of choices.

The printer 2000 has an image processing portion which includes a charger 2, an exposure unit 3, an image developer 4, an image transfer unit 5A, an electric discharger 5B, a separator 5C, and a cleaner 6, with all of the components being arranged around a latent image carrier 1 which rotates around its axis.

After the charger 2 charges the surface of the latent image carrier 1 uniformly along the axis, the exposure unit 3 exposes a laser beam to form a latent image on the charged surface of the latent image carrier 1 based on information about the manuscript obtained by the scan of the scanner 3. The developer 4 develops the latent image to a toner image on the latent image carrier 1. The transfer unit 5A transfers the toner image from the latent image carrier 1 on an obverse side of a sheet which is supplied from a sheet stacker 7A. Thereafter, the electric discharger 5B discharges electricity on a reverse side of the sheet, the separator 5C separates the sheet from the latent image carrier 1, and the cleaner 6 removes residual toner from the surface of the latent image carrier 1. Additionally, an intermediate conveyer 7B conveys the sheet, a fixing unit 8 fixes the toner image on the sheet, and a conveying roller pair 7C conveys the sheet.

In a duplex image forming mode, a path switch 7D connects a path from the fixing unit 8 to a sheet inverter 7E to switchback the sheet at first, and the path switch 7D reconnects the path from the fixing unit 8 to the conveying roller pair 7C after forming an image on the reverse side of the sheet.

The conveying roller pair 7C conveys the sheet to the sheet finishing apparatus FS.

The sheet folding apparatus 1000 has an inlet roller pair 30 to receive the sheet, and an intermediate transfer roller pair 32 to receive the sheet from the inlet roller pair 30.

The intermediate transfer roller pair 32 releases the sheet to an injection roller pair 34. The injection roller pair 34 injects the sheet upwards along an inclined direction to position the sheet on a standing tray 36 which has a surface inclined in a substantially similar direction as the injection direction in order to support the sheet.

A stacker 38 is positioned below the standing tray 36 to catch a lower end of the sheet which switchbacks on and falls along the standing tray 36. The stacker 38 remains still until a plurality of sheets makes a plane sheet bundle.

A stapler 40 is set above the standing tray 36. The stapler 40 staples at two points on a middle line of the length of the plane sheet bundle.

In a saddle stitch finishing mode, the stacker 38 is positioned to receive the sheet bundle so as to face the middle line of the sheet bundle to the stapler 40. The stacker 38 then descends so as to face the middle line of the sheet bundle to a blade 42 after the stapler 40 staples the sheet bundle.

The blade 42 has a tip line almost parallel to the lower end of the sheet bundle supported by the stacker 38. The blade 42 rams the sheet bundle with the tip line after facing the middle line of the sheet bundle.

A folding roller pair 44 makes a nip between its rollers on a ramming direction of the blade 42. The nip convolves the plane sheet bundle rammed by the blade 42 to make a folded edge on the sheet bundle.

The folded edge of the sheet bundle comes out from the nip and is traced by a fold enhancer 46.

A discharging roller pair 48 tows the sheet bundle to discharge on a sheet loader. Although the sheet loader is described here as the same as the sheet loader 900 of Embodiment 7, the sheet loader may alternatively be any of the other sheet loaders described in other embodiments or combinations thereof.

An inner frame 50 may support the intermediate transfer roller pair 32, the injection roller pair 34, a part of the standing tray 36, the stacker 38, the stapler 40, the blade 42, the folding roller pair 44, the fold enhancer 46 and the discharging roller pair 48. The intermediate transfer roller pair 32, the injection roller pair 34, a part of the standing tray 36, the stacker 38, the stapler 40, the blade 42, the folding roller pair 44, the fold enhancer 46 and the discharging roller pair 48 are removed together with the inner frame 50 at the same time from an inside of an outer frame 54 of the sheet folding apparatus 1000.

Figure 74:
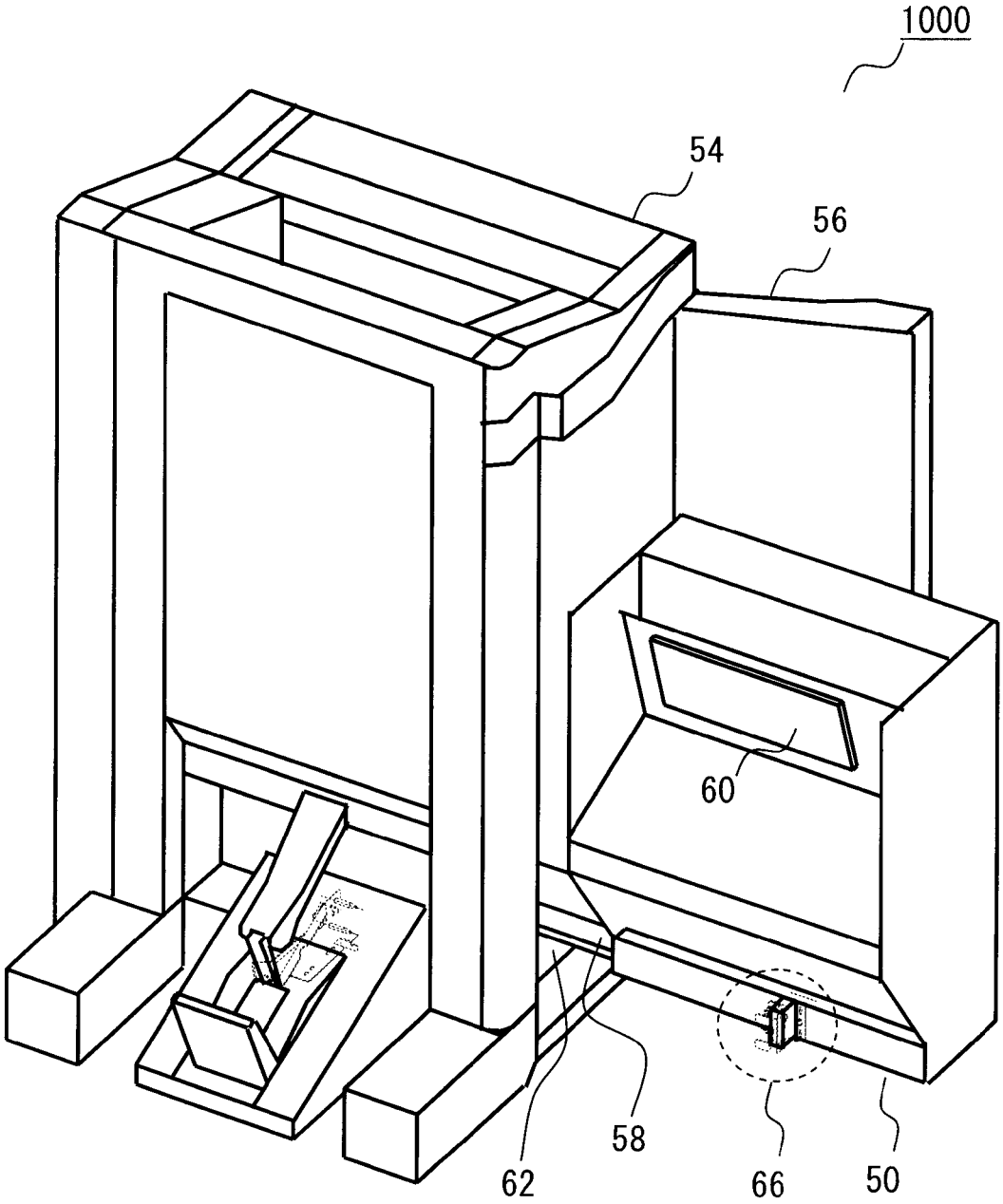
FIG. 74 is a diagram illustrating an exemplary perspective view of a sheet folding apparatus.

FIG. 74 illustrates a perspective view of the sheet folding apparatus 1000 with the inner frame 50 pulled out of the outer frame 54. The inner frame 50 moves along a rail 58 extended between the front side and the rear side. A floor plate 62 fixed at a bottom of the outer frame 54 supports the rail 58 so as to move between the front side and the rear side along a longitudinal direction of the rail 58.

The sheet folding apparatus 1000 has a door 56 on the front side. The inner frame 50 linearly exits out of the outer frame 54 along the rail 58 from an opening appearing after the door 56 opens. Consequently, sheets jammed in the sheet folding apparatus 1000 can be removed easily.

The inner frame 50 carries a controller 60 to manage control of the whole of the sheet folding apparatus 1000. The controller 60 is located at an easily touchable position after pulling the inner frame 50 out of the outer frame 54.

Figure 75:
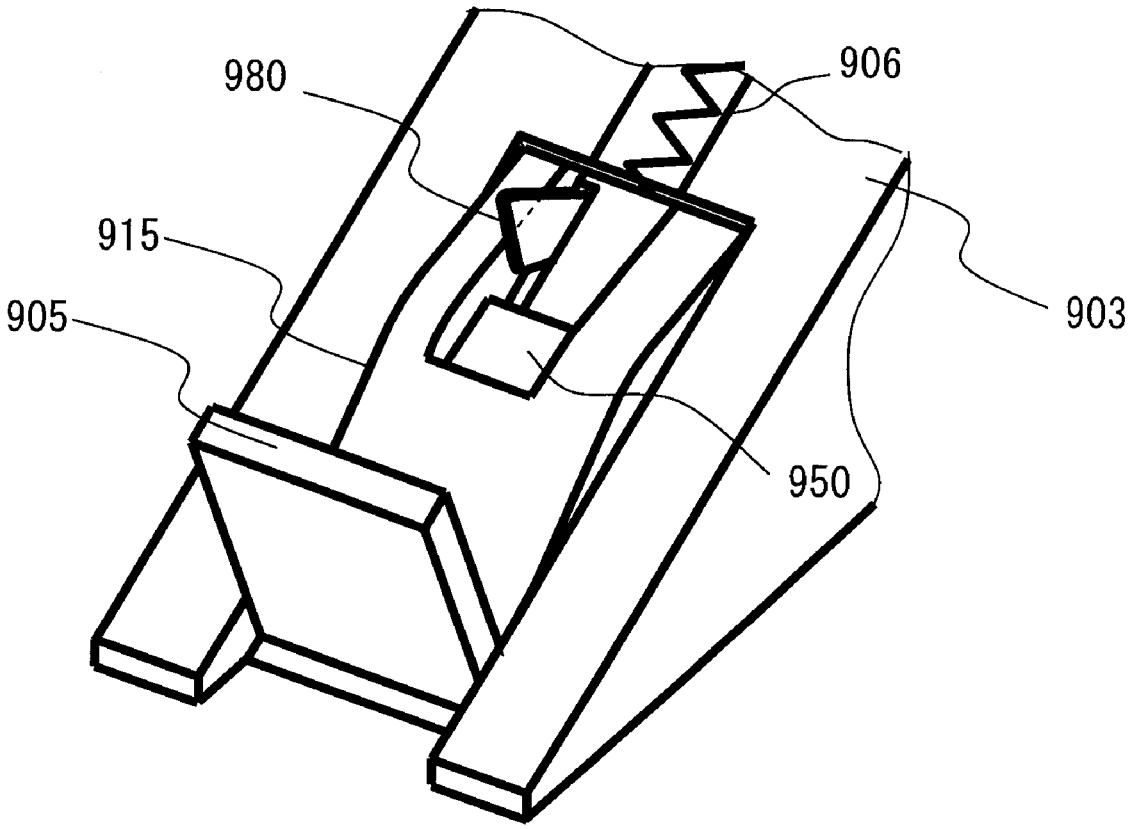
FIG. 75 is a diagram illustrating an exemplary perspective view around a sheet sensor of a sheet folding apparatus.

FIG. 75 illustrates a perspective view of the sheet loader 900 around a sheet sensor 980 projecting up from the base plate 915. The controller 60 determines whether a tip of the sheet sensor 980 projects up from, or is depressed into, the base plate 905.

The controller 60 is mounted on the inner frame 50, and the sheet sensor 980 is mounted on the outer frame 54. Since the inner frame 50 and the outer frame 54 move relative to each other as described above, some intracracies described below to lay out wire harnesses for transferring the state of the sheet sensor 980 to the controller 60.

Figure 76:
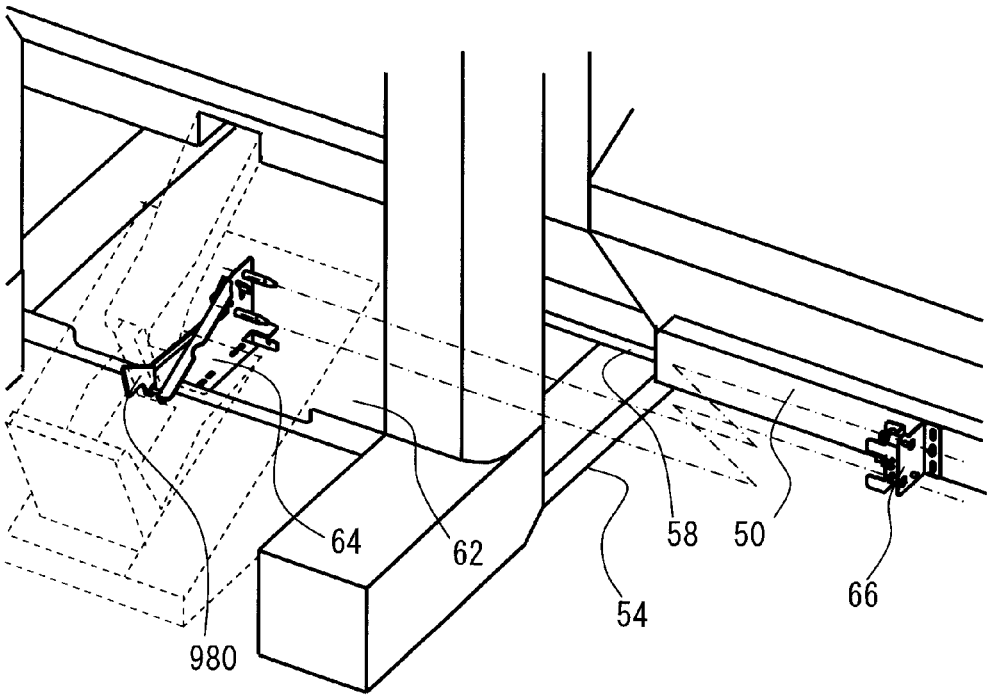
FIG. 76 is a diagram illustrating an exemplary perspective view around a sheet sensor of a sheet folding apparatus.

FIG. 76 illustrates a close-up view of the sheet folding apparatus 1000 around a sheet sensor 980 with the inner frame 50 pulled out of the outer frame 54. A mechanical sensor unit 64 is mounted on the floor plate 62 to rotatably support the sheet sensor 980. An electrical sensor unit 66 is mounted on the inner frame 50 to convert the motion of the sheet sensor 980 into an electrical signal. When the inner frame 50 moves straight to the rear side from the front side along the rail 58 to fit into the outer frame 54, the mechanical sensor unit 64 and the electrical sensor unit 66 are in such relative positions that the electrical sensor unit 66 can detect motion of the mechanical sensor unit 64.

Figure 77:
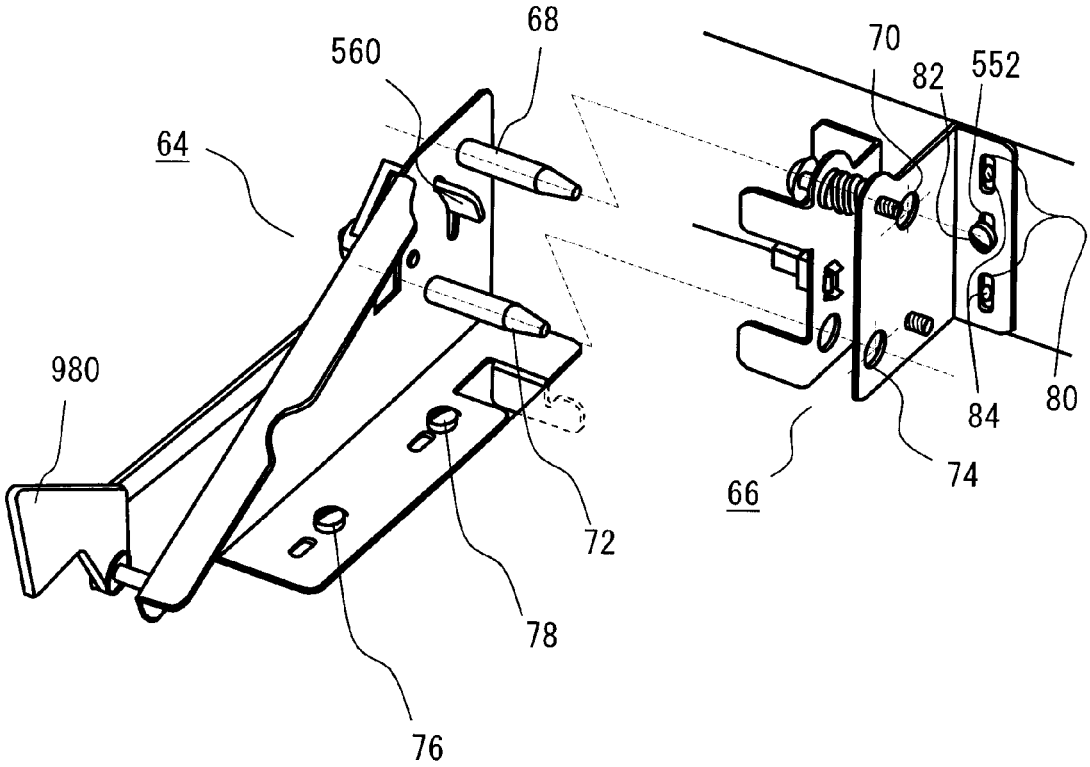
FIG. 77 is a diagram illustrating an exemplary perspective view of a mechanical sensor unit and an electrical sensor unit of a sheet folding apparatus.

FIG. 77 illustrates a close-up view of the mechanical sensor unit 64 and the electrical sensor unit 66 when they approach each other. The mechanical sensor unit 64 has an upper registration shaft 68 and a lower registration shaft 72 along the direction of movement of the inner frame 50. The shafts are fit respectively into an upper registration slot 70 and a lower registration slot 74 of the electrical sensor unit 66. The electrical sensor unit 66 may have one or more registration shafts, and then the mechanical sensor unit 64 may have registration slots to fit the registration shafts.

The mechanical sensor unit 64 is fixed on the floor plate 62 with screws 76 and 78. The screws 76 and 78 are put respectively through oval holes on the mechanical sensor unit 64. Major axes of the oval holes are parallel to each other and perpendicular to the direction along which the inner frame 50 moves. After the screws 76 and 78 are loosened, the mechanical sensor unit 64 can slide along the major axes of oval holes.

The electrical sensor unit 66 is fixed on the inner frame 50 with a screw 82. The electrical sensor unit 66 has three oval holes including a pair of oval holes 80 and a middle oval hole 552 between the pair of oval holes 80. Major axes of the three oval holes are parallel to each other and perpendicular to directions along which the inner frame 50 moves and the mechanical sensor unit 64 slides. The screw 82 is put through the middle oval hole 552. After the screw 82 is loosened, the electrical sensor unit 66 can slide along the major axis of the oval hole.

The inner frame 50 has two cylindrical projections 84 to fit respectively into the pair of oval holes 80 to guide the slide and to avoid rotation of the electrical sensor unit 66.

Figure 78:
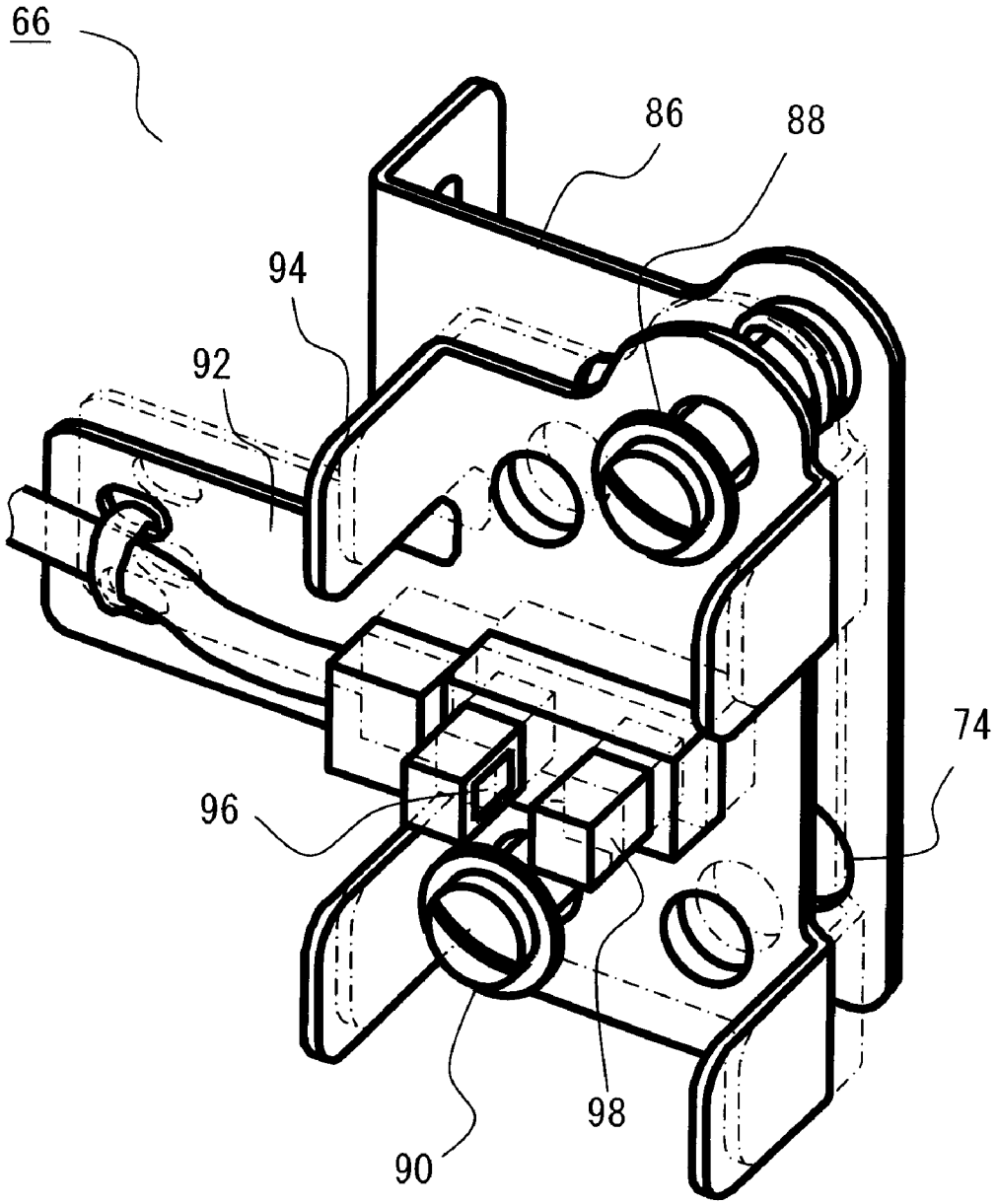
FIG. 78 is a diagram illustrating an exemplary perspective view of an electrical sensor unit of a sheet folding apparatus.

FIG. 78 illustrates a rear side perspective view of the electrical sensor unit 66. A base board 86 is fixed to the inner frame 50 with the screw 82 in FIG. 77. Half-screws 88 and 90 are screwed on the base board 86.

A movable board 92 has four holes. Diameters of two of the holes are smaller than the heads of and are bigger than necks of the half-screws 88 and 90. The half-screws 88 and 90 are put through the two holes, respectively.

The movable board 92 can slide within a distance of the length of necks of the half-screws 88 and 90 from the base board 86.

The remaining holes of the four holes are on axes of, and have bigger diameters than the upper registration slot 70 and the lower registration shaft 72, respectively.

The movable board 92 supports a receiver 96 and an emitter 98 on its vertical reference plane. The receiver 96 and the emitter 98 work as a photo interrupter in combination with each other. There is a sensing slot between the receiver 96 and the emitter 98. The photo interrupter detects whether something blocks a light from the emitter 98 to the receiver 96 is present in the sensing slot or not.

Pillars 94 stand almost perpendicular to the reference plane with their tops from the reference plane being higher than tops of the receiver 96 and the emitter 98.

Figure 79:
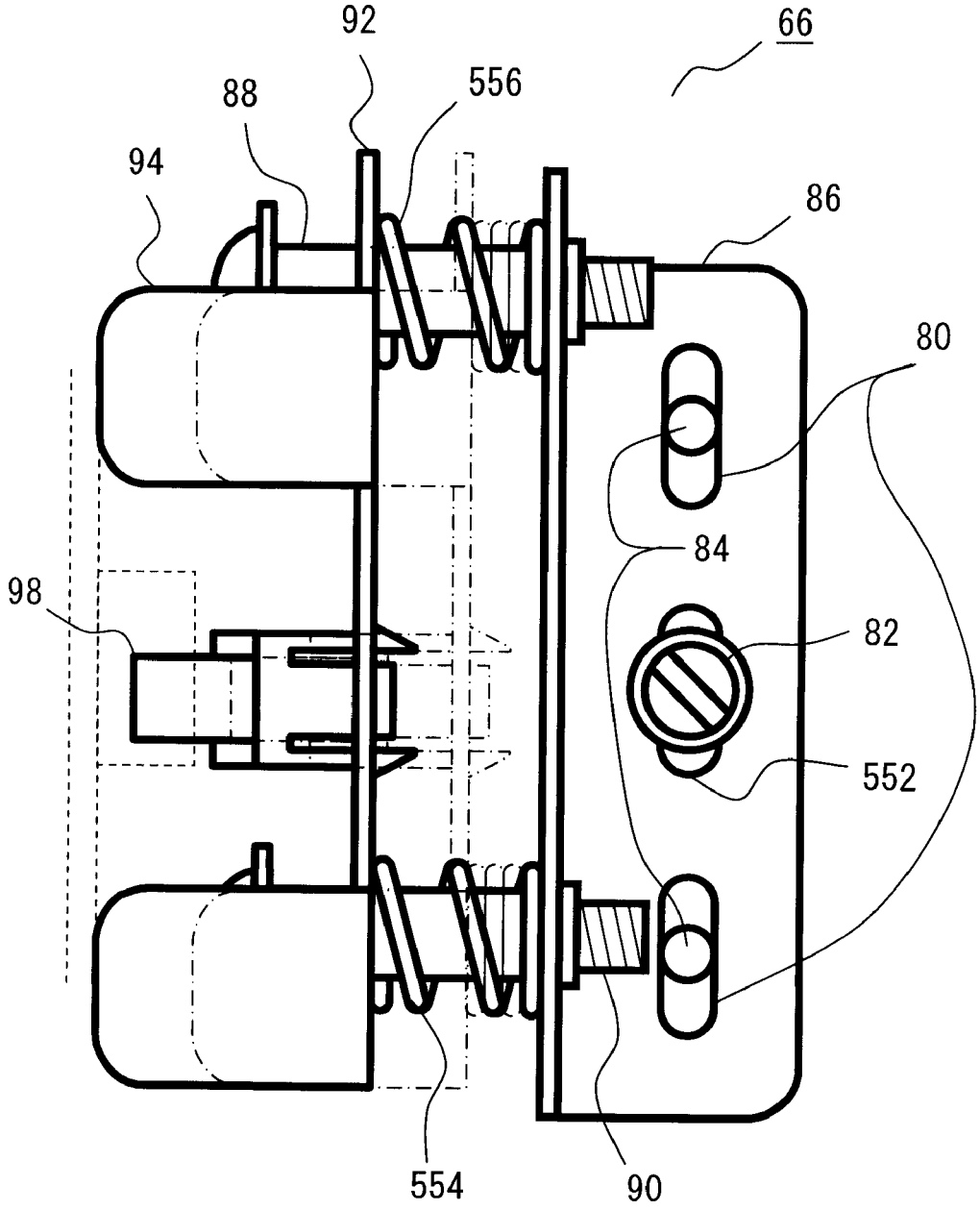
FIG. 79 is a diagram illustrating an exemplary side view of an electrical sensor unit of a sheet folding apparatus.

FIG. 79 illustrates a left side view of the electrical sensor unit 66. Springs 554 and 556 are put around the necks of the half-screws 88 and 90, respectively. The springs 554 and 556 stretch between the movable board 92 and the base board 86.

The movable board 92 is moved toward the base board 86 when the pillars 94 are pushed by the mechanical sensor unit 64. On the other hand, the springs 554 and 556 expand to force the movable board 92 against the mechanical sensor unit 64 to ensure a relative position between them.

When the pillars 94 are in contact with the mechanical sensor unit 64, the tops of the receiver 96 and the emitter 98 have clearances from a plane where the mechanical sensor unit 64 and the pillars 94 are in contact with each other. Furthermore, the pillars 94 are long enough for a bottom of the sensing slot not to contact a breaker plate 560 of the mechanical sensor unit 64.

Figure 80:
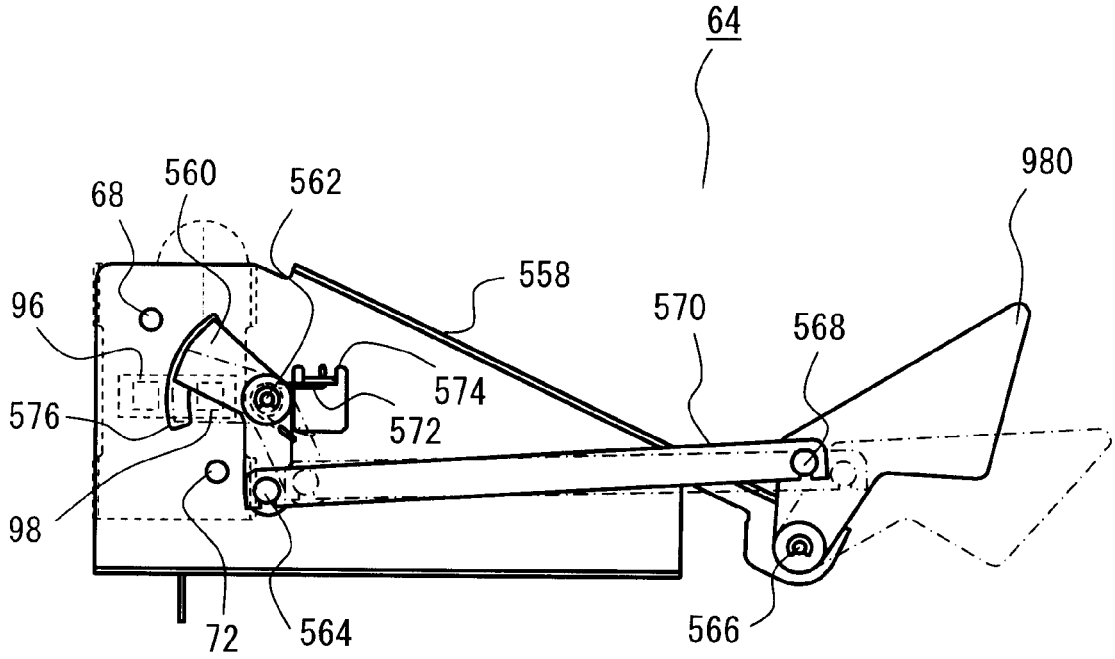
FIG. 80 is a diagram illustrating an exemplary rear side view of a mechanical sensor unit of a sheet folding apparatus.

FIG. 80 illustrates a rear side view of the mechanical sensor unit 64. The screws 76 and 78 screw a supporting board 558 on the floor plate 62. The supporting board 558 has screw holes on a face where the pillars 94 of the electrical sensor unit 66 contact. The upper registration shaft 68 and the lower registration shaft 72 are screwed into the screw holes, respectively.

The supporting board 558 has an arc slit 576 on the face where the pillars 94 of the electrical sensor unit 66 contact. A rotation shaft 562 is put at a track center of the arc slit 576. The arc slit 576 overlaps the sensing slot. The breaker plate 560 rotates around the rotation shaft 562. One end of the breaker plate 560 is bent behind the plane of the paper so as to be almost parallel to the rotational axis 562 around the arc slit 576. The one end is inserted into the arc slit 576 to move across the sensing slot. The breaker plate 560 rotates to take an active position to block the light from the emitter 98 to the receiver 96 with the one end, and a rest position not to interfere with the light. The active position is lower than the rest position.

The breaker plate 560 is biased by a spring 572 to a clockwise direction in FIG. 80 to push the one end up to the rest position. One end of the spring 572 connects to a stay 574 which is a part of the supporting board 558 bent in front of the plane of the paper. The other end of the spring 572 connects to the breaker plate 560. The other end of the breaker plate 560 supports a shaft 564. The shaft 564 supports one end of an arm 570 rotatably. The other end of the arm 570 connects to a shaft 568 rotatably. The shaft 568 is supported by the sheet sensor 980. The supporting board 558 supports a shaft 556 to support the sheet sensor 980 rotatably.

When the one end of the breaker plate 560 is out of the sensing slot, the shaft 564 pulls the arm 570 by the bias of the spring 572 applied on the breaker plate 560, the arm 570 pulls the shaft 568 to raise the tip of the sheet sensor 980 above the upper surface of the base plate 905.

On the other hand, if the tip of the sheet sensor 980 is depressed into the upper surface of the base plate 905, the shaft 568 pulls the arm 578 to rotate the breaker plate 560 against the bias of the spring 572 through the arm 570 and the shaft 564, and the one end of the breaker plate 560 blocks the light from the emitter 98 to the receiver 96.

Although the invention is shown and described with respect to certain illustrated aspects, it will be appreciated that equivalent alterations and modifications will occur to others skilled in the art upon the reading and understanding of this specification and the annexed drawings. In particular regard to the various functions performed by the above described components, the terms used to describe such components are intended to correspond, unless otherwise indicated, to any component which performs the specified function of the described component (e.g., that is functionally equivalent), even though not structurally equivalent to the disclosed structure, which performs the function in the herein illustrated exemplary aspects of the invention.

What is claimed is:

1. A sheet loader for loading a folded sheet bundle provided from a sheet bundle provider with a folded edge of the folded sheet bundle in a lead, comprising:

an undersurface support configured to support an undersurface of the folded sheet bundle provided from the sheet bundle provider;

a folded edge blocker configured rotate around a fulcrum on a first end to take a blocking position to block the folded edge of the folded sheet bundle on the undersurface support and a releasing position to release the folded sheet bundle; and a joint configured to evacuate from an orbit of a second end of the folded edge blocker rotating from the releasing position to the blocking position around the fulcrum, the joint is configured to join the undersurface support with the second end of the folded edge blocker at the blocking position after the rotating to the blocking position.

2. The sheet loader according to claim 1, wherein the first end is an upper end, and the second end is a lower end.

3. The sheet loader according to claim 1, further comprising a chassis configured to move in a direction where the folded sheet bundle discharged from the sheet bundle provider toward with being mounted the undersurface support on; and wherein the fulcrum is supported by the chassis.

4. The sheet loader according to claim 3, further comprising a canceller configured to rotate around a first fulcrum which is on a first end of the canceller and supported by the sheet bundle provider; and wherein the folded edge blocker rotates around a second fulcrum which is on an upper end of the folded edge blocker and at a second end of the canceller.

5. A sheet loader for loading a folded sheet bundle provided from a sheet bundle provider with a folded edge of the folded sheet bundle in a lead, comprising:

an undersurface support, comprising a hill on an upper surface thereof to support an undersurface of the folded sheet bundle provided from the sheet bundle provider;

a slot on a mountain slope of the hill;

a folded edge blocker configured to take a blocking position to block the folded edge of the folded sheet bundle on the undersurface support and a releasing position to release the folded sheet bundle; and a joint, at a first end of the slot further from the sheet bundle provider than a second end of the slot, configured to evacuate from an orbit of the folded edge blocker returning from the releasing position to the blocking position, the joint being configured to join the undersurface support with the folded edge blocker at the blocking position after the returning to the blocking position.

6. The sheet loader according to claim 5, further comprising a biasing member configured to bias the folded edge blocker toward the sheet bundle provider.

7. The sheet loader according to claim 5, wherein the joint comprises a joint fulcrum to rotate around below an upper surface of the undersurface support.

8. The sheet loader according to claim 5, wherein the joint comprises a roof in plane with an upper surface of the undersurface support when joining on the folded edge blocker.

9. The sheet loader according to claim 5, wherein the joint comprises a roof below an upper surface of the undersurface support when joining on the folded edge blocker.

10. The sheet loader according to claim 9, wherein the joint comprises a joint fulcrum at a position further from the sheet bundle provider than a position where an orbit of the folded edge blocker crosses with the undersurface support.

11. The sheet loader according to claim 5, wherein the joint comprises a roof with a first end, a second end and a joint fulcrum, the first end joins on the folded edge blocker at the blocking position, and the joint fulcrum is relatively fixed with the undersurface support at under the second end of the roof to rotate around.

12. The sheet loader according to claim 5, wherein the undersurface support comprises a moving mechanism to move in a direction where the folded sheet bundle discharged from the sheet bundle provider toward.

13. A sheet loader for loading a folded sheet bundle provided from a sheet bundle provider with a folded edge of the folded sheet bundle in a lead, comprising:

an undersurface support comprising a hill on an upper surface thereof to support an undersurface of the folded sheet bundle provided from the sheet bundle provider;

a folded edge blocker configured to take a blocking position to block the folded edge of the folded sheet bundle on the undersurface support and a releasing position to release the folded sheet bundle, an orbit of the folded end blocker returning from the releasing position to the blocking position to cross with a valley wall of the hill at a crossing position; and a joint configured to join at a first end thereof with the folded edge blocker at the blocking position and configured to rotate around a joint fulcrum thereof supported by the undersurface support under a second end thereof at a position further from the sheet bundle provider than the crossing position to evacuate from the orbit.

14. The sheet loader according to claim 13, wherein the undersurface support comprises a moving mechanism to move in a direction where the folded sheet bundle discharged from the sheet bundle provider toward.

15. The sheet loader according to claim 13, wherein the joint forms a part of a surface of the hill.

16. The sheet loader according to claim 13, further comprising a biasing member configured to bias the folded edge blocker toward the sheet bundle provider.

17. The sheet loader according to claim 13, wherein the joint comprises a roof in plane with the upper surface when joining on the folded edge blocker.

18. The sheet loader according to claim 13, wherein the joint comprises a roof below the upper surface when joining on the folded edge blocker.

19. The sheet loader according to claim 13, wherein the undersurface support comprises a moving mechanism to move in a direction where the folded sheet bundle discharged from the sheet bundle provider toward.

* * * * *